US008624937B2

(12) United States Patent
Lee et al.

(10) Patent No.: US 8,624,937 B2
(45) Date of Patent: Jan. 7, 2014

(54) DATA DRIVING DEVICE AND LIQUID CRYSTAL DISPLAY DEVICE USING THE SAME

(75) Inventors: Joo Hong Lee, Gyeongsangbuk-do (KR); Hong Sung Song, Gyeongangbuk-do (KR); Woong Ki Min, Daegu-si (KR); Yong Gi Son, Gyeongsangnam-do (KR)

(73) Assignee: LG Display Co., Ltd., Seoul (KR)

( * ) Notice: Subject to any disclaimer, the term of this patent is extended or adjusted under 35 U.S.C. 154(b) by 606 days.

(21) Appl. No.: 12/292,536

(22) Filed: Nov. 20, 2008

(65) Prior Publication Data

US 2009/0153593 A1 Jun. 18, 2009

(30) Foreign Application Priority Data

Dec. 13, 2007 (KR) ..... 10-2007-0129739

(51) Int. Cl.
*G09G 5/10* (2006.01)

(52) U.S. Cl.
USPC ..... 345/690

(58) Field of Classification Search
USPC ..... 345/690, 89, 95, 100, 204
See application file for complete search history.

(56) References Cited

U.S. PATENT DOCUMENTS

| | | | | |
|---|---|---|---|---|
| 5,250,937 | A | 10/1993 | Kikuo et al. | 345/89 |
| 6,008,801 | A * | 12/1999 | Jeong | 345/204 |
| 7,193,637 | B2 * | 3/2007 | Kudo et al. | 345/690 |
| 2002/0126112 | A1 * | 9/2002 | Kato | 345/204 |
| 2004/0075674 | A1 * | 4/2004 | Bu | 345/690 |
| 2004/0233182 | A1 * | 11/2004 | Chuang et al. | 345/204 |
| 2005/0200584 | A1 | 9/2005 | Kudo et al. | 345/89 |
| 2006/0214895 | A1 * | 9/2006 | Shih et al. | 345/88 |
| 2007/0182683 | A1 * | 8/2007 | Chin et al. | 345/88 |
| 2007/0182902 | A1 * | 8/2007 | Chung et al. | 349/129 |
| 2008/0062115 | A1 * | 3/2008 | Brown | 345/102 |
| 2008/0136761 | A1 * | 6/2008 | Hong et al. | 345/89 |

FOREIGN PATENT DOCUMENTS

| | | |
|---|---|---|
| CN | 1499472 | 5/2004 |
| CN | 1658275 | 8/2005 |

OTHER PUBLICATIONS

Chinese Office Action—Patent Application No. 2008-10186990.7, Apr. 26, 2011, China.

* cited by examiner

*Primary Examiner* — William Boddie
*Assistant Examiner* — Towfiq Elahi
(74) *Attorney, Agent, or Firm* — Morgan, Lewis & Bockius LLP

(57) ABSTRACT

A gray scale voltage generator includes a voltage dividing resistor string to generate blue (B), red (R), and green (G) gamma voltage signals, the voltage dividing resistor string including a B gamma voltage signal generating section, a R/G gamma voltage generating section, and a common (COM) gamma voltage generating section to individually control a B gray scale voltage and a R/G gray scale voltage to maintain a constant color temperature.

16 Claims, 29 Drawing Sheets

DATA DRIVING DEVICE AND LIQUID CRYSTAL DISPLAY DEVICE USING THE SAME

This application claims the benefit of Korean Patent Application No. P2007-129739 filed on Dec. 13, 2007, which is hereby incorporated by reference as if fully set forth herein.

BACKGROUND OF THE INVENTION

1. Field of the Invention

The present invention relates to a data driving device and a liquid crystal display device using the same, and more particularly, to a data driving device which is capable of compensating for a color temperature based on a gray scale, and a liquid crystal display device using the same.

2. Discussion of the Related Art

Generally, a liquid crystal display device displays a desired image by applying an electric field to a liquid crystal material having an anisotropic dielectric constant formed between two substrates and adjusting the intensity of the electric field to adjust light transmittance of the liquid crystal material. Such a conventional liquid crystal display device displays a gray scale according to light transmittance of red, green, and blue dots based on each of red (R), green (G) and blue (B) data signals. If the red, green, and blue data signals are the same, the same gray scale voltage is used for the red, green, and blue data signals. That is, the same gray scale voltage is used for all three colors even though it is known that the red, green, and blue dots have different electro-optical characteristics, resulting in a problem where color temperature varies with the gray scale. The color temperature is determined depending on a combination ratio of brightness of the red, green, and blue dots that make up a pixel. However, when the gray scale increases or decreases, the gray scale voltages used for the red, green, and blue data signals cannot be controlled individually, thereby causing the color temperature to be uneven in upper and lower gray scale areas, as shown in FIG. 1.

SUMMARY OF THE INVENTION

Accordingly, the present invention is directed to a data driving device and a liquid crystal display device using the same that substantially obviate one or more problems due to limitations and disadvantages of the related art.

An object of the present invention is to provide a data driving device which is capable of compensating for a color temperature based on a gray scale, and a liquid crystal display device using the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a gray scale voltage generator includes a voltage dividing resistor string to generate blue (B), red (R), and green (G) gamma voltage signals, the voltage dividing resistor string including a B gamma voltage signal generating section, a R/G gamma voltage generating section, and a common (COM) gamma voltage generating section to individually control a B gray scale voltage and a R/G gray scale voltage to maintain a constant color temperature.

In another aspect, a data driving device for a liquid crystal display includes a control circuit to relay red (R), green (G), and blue (B) data signals, a gray scale voltage generator to generate gray scale voltages, a digital processor to latch the R, G, B data signals, and an analog processor to convert the latched R, G, B data supplied from the digital processor into image signals to be displayed on the liquid crystal display, the gray scale voltage generator including a voltage dividing resistor string to generate R, G, and B gamma voltage signals, the voltage dividing resistor string including a B gamma voltage signal generating section, a R/G gamma voltage generating section, and a common (COM) gamma voltage generating section to individually control a B gray scale voltage and a R/G gray scale voltage to maintain a constant color temperature.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the preferred embodiments of the present invention, examples of which are illustrated in the accompanying drawings. Wherever possible, the same reference numbers will be used throughout the drawings to refer to the same or like parts. In the following description of the present invention, a detailed description of known functions and configurations incorporated herein will not be repeated.

Figure 1:
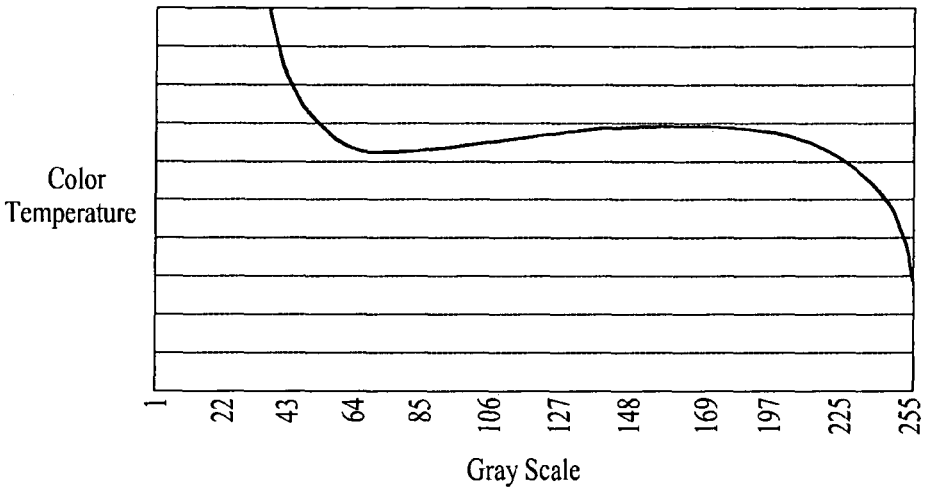
FIG. 1 Related Art
FIG. 1 is a graph illustrating a color temperature based on a gray scale in the related art.
Figure 2:
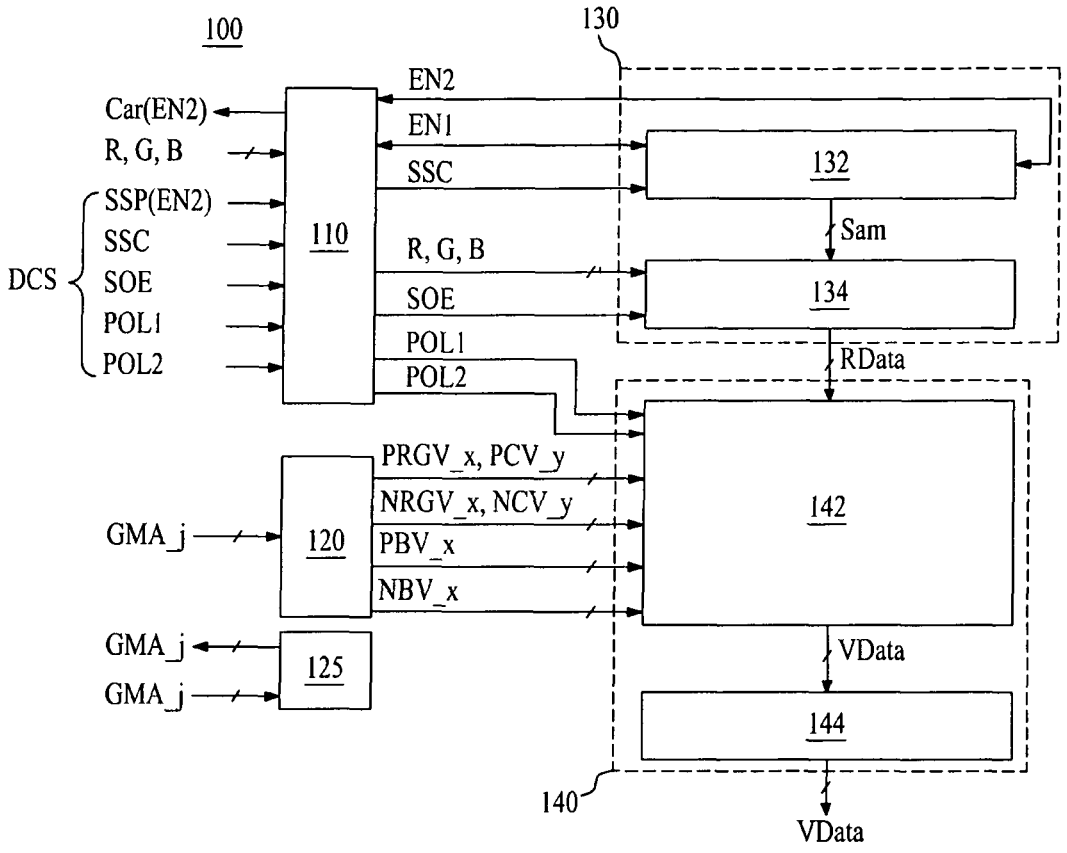
FIG. 2 is a block diagram schematically showing the configuration of a data driving device according to a first embodiment of the present invention.

FIG. 2 is a block diagram schematically showing the configuration of a data driving device according to a first embodiment of the present invention. As shown in FIG. 2, the data driving device 100 according to the first embodiment of the present invention includes a control block 110 for relaying red, green, and blue data signals (R, G, B) and a data control signal DCS externally supplied thereto, a gray scale voltage generator 120 for generating three-color common gray scale voltages CV, blue gray scale voltages PBV and NBV, and red/green gray scale voltages PRGV and NRGV, a digital processor 130 for latching the data signals R, G, and B supplied from the control block 110 in response to data control signals EN1, SSC, and SOE supplied from the control block 110, and an analog processor 140 for converting latched data RData supplied from the digital processor 130 into image signals VData having data polarities corresponding to first and second polarity control signals POL1 and POL2 supplied from the control block 110 using the gray scale voltages CV, PBV, NBV, PRGV, and NRGV.

The control block 110 restores N-bit red, green, and blue data signals R, G, and B, externally supplied thereto via a data interface scheme, such that they correspond to the data interface scheme and supplies the restored red, green, and blue data signals R, G, and B to the digital processor 130. The control block 110 also controls each of the digital processor 130 and analog processor 140 using the data control signal DCS, which includes a source start pulse SSP, a source shift clock SSC, a source output enable signal SOE, and the first and second polarity control signals POL1 and POL2, externally supplied thereto.

Figure 3:
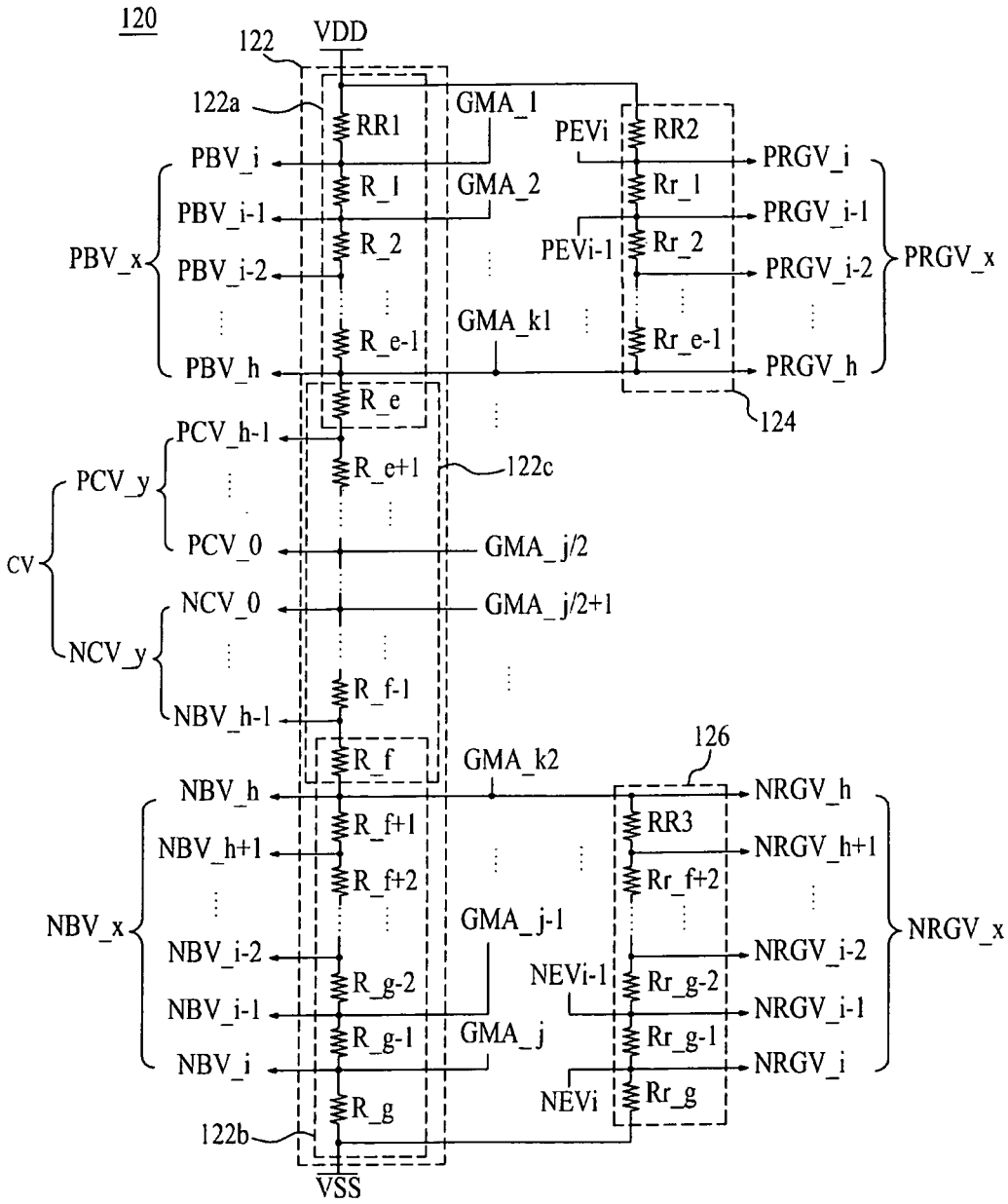
FIG. 3 is a schematic circuit diagram of an exemplary gray scale voltage generator of the data driving device according to the first embodiment of the present invention shown in FIG. 2.

The gray scale voltage generator 120 includes first to third voltage-dividing resistor strings 122, 124 and 126, as shown in FIG. 3. The first voltage-dividing resistor string 122 includes a first resistor RR1 connected to a driving voltage source VDD and first to gth voltage-dividing resistors R_1 to R_g connected in series between the first resistor RR1 and a ground voltage source VSS. The first voltage-dividing resistor string 122 is divided into a first area 122*a*, a second area 122*b*, and a common area 122*c* according to voltages generated by voltage divisions using resistors.

The first area 122*a* includes the first resistor RR1 and the first to eth voltage-dividing resistors R_1 to R_e connected in series to the first resistor RR1. First to (k1)th reference gamma voltages GMA_1 to GMA_k1 (where k1 is a natural number smaller than j/2), among j reference gamma voltages GMA_j (where j is a natural number), are supplied to intermediate voltage-dividing nodes of the first area 122*a*, respectively. For example, the first reference gamma voltage GMA_1 may be supplied to a voltage-dividing node (between RR1 and R_1) that generates an ith gray scale voltage PBV_i among the voltage-dividing nodes of the first area 122*a*, and the second reference gamma voltage GMA_2 may be supplied to a voltage-dividing node (between R_1 and R_2) that generates an (i−1)th gray scale voltage PBV_i−1 among the voltage-dividing nodes of the first area 122*a*. Further, the (k1)th reference gamma voltage GMA_k1 is supplied to a voltage-dividing node (between R_e−1 and R_e) that generates an hth gray scale voltage PBV_h among the voltage-dividing nodes of the first area 122*a*. Here, i is 0 to $2^N$ where N is the number of bits of the data signal (e.g., when the number of bits of the data signal is 8, i=255), h is a natural number smaller than i (e.g., when the number of bits of the data signal is 8, h may be 223), and k1 can be set to a natural number smaller than j/2 depending on at least one of an electro-optical characteristic, gamma characteristic, and color temperature characteristic of a liquid crystal (e.g., when j=18, k1 may be 2 or 3). The first area 122*a* supplies to the analog processor 140, x positive blue upper gray scale voltages PBV_x including the ith to hth gray scale voltages PBV_i to PBV_h generated by the voltage divisions at the corresponding voltage-dividing nodes each formed between every adjacent ones of the first resistor RR1 to the eth voltage-dividing resistor R_e.

The common area 122*c* includes the eth to fth voltage-dividing resistors R_e to R_f. The (k1+1)th to (k2−1)th reference gamma voltages GMA_k1+1 to GMA_k2−1 (where k2 is a natural number larger than j/2 and smaller than j), among the j reference gamma voltages GMA_j, are supplied to intermediate voltage-dividing nodes of the common area 122*c*, respectively. The (k1+1)th to (k2−1)th reference gamma voltages GMA_k1+1 to GMA_k2−1 have regular or irregular voltage differences with respect to the adjacent reference gamma voltages depending on the electro-optical characteristic, color temperature characteristic, and gamma characteristic of the liquid crystal and are supplied to the corresponding voltage-dividing nodes of the common area 122*c*, respectively. For example, the (j/2)th reference gamma voltage GMA_j/2 is supplied to a voltage-dividing node that generates a 0th positive three-color common gray scale voltage PCV_0 among the voltage-dividing nodes of the common area 122*c*, and the (j/2−1)th reference gamma voltage GMA_j/2−1 may be supplied to a voltage-dividing node that generates a first positive three-color common gray scale voltage PCV_1 (not shown) among the voltage-dividing nodes of the common area 122*c*. The (k1+1)th to (j/2−2)th reference gamma voltages GMA_k1+1 to GMA_j/2−2 have regular or irregular voltage differences with respect to the adjacent reference gamma voltages and are supplied respectively to voltage-dividing nodes that generate third to (h−1)th positive three-color common gray scale voltages PCV_3 (not shown) to PCV_h−1, respectively, among the voltage-dividing nodes of the common area 122*c*. The (j/2+1)th reference gamma voltage GMA_j/2+1 is supplied to a voltage-dividing node that generates a 0th negative three-color common gray scale voltage NCV_0 among the voltage-dividing nodes of the common area 122*c*, and the (j/2+2)th reference gamma voltage GMA_j/2+2 is supplied to a voltage-dividing node that generates a first negative three-color common gray scale voltage NCV_1 (not shown) among the voltage-dividing nodes of the common area 122*c*. The (j/2+3)th to (k2−1)th reference gamma voltages GMA_j/2+3 to GMA_k2−1 (not shown) have regular or irregular voltage differences with respect to the adjacent reference gamma voltages and are supplied respectively to voltage-dividing nodes that generate third to (h−1)th negative three-color common gray scale voltages NCV_3 (not shown) to NCV_h−1, respectively, among the voltage-dividing nodes of the common area 122*c*.

This common area 122*c* supplies to the analog processor 140, y positive three-color common gray scale voltages PCV_y including the (h−1)th positive gray scale voltage PCV_h−1 to the 0th positive gray scale voltage PCV_0 generated by the voltage divisions at the corresponding voltage-dividing nodes each formed between every adjacent ones of the eth to fth voltage-dividing resistors R_e to R_f, and y negative three-color common gray scale voltages NCV_y including the 0th negative gray scale voltage NCV_0 to the (h−1)th negative gray scale voltage NCV_h−1 generated by the voltage divisions at the corresponding voltage-dividing nodes each formed between every adjacent ones of the eth to fth voltage-dividing resistors R_e to R_f. When the number of bits of the data signal is 8, for example, the common area 122*c* generates 223 positive three-color common gray scale voltages PCV_y including the 0th to 222th positive gray scale voltages PCV_0 to PCV_222, and 223 negative three-color common gray scale voltages NCV_y including the 0th to 222th negative gray scale voltages NCV_0 to NCV_222.

Alternatively, at least one dummy resistor (not shown) may be connected between the voltage-dividing node that generates the 0th positive three-color common gray scale voltage PCV_0 and the voltage-dividing node that generates the 0th negative three-color common gray scale voltage NCV_0.

The second area 122*b* includes the fth to gth voltage-dividing resistors R_f to R_g connected in series. The (k2)th to jth reference gamma voltages GMA_k2 to GMA_j, among the j reference gamma voltages GMA_j, are supplied to intermediate voltage-dividing nodes of the second area 122*b*, respectively. For example, the (k2)th reference gamma voltage GMA_k2 is supplied to a voltage-dividing node (between R_f and R_f+1) that generates an hth gray scale voltage NBV_h among the voltage-dividing nodes of the second area 122*b*, and the (j−1)th reference gamma voltage GMA_j−1 may be supplied to a voltage-dividing node (between R_g−2 and R_g−1) that generates an (i−1)th gray scale voltage NBV_i−1 among the voltage-dividing nodes of the second area 122*b*. The jth reference gamma voltage GMA_j may be supplied to a voltage-dividing node (between R_g−1 and R_g) that generates an ith gray scale voltage NBV_i among the voltage-dividing nodes of the second area 122*b*. Here, k2 can be set to a natural number larger than j/2 and smaller than j depending on at least one of the electro-optical characteristic, gamma characteristic, and color temperature characteristic of the liquid crystal. For example, k2 may be j−1 or j−2.

The second area 122*b* supplies to the analog processor 140, x negative blue upper gray scale voltages NBV_x including the hth gray scale voltage NBV_h to the ith gray scale voltage NBV_i generated by the voltage divisions at the corresponding voltage-dividing nodes each formed between every adjacent ones of the fth to gth voltage-dividing resistors R_f to R_g. Here, the x negative blue upper gray scale voltages NBV_x have voltage levels that are symmetrical to those of the x positive blue upper gray scale voltages PBV_x with respect to a common voltage (not shown).

The second voltage-dividing resistor string 124 includes a second resistor RR2 and first to (e−1)th positive red/green voltage-dividing resistors Rr_1 to Rr_e−1 having different resistances connected in series between the driving voltage source VDD and the common area 122*c* of the first voltage-dividing resistor string 122 such that they are connected in parallel to the first area 122*a* of the first voltage-dividing resistor string 122. Alternatively, some of the first to (e−1)th positive red/green voltage-dividing resistors Rr_1 to Rr_e−1 may have the same resistance.

The second resistor RR2 is connected to the driving voltage source VDD. This second resistor RR2 has a resistance larger than that of the first resistor RR1 of the first voltage-dividing resistor string 122 to optimize x red/green gray scale voltages PRGV_x in a positive area.

The first to (e−1)th positive red/green voltage-dividing resistors Rr_1 to Rr_e−1 are connected in series between the second resistor RR2 and the eth voltage-dividing resistor R_e of the first voltage-dividing resistor string 122. Here, the second voltage-dividing resistor string 124 has the same structure as that of the first area 122*a* of the first voltage-dividing resistor string 122 with the exception of the resistance of the second resistor RR2. Thus, each of the first to (e−1)th positive red/green voltage-dividing resistors Rr_1 to Rr_e−1 has the same resistance as that of the corresponding ones of the first to (e−1)th voltage-dividing resistors R_1 to R_e−1 arranged in the first area 122*a* of the first voltage-dividing resistor string 122.

One or more positive external voltages PEVi and PEVi−1 and the (k1)th reference gamma voltage GMA_k1 are supplied to intermediate voltage-dividing nodes of the second voltage-dividing resistor string 124. For example, an ith positive gray scale external voltage PEVi corresponding to an ith gray scale voltage PRGV_i may be supplied to a voltage-dividing node (between RR2 and Rr_1) that generates the ith gray scale voltage PRGV_i among the voltage-dividing nodes of the second voltage-dividing resistor string 124, and an (i−1)th positive gray scale external voltage PEVi−1 corresponding to an (i−1)th gray scale voltage PRGV_i−1 may be supplied to a voltage-dividing node (between Rr_1 and Rr_2) that generates the (i−1)th gray scale voltage PRGV_i−1 among the voltage-dividing nodes of the second voltage-dividing resistor string 124. The (k1)th reference gamma voltage GMA_k1 is supplied to a voltage-dividing node (between Rr_e−1 and Rr_e) that generates an hth gray scale voltage PRGV_h among the voltage-dividing nodes of the second voltage-dividing resistor string 124. Rather than the positive gray scale external voltages (e.g., PEVi and PEVi−1), the reference gamma voltages (e.g., GMA_1 and GMA_2) may be supplied to the voltage-dividing nodes, respectively.

The second voltage-dividing resistor string 124 supplies to the analog processor 140, x positive red/green upper gray scale voltages PRGV_x including the ith gray scale voltage PRGV_i to the hth gray scale voltage PRGV_h generated by the voltage divisions at the corresponding voltage-dividing nodes each formed between every adjacent ones of the second resistor RR2 to the (e−1)th positive red/green voltage-dividing resistor Rr_e−1.

The third voltage-dividing resistor string 126 includes a third resistor RR3 and first to (e−1)th negative red/green voltage-dividing resistors Rr_f+2 to Rr_g having different resistances connected in series between the common area 122*c* of the first voltage-dividing resistor string 122 and the ground voltage source VSS such that they are connected in parallel to the second area 122*b* of the first voltage-dividing resistor string 122. Alternatively, some of the first to (e−1)th negative red/green voltage-dividing resistors Rr_f+2 to Rr_g may have the same resistance.

The third resistor RR3 is connected to the fth resistor R_f of the first voltage-dividing resistor string 122. The third resistor RR3 has a resistance smaller than that of the (f+1)th voltage-dividing resistor R_f+1 of the first voltage-dividing resistor string 122 to optimize x red/green gray scale voltages NRGV_x in a negative area.

The first to (e−1)th negative red/green voltage-dividing resistors Rr_f+2 to Rr_g are connected in series between the third resistor RR3 and the ground voltage source VSS. Here, the third voltage-dividing resistor string 126 has the same structure as that of the second area 122*b* of the first voltage-dividing resistor string 122 with the exception of the resistance of the third resistor RR3. Thus, each of the first to (e−1)th negative red/green voltage-dividing resistors Rr_f+2 to Rr_g has the same resistance as that of the corresponding ones of the (f+2)th to gth voltage-dividing resistors R_f+1 to R_g arranged in the second area 122*b* of the first voltage-dividing resistor string 122.

The (k2)th reference gamma voltage GMA_k2 and one or more negative external voltages NEVi−1 and NEVi are supplied to intermediate voltage-dividing nodes of the third voltage-dividing resistor string 126. For example, the (k2)th reference gamma voltage GMA_k2 is supplied to a voltage-dividing node (between RR3 and R_f) that generates an hth gray scale voltage NRGV_h among the voltage-dividing nodes of the third voltage-dividing resistor string 126, and an (i−1)th negative gray scale external voltage NEVi−1 corresponding to an (i−1)th gray scale voltage NRGV_i−1 is supplied to a voltage-dividing node (between Rr_g−2 and Rr_g−1) that generates the (i−1)th gray scale voltage NRGV_i−1 among the voltage-dividing nodes of the third voltage-dividing resistor string 126. An ith negative gray scale external voltage NEVi corresponding to an ith gray scale voltage NRGV_i may be supplied to a voltage-dividing node (between Rr_g−1 and Rr_g) that generates the ith gray scale voltage NRGV_i among the voltage-dividing nodes of the third voltage-dividing resistor string 126. Rather than the negative gray scale external voltages (e.g., NEVi−1 and NEVi), the reference gamma voltages (e.g., GMA_j−1 and GMA_j) may be supplied to the voltage-dividing nodes, respectively.

The third voltage-dividing resistor string 126 supplies to the analog processor 140, x negative red/green upper gray scale voltages NRGV_x including the hth gray scale voltage NRGV_h to the ith gray scale voltage NRGV_i generated by the voltage divisions at the corresponding voltage-dividing nodes each formed between every adjacent ones of the third resistor RR3 to the (e−1)th voltage-dividing resistor Rr_g.

Figure 4:
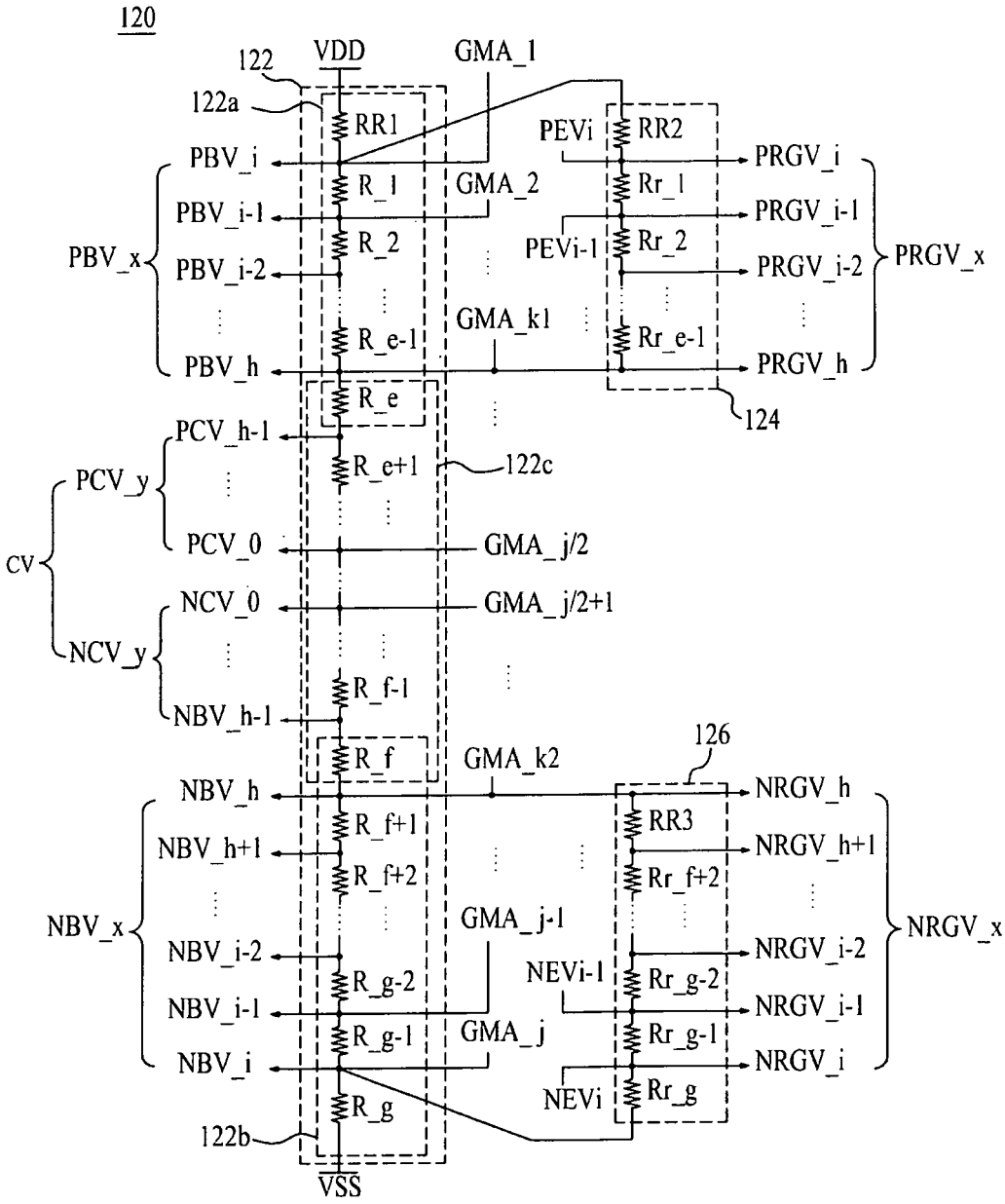
FIG. 4 is a schematic circuit diagram of another exemplary configuration of the gray scale voltage generator shown in FIG. 2.

Alternatively, as shown in FIG. 4, the second resistor RR2 of the second voltage-dividing resistor string 124 may be connected to the voltage-dividing node (between RR1 and R_1) that generates the ith positive gray scale voltage PBV_i (i.e., a positive white voltage) among the voltage-dividing nodes of the first voltage-dividing resistor string 122 rather than to the driving voltage source VDD. Likewise, the gth voltage-dividing resistor Rr_g of the third voltage-dividing resistor string 126 may be connected to the voltage-dividing node (between R_g−1 and R_g) that generates the ith negative gray scale voltage NBV_i (i.e., a negative white voltage) among the voltage-dividing nodes of the first voltage-dividing resistor string 122 rather than to the ground voltage source VSS.

The gray scale voltage generator 120 generates the positive and negative blue upper gray scale voltages PBV_x and NBV_x and the positive and negative three-color common gray scale voltages CV using the first voltage-dividing resistor string 122 and generates the positive and negative red/green upper gray scale voltages PRGV_x and NRGV_x using the second and third voltage-dividing resistor strings 124 and 126. In order to compensate for a color temperature, each of the positive blue upper gray scale voltages PBV_x has a voltage level higher by a predetermined value than each of the positive red/green upper gray scale voltages PRGV_x, and each of the negative blue upper gray scale voltages NBV_x has a voltage level lower by a predetermined value than each of the negative red/green upper gray scale voltages NRGV_x.

The first to jth reference gamma voltages GMA_1 to GMA_j supplied to the gray scale voltage generator 120 are buffered by a gamma buffer 125 built in the data driving device 100, output to an external device (for example, a data printed circuit board) outside the data driving device 100, and then re-supplied to the gray scale voltage generator 120. In this way, when a plurality of data driving devices 100 are used, the gamma voltages are compensated for deviations of the first to jth reference gamma voltages GMA_1 to GMA_j before being supplied to the respective data driving devices 100.

The digital processor 130 includes a shift register 132 and a latch part 134. The shift register 132 sequentially shifts a first enable signal EN1 corresponding to the source start pulse SSP from the control block 110 in response to the source shift clock SSC to generate a sampling signal Sam and supplies the generated sampling signal Sam to the latch part 134. The shift register 132 is a bidirectional shift register. The shift register 132 also generates a forward carry signal Car(EN2) or backward carry signal Car(EN1), which is then supplied as the source start pulse SSP to an external different data driving device through the control block 110.

The latch part 134 latches each of the red, green, and blue data signals R, G, and B supplied from the control block 110 in response to the sampling signal Sam supplied from the shift register 132. Then, the latch part 134 supplies latched data RData to the analog processor 140 in response to the source output enable signal SOE. The latch part 134 sequentially latches the red, green, and blue data signals R, G and B corresponding to the number of output channels of the data driving device 100. That is, the latch part 134 sequentially latches the data signal R of the first channel to the data signal B of the last channel and then outputs the latched data signals R, G, and B of all the channels simultaneously in response to the source output enable signal SOE.

Figure 5:
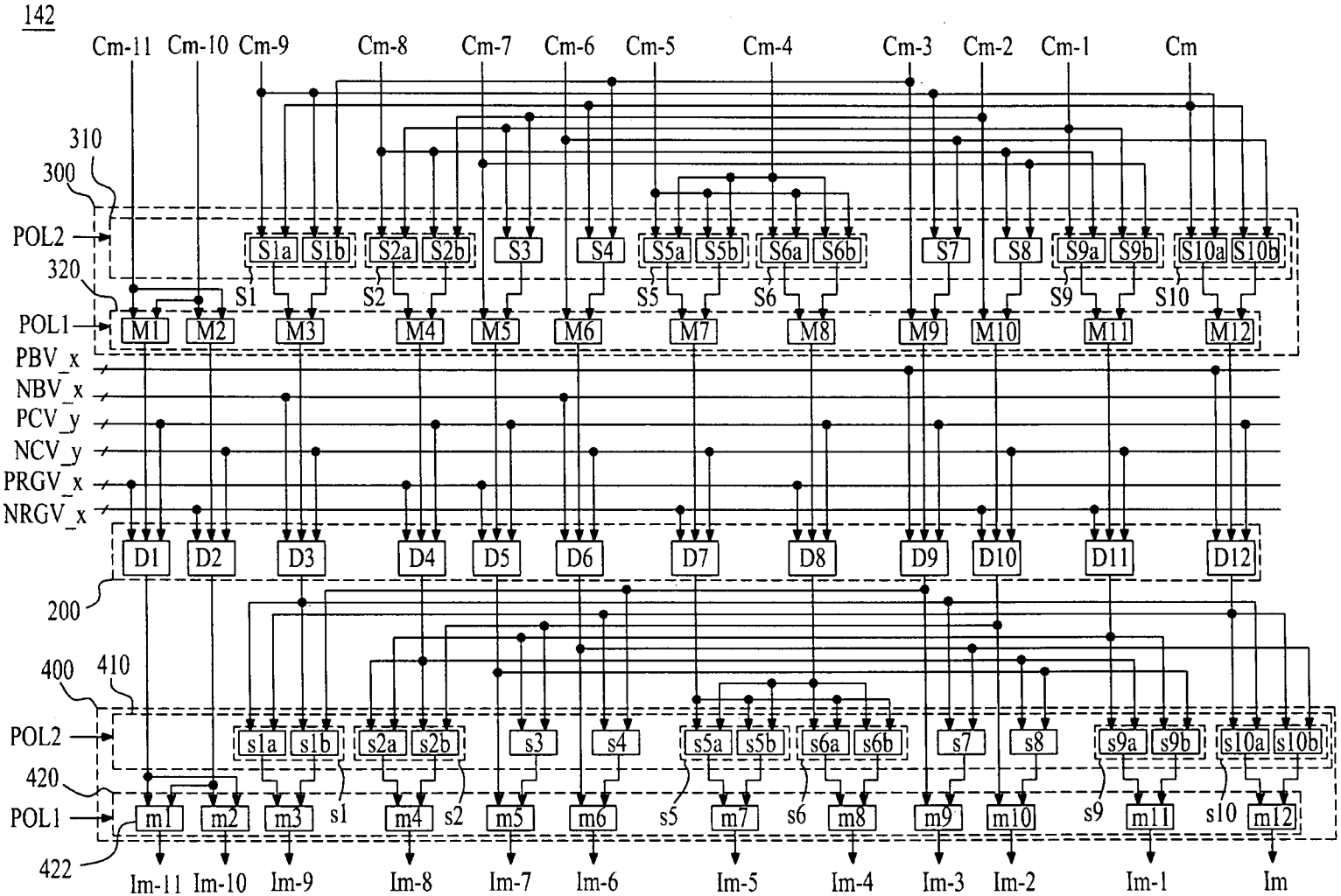
FIG. 5 is a schematic block diagram of an exemplary digital/analog converter shown in FIG. 2.

The analog processor 140 includes a digital/analog (D/A) converter 142 and an output buffer part 144. The D/A converter 142 includes a plurality of data conversion blocks each having 12 channels, as shown in FIG. 5. Each data conversion block includes a data converter 200 for converting latched red, green, and blue data RData input thereto into red, green, and blue image signals Vdata, respectively, using the x positive and negative blue upper gray scale voltages PBV_x and NBV_x, the y positive and negative three-color common gray scale voltages PCV_y and NCV_y, and the x positive and negative red/green upper gray scale voltages PRGV_x and NRGV_x supplied from the gray scale voltage generator 120. Each data conversion block also includes a data path controller 300 for controlling a path of each of the latched red, green, and blue data RData from first to twelfth input channels Cm-11 to Cm (where m is a multiple of 12) to the data converter 200 based on the first and second polarity control signals POL1 and POL2, and an image signal path controller 400 for controlling a path of each of the red, green, and blue image signals Vdata from the data converter 200 to the output buffer part 144 based on the first and second polarity control signals POL1 and POL2.

The data converter 200 includes first to twelfth decoders D1 to D12 including positive (P) decoders and negative (N) decoders arranged to correspond to a horizontal 2-dot inversion mode. Here, the first to twelfth decoders D1 to D12 are repetitively arranged in the order of a positive (P) decoder, a negative (N) decoder, a negative (N) decoder and a positive (P) decoder.

Each of the first, fourth, fifth and eighth decoders D1, D4, D5, and D8 converts the latched red or green data RData into a positive red or green image signal VData using the x positive red/green upper gray scale voltages PRGV_x and the y positive three-color common gray scale voltages PCV_y supplied from the gray scale voltage generator 120.

Each of the second, seventh, tenth, and eleventh decoders D2, D7, D10 and D11 converts the latched red or green data RData into a negative red or green image signal VData using the x negative red/green upper gray scale voltages NRGV_x and the y negative three-color common gray scale voltages NCV_y supplied from the gray scale voltage generator 120.

Each of the ninth and twelfth decoders D9 and D12 converts the latched blue data RData into a positive blue image signal VData using the x positive blue upper gray scale voltages PBV_x and the y positive three-color common gray scale voltages PCV_y supplied from the gray scale voltage generator 120.

Each of the third and sixth decoders D3 and D6 converts the latched blue data RData into a negative blue image signal VData using the x negative blue upper gray scale voltages NBV_x and the y negative three-color common gray scale voltages NCV_y supplied from the gray scale voltage generator 120.

The data path controller 300 controls the path of each of the latched red, green, and blue data RData from the first to twelfth input channels Cm-11 to Cm to the data converter 200 based on the first and second polarity control signals POL1 and POL2 such that the polarities of the image signals correspond to a horizontal 1-dot or horizontal 2-dot inversion mode. To this end, the data path controller 300 includes first and second data path controllers 310 and 320.

The first data path controller 310 includes first to tenth data path selectors S1 to S10. The first data path selector S1 includes a first switch S1*a* for outputting the latched blue data RData supplied to the third or twelfth input channel Cm-9 or Cm in response to the second polarity control signal POL2, and a second switch S1*b* for outputting the latched blue data RData supplied to the ninth or third input channel Cm-3 or Cm-9 in response to the second polarity control signal POL2. The first switch S1*a* selects and outputs the latched blue data RData of the third input channel Cm-9 in response to a first logic state of the second polarity control signal POL2 and selects and outputs the latched blue data RData of the twelfth input channel Cm in response to a second logic state of the second polarity control signal POL2. The second switch S1*b* selects and outputs the latched blue data RData of the ninth input channel Cm-3 in response to the first logic state of the second polarity control signal POL2 and selects and outputs the latched blue data RData of the third input channel Cm-9 in response to the second logic state of the second polarity control signal POL2.

The second data path selector S2 includes a first switch S2*a* for outputting the latched red data RData supplied to the fourth input channel Cm-8 or the latched green data RData supplied to the eleventh input channel Cm-1 in response to the second polarity control signal POL2, and a second switch S2*b* for outputting the latched red data RData supplied to the tenth input channel Cm-2 or the latched red data RData supplied to the fourth input channel Cm-8 in response to the second polarity control signal POL2. The first switch S2*a* selects and outputs the latched red data RData of the fourth input channel Cm-8 in response to the first logic state of the second polarity control signal POL2 and selects and outputs the latched green data RData of the eleventh input channel Cm-1 in response to the second logic state of the second polarity control signal POL2. The second switch S2*b* selects and outputs the latched red data RData of the tenth input channel Cm-2 in response to the first logic state of the second polarity control signal POL2 and selects and outputs the latched red data RData of the fourth input channel Cm-8 in response to the second logic state of the second polarity control signal POL2.

The third data path selector S3 selects and outputs the latched green data RData of the eleventh input channel Cm-1 in response to the first logic state of the second polarity control signal POL2 and selects and outputs the latched red data RData of the tenth input channel Cm-2 in response to the second logic state of the second polarity control signal POL2.

The fourth data path selector S4 selects and outputs the latched blue data RData of the twelfth input channel Cm in response to the first logic state of the second polarity control signal POL2 and selects and outputs the latched blue data RData of the ninth input channel Cm-3 in response to the second logic state of the second polarity control signal POL2.

The fifth data path selector S5 includes a first switch S5*a* for outputting the latched red data RData supplied to the seventh input channel Cm-5 or the latched green data RData supplied to the eighth input channel Cm-4 in response to the second polarity control signal POL2, and a second switch S5*b* for outputting the latched green data RData supplied to the eighth input channel Cm-4 or the latched red data RData supplied to the seventh input channel Cm-5 in response to the second polarity control signal POL2. The first switch S5*a* selects and outputs the latched red data RData of the seventh input channel Cm-5 in response to the first logic state of the second polarity control signal POL2 and selects and outputs the latched green data RData of the eighth input channel Cm-4 in response to the second logic state of the second polarity control signal POL2. The second switch S5*b* selects and outputs the latched green data RData of the eighth input channel Cm-4 in response to the first logic state of the second polarity control signal POL2 and selects and outputs the latched red data RData of the seventh input channel Cm-5 in response to the second logic state of the second polarity control signal POL2.

The sixth data path selector S6 includes a first switch S6*a* for outputting the latched green data RData of the eighth input channel Cm-4 or the latched red data RData of the seventh input channel Cm-5 in response to the second polarity control signal POL2, and a second switch S6*b* for outputting the latched red data RData of the seventh input channel Cm-5 or the latched green data RData of the eighth input channel Cm-4 in response to the second polarity control signal POL2. The first switch S6*a* selects and outputs the latched green data RData of the eighth input channel Cm-4 in response to the first logic state of the second polarity control signal POL2 and selects and outputs the latched red data RData of the seventh input channel Cm-5 in response to the second logic state of the second polarity control signal POL2. The second switch S6*b* selects and outputs the latched red data RData of the seventh input channel Cm-5 in response to the first logic state of the second polarity control signal POL2 and selects and outputs the latched green data RData of the eighth input channel Cm-4 in response to the second logic state of the second polarity control signal POL2.

The seventh data path selector S7 selects and outputs the latched blue data RData of the third input channel Cm-9 in response to the first logic state of the second polarity control signal POL2 and selects and outputs the latched blue data RData of the sixth input channel Cm-6 in response to the second logic state of the second polarity control signal POL2.

The eighth data path selector S8 selects and outputs the latched red data RData of the fourth input channel Cm-8 in response to the first logic state of the second polarity control signal POL2 and selects and outputs the latched green data RData supplied to the fifth input channel Cm-7 in response to the second logic state of the second polarity control signal POL2.

The ninth data path selector S9 includes a first switch S9*a* for outputting the latched green data RData of the eleventh input channel Cm-1 or the latched red data RData of the fourth input channel Cm-8 in response to the second polarity control signal POL2, and a second switch S9*b* for outputting the latched green data RData of the fifth input channel Cm-7 or the latched green data RData of the eleventh input channel Cm-1 in response to the second polarity control signal POL2. The first switch S9*a* selects and outputs the latched green data RData of the eleventh input channel Cm-1 in response to the first logic state of the second polarity control signal POL2 and selects and outputs the latched red data RData of the fourth input channel Cm-8 in response to the second logic state of the second polarity control signal POL2. The second switch S9*b* selects and outputs the latched green data RData of the fifth input channel Cm-7 in response to the first logic state of the second polarity control signal POL2 and selects and outputs the latched green data RData of the eleventh input channel Cm-1 in response to the second logic state of the second polarity control signal POL2.

The tenth data path selector S10 includes a first switch S10*a* for outputting the latched blue data RData of the twelfth input channel Cm or the latched blue data RData of the third input channel Cm-9 in response to the second polarity control signal POL2, and a second switch S10*b* for outputting the latched blue data RData of the sixth input channel Cm-6 or the latched blue data RData of the twelfth input channel Cm in response to the second polarity control signal POL2. The first switch S10*a* selects and outputs the latched blue data RData of the twelfth input channel Cm in response to the first logic state of the second polarity control signal POL2 and selects and outputs the latched blue data RData of the third input channel Cm-9 in response to the second logic state of the second polarity control signal POL2. The second switch S10*b* selects and outputs the latched blue data RData of the sixth input channel Cm-6 in response to the first logic state of the second polarity control signal POL2 and selects and outputs the latched blue data RData of the twelfth input channel Cm in response to the second logic state of the second polarity control signal POL2.

The second data path controller 320 includes first to twelfth data selectors M1 to M12. The first data selector M1 supplies the latched red data RData of the first input channel Cm-11 to the first decoder D1 when the first polarity control signal POL1 is in the first logic state and supplies the latched green data RData of the second input channel Cm-10 to the first decoder D1 when the first polarity control signal POL1 is in the second logic state.

The second data selector M2 supplies the latched green data RData of the second input channel Cm-10 to the second decoder D2 when the first polarity control signal POL1 is in the first logic state and supplies the latched red data RData of the first input channel Cm-11 to the second decoder D2 when the first polarity control signal POL1 is in the second logic state.

The third data selector M3 supplies the latched blue data RData of the third or twelfth input channel Cm-9 or Cm supplied from the first switch S1*a* of the first data path selector S1 to the third decoder D3 when the first polarity control signal POL1 is in the first logic state and supplies the latched blue data RData of the ninth or third input channel Cm-3 or Cm-9 supplied from the second switch S1*b* of the first data path selector S1 to the third decoder D3 when the first polarity control signal POL1 is in the second logic state.

The fourth data selector M4 supplies the latched red data RData of the fourth input channel Cm-8 or the latched green data RData of the eleventh input channel Cm-1 supplied from the first switch S2*a* of the second data path selector S2 to the fourth decoder D4 when the first polarity control signal POL1 is in the first logic state and supplies the latched red data RData of the tenth input channel Cm-2 or the latched red data RData of the fourth input channel Cm-8 supplied from the second switch S2*b* of the second data path selector S2 to the fourth decoder D4 when the first polarity control signal POL1 is in the second logic state.

The fifth data selector M5 supplies the latched green data RData of the fifth input channel Cm-7 to the fifth decoder D5 when the first polarity control signal POL1 is in the first logic state and supplies the latched green data RData of the eleventh input channel Cm-1 or the latched red data RData of the tenth input channel Cm-2 supplied from the third data path selector S3 to the fifth decoder D5 when the first polarity control signal POL1 is in the second logic state.

The sixth data selector M6 supplies the latched blue data RData of the sixth input channel Cm-6 to the sixth decoder D6 when the first polarity control signal POL1 is in the first logic state and supplies the latched blue data RData of the twelfth or ninth input channel Cm or Cm-3 supplied from the fourth data path selector S4 to the sixth decoder D6 when the first polarity control signal POL1 is in the second logic state.

The seventh data selector M7 supplies the latched red data RData of the seventh input channel Cm-5 or the latched green data RData of the eighth input channel Cm-4 supplied from the first switch S5*a* of the fifth data path selector S5 to the seventh decoder D7 when the first polarity control signal POL1 is in the first logic state and supplies the latched green data RData of the eighth input channel Cm-4 or the latched red data RData of the seventh input channel Cm-5supplied from the second switch S5*b* of the fifth data path selector S5 to the seventh decoder D7 when the first polarity control signal POL1 is in the second logic state.

The eighth data selector M8 supplies the latched green data RData of the eighth input channel Cm-4 or the latched red data RData of the seventh input channel Cm-5 supplied from the first switch S6*a* of the sixth data path selector S6 to the eighth decoder D8 when the first polarity control signal POL1 is in the first logic state and supplies the latched red data RData of the seventh input channel Cm-5 or the latched green data RData of the eighth input channel Cm-4 supplied from the second switch S6*b* of the sixth data path selector S6 to the eighth decoder D8 when the first polarity control signal POL1 is in the second logic state.

The ninth data selector M9 supplies the latched blue data RData of the ninth input channel Cm-3 to the ninth decoder D9 when the first polarity control signal POL1 is in the first logic state, and supplies the latched blue data RData of the third or sixth input channel Cm-9 or Cm-6 supplied from the seventh data path selector S7 to the ninth decoder D9 when the first polarity control signal POL1 is in the second logic state.

The tenth data selector M10 supplies the latched red data RData of the tenth input channel Cm-2 to the tenth decoder D10 when the first polarity control signal POL1 is in the first logic state and supplies the latched red data RData of the fourth input channel Cm-8 or the latched green data RData of the fifth input channel Cm-7 supplied from the eighth data path selector S8 to the tenth decoder D10 when the first polarity control signal POL1 is in the second logic state.

The eleventh data selector M11 supplies the latched green data RData of the eleventh input channel Cm-1 or the latched red data RData of the fourth input channel Cm-8 supplied from the first switch S9*a* of the ninth data path selector S9 to the eleventh decoder D11 when the first polarity control signal POL1 is in the first logic state and supplies the latched green data RData of the fifth or eleventh input channel Cm-7 or Cm-1 supplied from the second switch S9*b* of the ninth data path selector S9 to the eleventh decoder D11 when the first polarity control signal POL1 is in the second logic state.

The twelfth data selector M12 supplies the latched blue data RData of the twelfth or third input channel Cm or Cm-9 supplied from the first switch S10*a* of the tenth data path selector S10 to the twelfth decoder D12 when the first polarity control signal POL1 is in the first logic state and supplies the latched blue data RData of the sixth or twelfth input channel Cm-6 or Cm supplied from the second switch S10*b* of the tenth data path selector S10 to the twelfth decoder D12 when the first polarity control signal POL1 is in the second logic state.

The image signal path controller 400 controls the path of each of the image signals Vdata from the data converter 200 to the output buffer part 144 based on the first and second polarity control signals POL1 and POL2 such that the polarities of the image signals VData correspond to the horizontal 1-dot or horizontal 2-dot inversion mode. To this end, the image signal path controller 400 includes first and second image signal path controllers 410 and 420.

The first image signal path controller 410 includes first to tenth image signal path selectors s1 to s10. The first image signal path selector s1 includes a first switch s1*a* for outputting the blue image signal VData from the third or twelfth decoder D3 or D12 in response to the second polarity control signal POL2 and a second switch s1*b* for outputting the blue image signal VData from the ninth or third decoder D9 or D3 in response to the second polarity control signal POL2. The first switch s1*a* selects and outputs the negative blue image signal VData supplied from the third decoder D3 in response to the first logic state of the second polarity control signal POL2 and selects and outputs the positive blue image signal VData supplied from the twelfth decoder D12 in response to the second logic state of the second polarity control signal POL2. The second switch s1*b* selects and outputs the positive blue image signal VData supplied from the ninth decoder D9 in response to the first logic state of the second polarity control signal POL2 and selects and outputs the negative blue image signal VData supplied from the third decoder D3 in response to the second logic state of the second polarity control signal POL2.

The second image signal path selector s2 includes a first switch s2*a* for outputting the red image signal VData from the fourth decoder D4 or the green image signal VData from the eleventh decoder D11 in response to the second polarity control signal POL2 and a second switch s2*b* for outputting the red image signal VData from the tenth decoder D10 or the red image signal VData from the fourth decoder D4 in response to the second polarity control signal POL2. The first switch s2*a* selects and outputs the positive red image signal VData supplied from the fourth decoder D4 in response to the first logic state of the second polarity control signal POL2 and selects and outputs the green image signal VData supplied from the eleventh decoder D11 in response to the second logic state of the second polarity control signal POL2. The second switch s2*b* selects and outputs the red image signal VData supplied from the tenth decoder D10 in response to the first logic state of the second polarity control signal POL2 and selects and outputs the red image signal VData supplied from the fourth decoder D4 in response to the second logic state of the second polarity control signal POL2.

The third image signal path selector s3 selects and outputs the negative green image signal VData supplied from the eleventh decoder D11 in response to the first logic state of the second polarity control signal POL2 and selects and outputs the negative red image signal VData supplied from the tenth decoder D10 in response to the second logic state of the second polarity control signal POL2.

The fourth image signal path selector s4 selects and outputs the positive blue image signal VData supplied from the twelfth decoder D12 in response to the first logic state of the second polarity control signal POL2 and selects and outputs the positive blue image signal VData supplied from the ninth decoder D9 in response to the second logic state of the second polarity control signal POL2.

The fifth image signal path selector s5 includes a first switch s5*a* for outputting the red image signal VData from the seventh decoder D7 or the green image signal VData from the eighth decoder D8 in response to the second polarity control signal POL2 and a second switch s5*b* for outputting the green image signal VData from the eighth decoder D8 or the red image signal VData from the seventh decoder D7 in response to the second polarity control signal POL2. The first switch s5*a* selects and outputs the negative red image signal VData supplied from the seventh decoder D7 in response to the first logic state of the second polarity control signal POL2 and selects and outputs the positive green image signal VData supplied from the eighth decoder D8 in response to the second logic state of the second polarity control signal POL2. The second switch s5*b* selects and outputs the positive green image signal VData supplied from the eighth decoder D8 in response to the first logic state of the second polarity control signal POL2 and selects and outputs the negative red image signal VData supplied from the seventh decoder D7 in response to the second logic state of the second polarity control signal POL2.

The sixth image signal path selector s6 includes a first switch s6*a* for outputting the green image signal VData from the eighth decoder D8 or the red image signal VData from the seventh decoder D7 in response to the second polarity control signal POL2 and a second switch s6*b* for outputting the red image signal VData from the seventh decoder D7 or the green image signal VData from the eighth decoder D8 in response to the second polarity control signal POL2. The first switch s6*a* selects and outputs the positive green image signal VData supplied from the eighth decoder D8 in response to the first logic state of the second polarity control signal POL2 and selects and outputs the negative red image signal VData supplied from the seventh decoder D7 in response to the second logic state of the second polarity control signal POL2. The second switch s6*b* selects and outputs the negative red image signal VData supplied from the seventh decoder D7 in response to the first logic state of the second polarity control signal POL2 and selects and outputs the positive green image signal VData supplied from the eighth decoder D8 in response to the second logic state of the second polarity control signal POL2.

The seventh image signal path selector s7 selects and outputs the negative blue image signal VData supplied from the third decoder D3 in response to the first logic state of the second polarity control signal POL2 and selects and outputs the negative blue image signal VData supplied from the sixth decoder D6 in response to the second logic state of the second polarity control signal POL2.

The eighth image signal path selector s8 selects and outputs the positive red image signal VData supplied from the fourth decoder D4 in response to the first logic state of the second polarity control signal POL2 and selects and outputs the positive green image signal VData supplied from the fifth decoder D5 in response to the second logic state of the second polarity control signal POL2.

The ninth image signal path selector s9 includes a first switch s9*a* for outputting the green image signal VData from the eleventh decoder D11 or the red image signal VData from the fourth decoder D4 in response to the second polarity control signal POL2 and a second switch s9*b* for outputting the green image signal VData from the fifth decoder D5 or the green image signal VData from the eleventh decoder D11 in response to the second polarity control signal POL2. The first switch s9*a* selects and outputs the negative green image signal VData supplied from the eleventh decoder D11 in response to the first logic state of the second polarity control signal POL2 and selects and outputs the positive red image signal VData supplied from the fourth decoder D4 in response to the second logic state of the second polarity control signal POL2. The second switch s9*b* selects and outputs the positive green image signal VData supplied from the fifth decoder D5 in response to the first logic state of the second polarity control signal POL2 and selects and outputs the negative green image signal VData supplied from the eleventh decoder D11 in response to the second logic state of the second polarity control signal POL2.

The tenth image signal path selector s10 includes a first switch s10*a* for outputting the blue image signal VData from the twelfth decoder D12 or the blue image signal VData from the third decoder D3 in response to the second polarity control signal POL2 and a second switch s10*b* for outputting the blue image signal VData from the sixth decoder D6 or the blue image signal VData from the twelfth decoder D12 in response to the second polarity control signal POL2. The first switch s10*a* selects and outputs the positive blue image signal VData supplied from the twelfth decoder D12 in response to the first logic state of the second polarity control signal POL2 and selects and outputs the negative blue image signal VData supplied from the third decoder D3 in response to the second logic state of the second polarity control signal POL2. The second switch s10*b* selects and outputs the negative blue image signal VData supplied from the sixth decoder D6 in response to the first logic state of the second polarity control signal POL2 and selects and outputs the positive blue image signal VData supplied from the twelfth decoder D12 in response to the second logic state of the second polarity control signal POL2.

The second image signal path controller 420 includes first to twelfth image signal selectors m1 to m12. The first image signal selector m1 supplies the positive red image signal VData supplied from the first decoder D1 to a first buffer line Im-11 of the output buffer part 144 when the first polarity control signal POL1 is in the first logic state and supplies the negative red image signal VData supplied from the second decoder D2 to the first buffer line Im-11 of the output buffer part 144 when the first polarity control signal POL1 is in the second logic state. At this time, the positive or negative red image signal VData supplied to the first buffer line Im-11 corresponds to data supplied to the first input channel Cm-11.

The second image signal selector m2 supplies the negative green image signal VData supplied from the second decoder D2 to a second buffer line Im-10 of the output buffer part 144 when the first polarity control signal POL1 is in the first logic state, and supplies the positive green image signal VData supplied from the first decoder D1 to the second buffer line Im-10 of the output buffer part 144 when the first polarity control signal POL1 is in the second logic state. At this time, the positive or negative green image signal VData supplied to the second buffer line Im-10 corresponds to data supplied to the second input channel Cm-10.

The third image signal selector m3 supplies the negative blue image signal VData from the third decoder D3 or the positive blue image signal VData from the twelfth decoder D12 supplied through the first switch s1*a* of the first image signal path selector s1 to a third buffer line Im-9 of the output buffer part 144 when the first polarity control signal POL1 is in the first logic state and supplies the positive blue image signal VData from the ninth decoder D9 or the negative blue image signal VData from the third decoder D3 supplied through the second switch s1*b* of the first image signal path selector s1 to the third buffer line Im-9 of the output buffer part 144 when the first polarity control signal POL1 is in the second logic state. At this time, the positive or negative blue image signal VData supplied to the third buffer line Im-9 corresponds to data supplied to the third input channel Cm-9.

The fourth image signal selector m4 supplies the positive red image signal VData from the fourth decoder D4 or the negative red image signal VData from the eleventh decoder D11 supplied through the first switch s2*a* of the second image signal path selector s2 to a fourth buffer line Im-8 of the output buffer part 144 when the first polarity control signal POL1 is in the first logic state and supplies the negative red image signal VData from the tenth decoder D10 or the positive red image signal VData from the fourth decoder D4 supplied through the second switch s2*b* of the second image signal path selector s2 to the fourth buffer line Im-8 of the output buffer part 144 when the first polarity control signal POL1 is in the second logic state. At this time, the positive or negative red image signal VData supplied to the fourth buffer line Im-8 corresponds to data supplied to the fourth input channel Cm-8.

The fifth image signal selector m5 supplies the positive green image signal VData supplied from the fifth decoder D5 to a fifth buffer line Im-7 of the output buffer part 144 when the first polarity control signal POL1 is in the first logic state and supplies the negative green image signal VData from the eleventh decoder D11 or the negative red image signal VData from the tenth decoder D10 supplied through the third image signal path selector s3 to the fifth buffer line Im-7 of the output buffer part 144 when the first polarity control signal POL1 is in the second logic state. At this time, the positive or negative green image signal VData supplied to the fifth buffer line Im-7 corresponds to data supplied to the fifth input channel Cm-7.

The sixth image signal selector m6 supplies the negative blue image signal VData supplied from the sixth decoder D6 to a sixth buffer line Im-6 of the output buffer part 144 when the first polarity control signal POL1 is in the first logic state and supplies the positive blue image signal VData from the twelfth decoder D12 or the positive blue image signal VData from the ninth decoder D9 supplied through the fourth image signal path selector s4 to the sixth buffer line Im-6 of the output buffer part 144 when the first polarity control signal POL1 is in the second logic state. At this time, the positive or negative blue image signal VData supplied to the sixth buffer line Im-6 corresponds to data supplied to the sixth input channel Cm-6.

The seventh image signal selector m7 supplies the negative red image signal VData from the seventh decoder D7 or the positive red image signal VData from the eighth decoder D8 supplied through the first switch s5*a* of the fifth image signal path selector s5 to a seventh buffer line Im-5 of the output buffer part 144 when the first polarity control signal POL1 is in the first logic state and supplies the positive red image signal VData from the eighth decoder D8 or the negative red image signal VData from the seventh decoder D7 supplied through the second switch s5*b* of the fifth image signal path selector s5 to the seventh buffer line Im-5 of the output buffer part 144 when the first polarity control signal POL1 is in the second logic state. At this time, the positive or negative red image signal VData supplied to the seventh buffer line Im-5 corresponds to data supplied to the seventh input channel Cm-5.

The eighth image signal selector m8 supplies the positive green image signal VData from the eighth decoder D8 or the negative green image signal VData from the seventh decoder D7 supplied through the first switch s6*a* of the sixth image signal path selector s6 to an eighth buffer line Im-4 of the output buffer part 144 when the first polarity control signal POL1 is in the first logic state and supplies the negative green image signal VData from the seventh decoder D7 or the positive green image signal VData from the eighth decoder D8 supplied through the second switch s6*b* of the sixth image signal path selector s6 to the eighth buffer line Im-4 of the output buffer part 144 when the first polarity control signal POL1 is in the second logic state. At this time, the positive or negative green image signal VData supplied to the eighth buffer line Im-4 corresponds to data supplied to the eighth input channel Cm-4.

The ninth image signal selector m9 supplies the positive blue image signal VData supplied from the ninth decoder D9 to a ninth buffer line Im-3 of the output buffer part 144 when the first polarity control signal POL1 is in the first logic state and supplies the negative blue image signal VData from the third decoder D3 or the negative blue image signal VData from the sixth decoder D6 supplied through the seventh image signal path selector s7 to the ninth buffer line Im-3 of the output buffer part 144 when the first polarity control signal POL1 is in the second logic state. At this time, the positive or negative blue image signal VData supplied to the ninth buffer line Im-3 corresponds to data supplied to the ninth input channel Cm-3.

The tenth image signal selector m10 supplies the red image signal VData supplied from the tenth decoder D10 to a tenth buffer line Im-2 of the output buffer part 144 when the first polarity control signal POL1 is in the first logic state and supplies the positive red image signal VData from the fourth decoder D4 or the positive red image signal VData from the fifth decoder D5 supplied through the eighth image signal path selector s8 to the tenth buffer line Im-2 of the output buffer part 144 when the first polarity control signal POL1 is in the second logic state. At this time, the positive or negative red image signal VData supplied to the tenth buffer line Im-2 corresponds to data supplied to the tenth input channel Cm-2.

The eleventh image signal selector m11 supplies the negative green image signal VData from the eleventh decoder D11 or the positive green image signal VData from the fourth decoder D4 supplied through the first switch s9*a* of the ninth image signal path selector s9 to an eleventh buffer line Im-1 of the output buffer part 144 when the first polarity control signal POL1 is in the first logic state and supplies the positive green image signal VData from the fifth decoder D5 or the negative green image signal VData from the eleventh decoder D11 supplied through the second switch s9*b* of the ninth image signal path selector s9 to the eleventh buffer line Im-1 of the output buffer part 144 when the first polarity control signal POL1 is in the second logic state. At this time, the positive or negative green image signal VData supplied to the eleventh buffer line Im-1 corresponds to data supplied to the eleventh input channel Cm-1.

The twelfth image signal selector m12 supplies the positive blue image signal VData from the twelfth decoder D12 or the negative blue image signal VData from the third decoder D3 supplied through the first switch s10*a* of the tenth image signal path selector s10 to a twelfth buffer line Im of the output buffer part 144 when the first polarity control signal POL1 is in the first logic state and supplies the negative blue image signal VData from the sixth decoder D6 or the positive blue image signal VData from the twelfth decoder D12 supplied through the second switch s10*b* of the tenth image signal path selector s10 to the twelfth buffer line Im of the output buffer part 144 when the first polarity control signal POL1 is in the second logic state. At this time, the positive or negative blue image signal VData supplied to the twelfth buffer line Im corresponds to data supplied to the twelfth input channel Cm.

In this manner, the D/A converter 142 controls the paths of data and image signals based on the logic states of the first and second polarity control signals POL1 and POL2 using the data path controller 300 and image signal path controller 400. As a result, the D/A converter 142 converts latched data RData into image signals VData having a polarity pattern of the horizontal 1-dot or horizontal 2-dot inversion mode and supplies the converted image signals to the output buffer part 144.

Figure 6A:
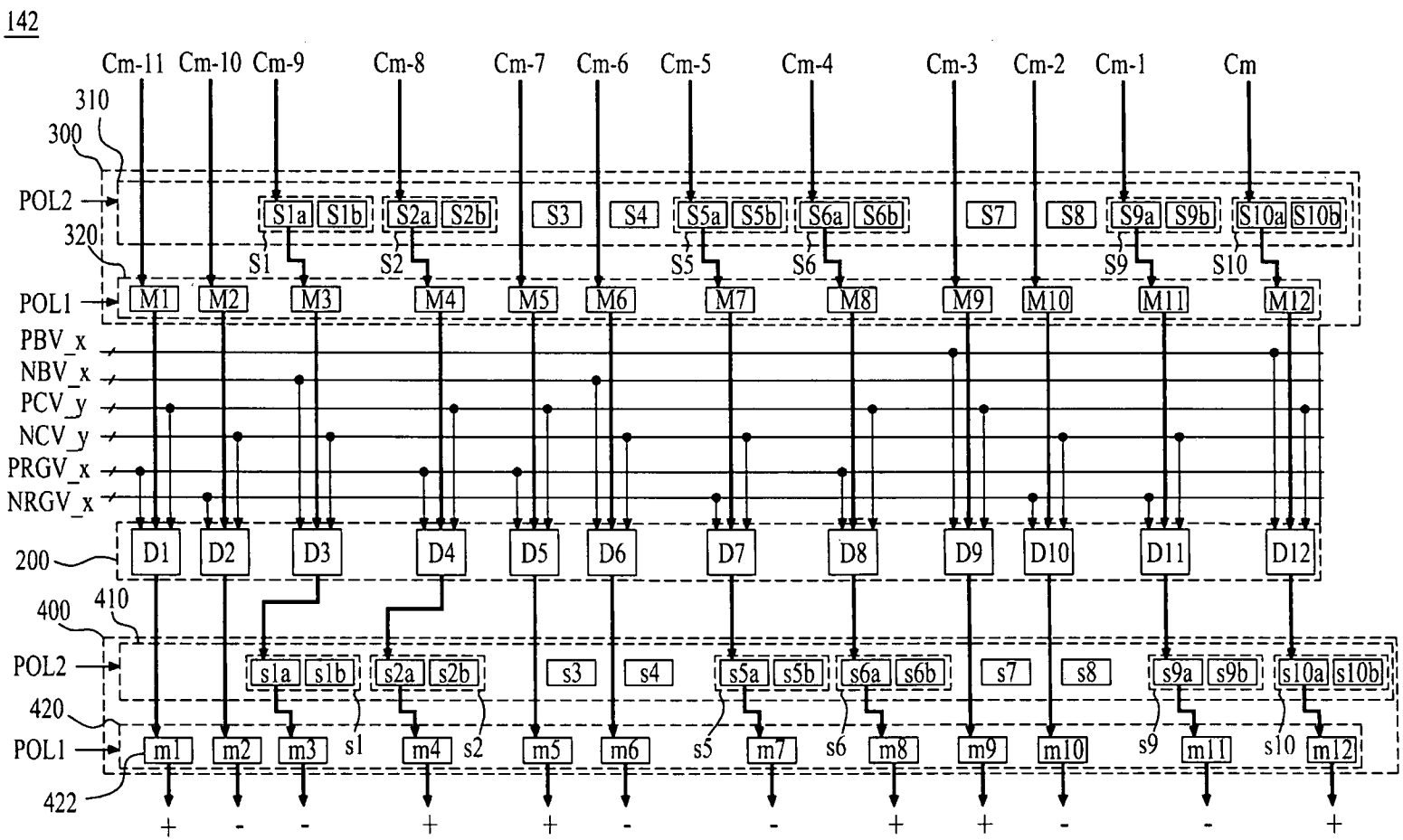
FIG. 6A is a schematic block diagram illustrating exemplary paths of data and image signals corresponding to a horizontal 2-dot inversion mode based on first and second polarity control signals in the first embodiment of the present invention.

For example, in the case where both the first and second polarity control signals POL1 and POL2 are in the first logic state, the D/A converter 142 converts the polarity pattern of the image signals VData into that of the horizontal 2-dot inversion mode and supplies the resulting image signals to the output buffer part 144, as shown in FIG. 6A. At this time, the polarity pattern of the horizontal 2-dot inversion mode has a form such as {+−−++−−++−−+} because the polarities of the image signals are inverted on a two-input channel basis in a horizontal direction with the exception of the first and last input channels Cm-11 and Cm.

Figure 6B:
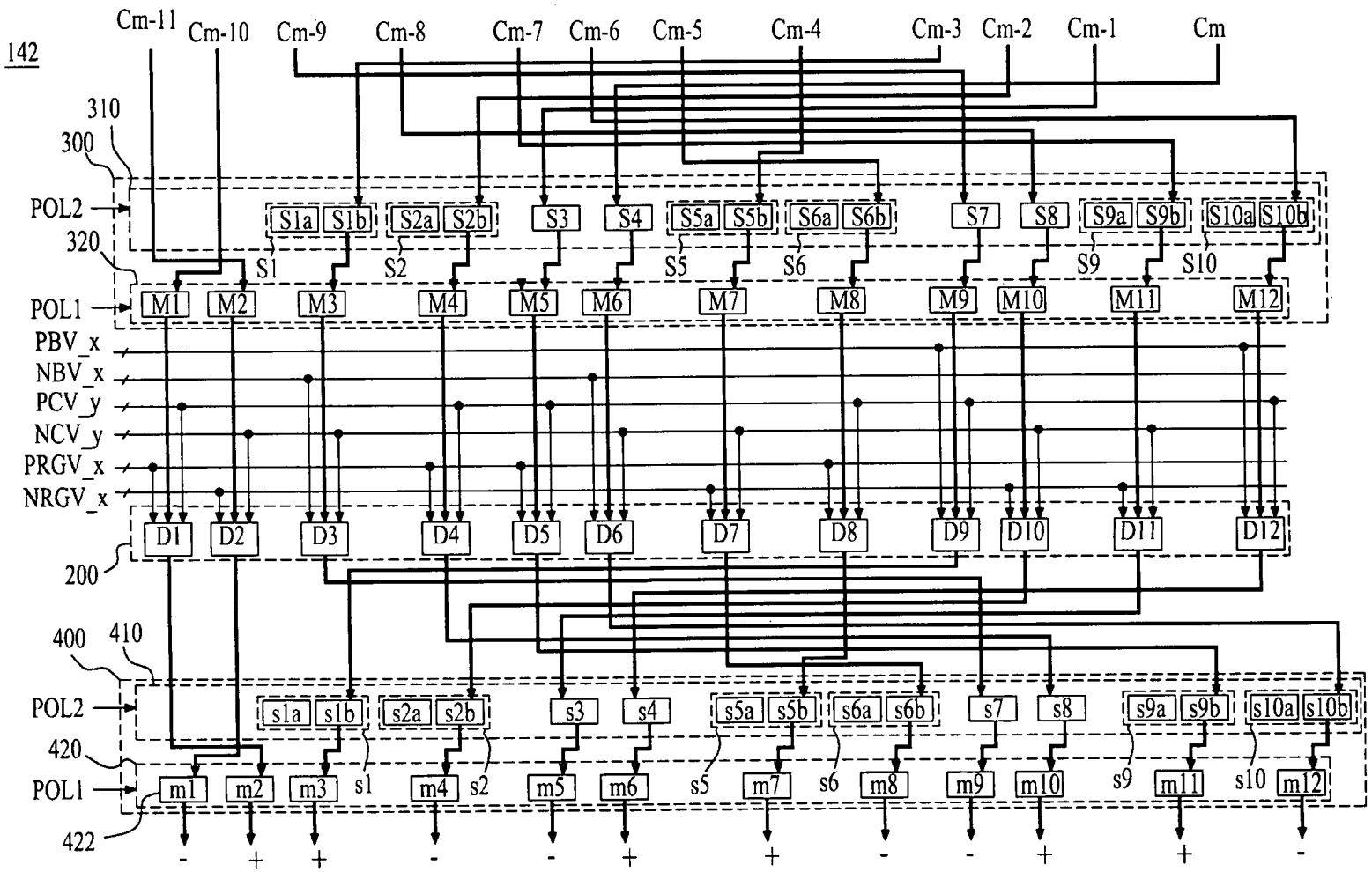
FIG. 6B is a schematic block diagram illustrating exemplary paths of data and image signals corresponding to an inverted horizontal 2-dot inversion mode based on the first and second polarity control signals in the first embodiment of the present invention.

In the case where the first polarity control signal POL1 is in the second logic state and the second polarity control signal POL2 is in the first logic state, the D/A converter 142 converts the polarity pattern of the image signals VData into that of an inverted horizontal 2-dot inversion mode and supplies the resulting image signals to the output buffer part 144, as shown in FIG. 6B. At this time, the polarity pattern of the inverted horizontal 2-dot inversion mode has a form such as {−++−−++−−++−} because the polarities of the image signals are inverted on a two-input channel basis in the horizontal direction with the exception of the first and last input channels Cm-11 and Cm.

Figure 6C:
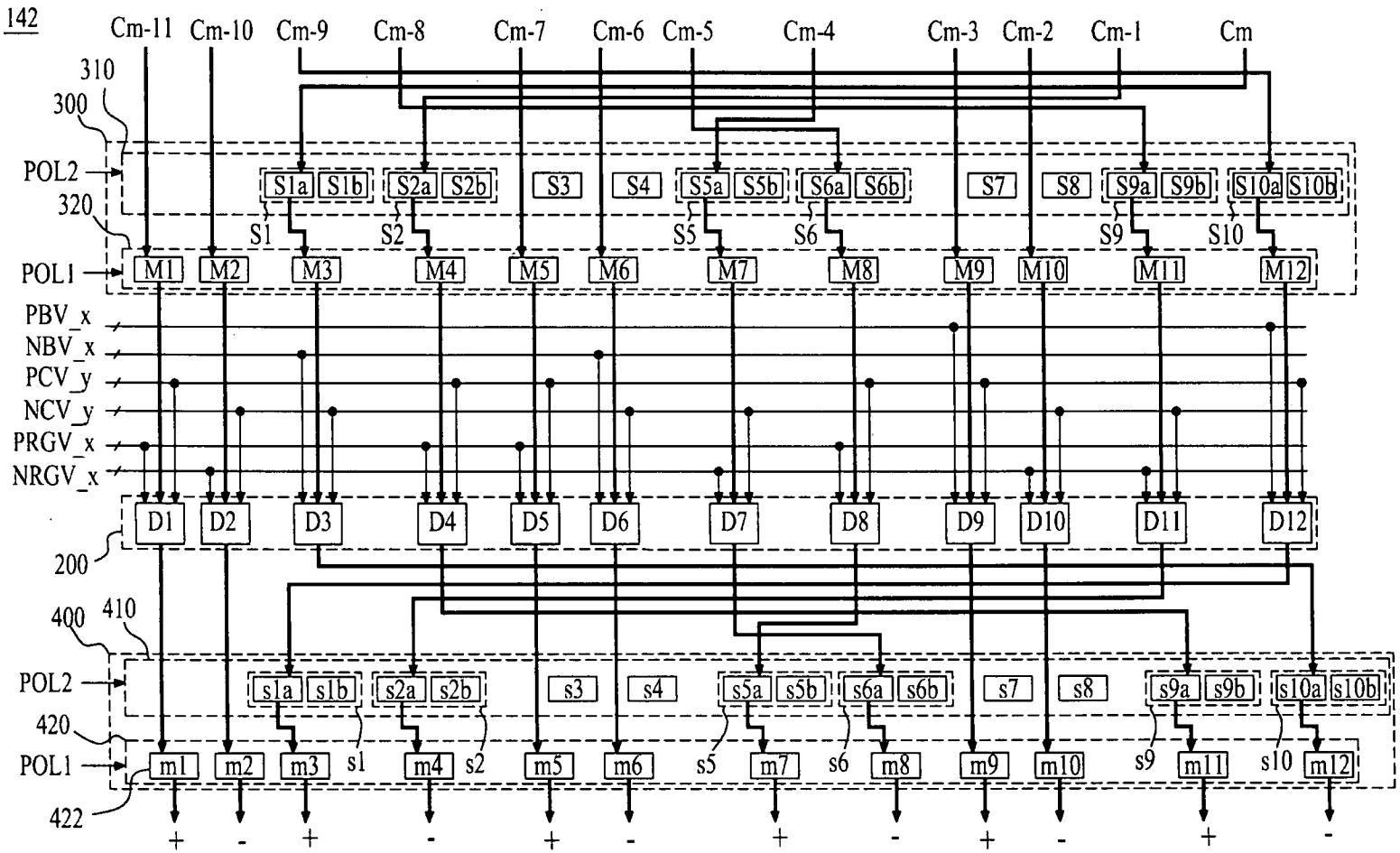
FIG. 6C is a schematic block diagram illustrating exemplary paths of data and image signals corresponding to a horizontal 1-dot inversion mode based on the first and second polarity control signals in the first embodiment of the present invention.

In the case where the first polarity control signal POL1 is in the first logic state and the second polarity control signal POL2 is in the second logic state, the D/A converter 142 converts the polarity pattern of the image signals VData into that of the horizontal 1-dot inversion mode and supplies the resulting image signals to the output buffer part 144, as shown in FIG. 6C. At this time, the polarity pattern of the horizontal 1-dot inversion mode has a form such as {+−+−+−+−+−+−} because the polarities of the image signals are inverted on a per input channel basis in the horizontal direction.

Figure 6D:
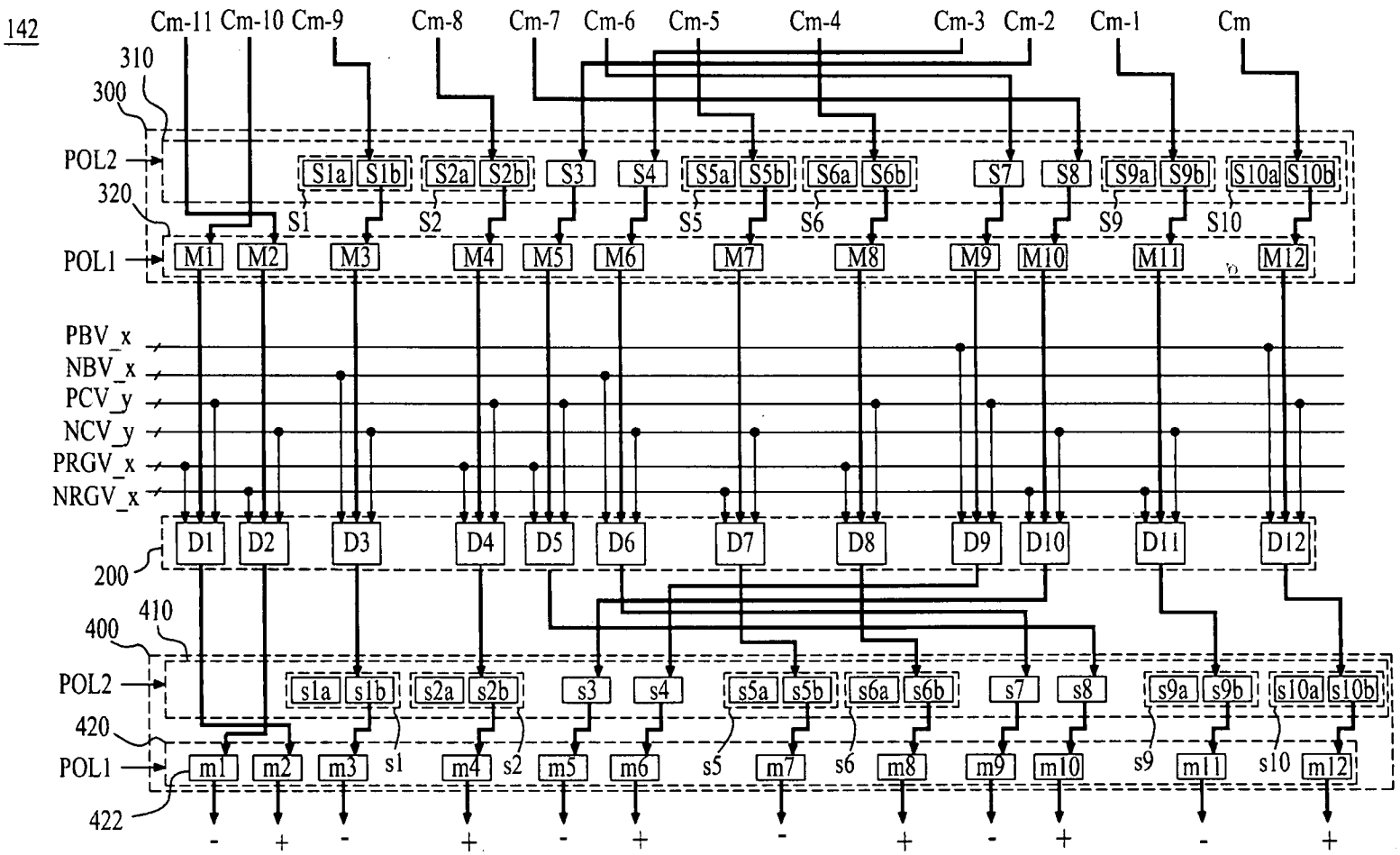
FIG. 6D is a schematic block diagram illustrating exemplary paths of data and image signals corresponding to an inverted horizontal 1-dot inversion mode based on the first and second polarity control signals in the first embodiment of the present invention.

In the case where both the first and second polarity control signals POL1 and POL2 are in the second logic state, the D/A converter 142 converts the polarity pattern of the image signals VData into that of an inverted horizontal 1-dot inversion mode and supplies the resulting image signals to the output buffer part 144, as shown in FIG. 6D. At this time, the polarity pattern of the inverted horizontal 1-dot inversion mode has a form such as {−+−+−+−+−+−+} because the polarities of the image signals are inverted on a per input channel basis in the horizontal direction.

Consequently, the D/A converter 142 controls the path of each of the data and image signals based on the logic states of the first and second polarity control signals POL1 and POL2 such that the data and image signals correspond to the horizontal 2-dot or horizontal 1-dot inversion mode. As a result, the number of decoders arranged is the same as that of output channels.

The output buffer part 144 buffers the image signal VData of each channel supplied from the D/A converter 142 and outputs the buffered image signal externally through a final output channel. The output buffer part 144 amplifies and outputs the image signal VData based on an external load.

Figure 7:
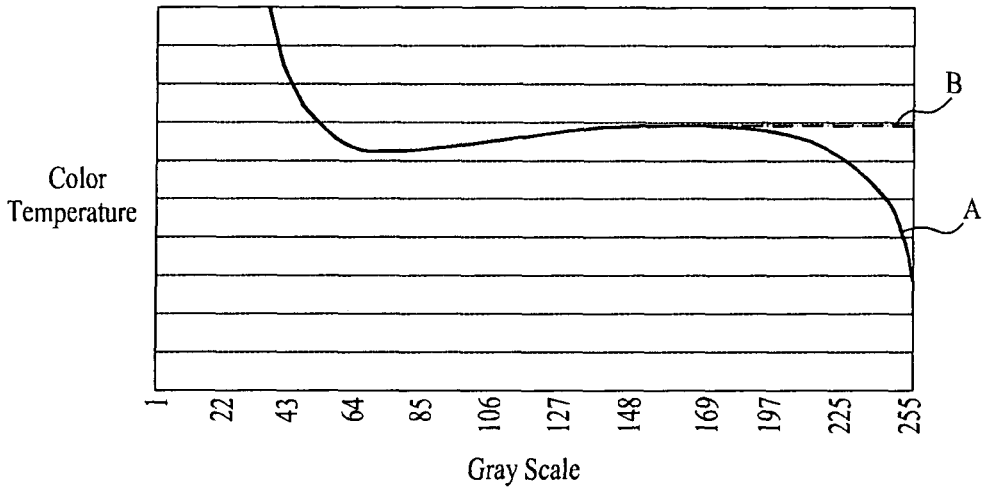
FIG. 7 is a graph illustrating an exemplary color temperature based on a gray scale in the data driving device and a liquid crystal display device according to the first embodiment of the present invention.

As described above, the data driving device 100 according to the first embodiment of the present invention can separately and individually control the blue upper gray scale voltages PBV_x and NBV_x and the red/green upper gray scale voltages PRGV_x and NRGV_x so as to maintain a color temperature based on a gray scale constant. Further, the size of the gray scale voltage generator 120 may be reduced. More specifically, the data driving device 100 according to the first embodiment of the present invention sets each of the positive blue upper gray scale voltages PBV_x to a voltage level higher than that of each of the positive red/green upper gray scale voltages PRGV_x and sets each of the negative blue upper gray scale voltages NBV_x to a voltage level lower than that of each of the negative red/green upper gray scale voltages NRGV_x. Therefore, as shown in FIG. 7, the color temperature may be compensated based on the gray scale in an upper gray scale area indicated by curve B. By contrast, curve A represents a color temperature curve based on a gray scale in a conventional liquid crystal display device where the same gray scale voltage is used for the red, green, and blue data signals.

Furthermore, in the first exemplary embodiment of the present invention, the same number of decoders as that of output channels of the data driving device 100 is arranged in the digital/analog converter 142, thereby reducing the size of the data driving device 100.

Figure 8:
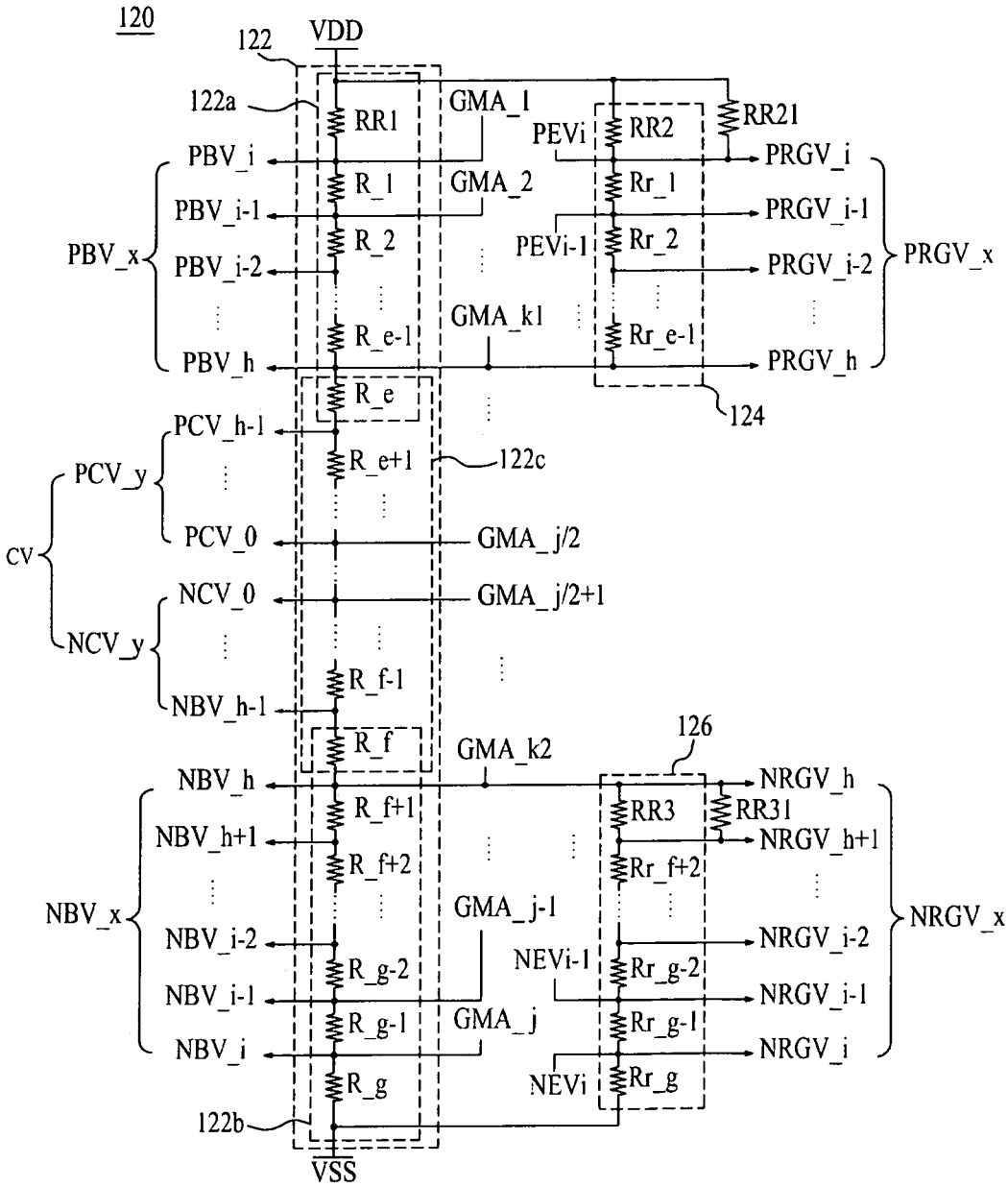
FIG. 8 is a schematic circuit diagram of an exemplary gray scale voltage generator of a data driving device according to a second embodiment of the present invention.

FIG. 8 is a schematic circuit diagram of an exemplary gray scale voltage generator 120 of the data driving device 100 according to a second embodiment of the present invention. The data driving device 100 according to the second embodiment of the present invention generally has the same configuration as the data driving device 100 according to the first embodiment of the present invention shown in FIGS. 2 and 3 with the exception that it further includes first and second external resistors RR21 and RR31 connected to the gray scale voltage generator 120. Therefore, descriptions of like elements in FIGS. 2 and 3 already described above are not repeated.

In particular, the first external resistor RR21 is connected in parallel to the second resistor RR2 provided in the second voltage-dividing resistor string 124 of the gray scale voltage generator 120. The first external resistor RR21 may be a resistor installed external to the data driving device 100. The first external resistor RR21 acts to finely adjust the resistance of the second resistor RR2 in the second voltage-dividing resistor string 124 of the gray scale voltage generator 120. The second external resistor RR31 is connected in parallel to the third resistor RR3 provided in the third voltage-dividing resistor string 126 of the gray scale voltage generator 120. The second external resistor RR31 may be a resistor installed external to the data driving device 100. The second external resistor RR31 acts to finely adjust the resistance of the third resistor RR3 in the third voltage-dividing resistor string 126 of the gray scale voltage generator 120. Accordingly, the data driving device 100 according to the second embodiment of the present invention can finely adjust each of the positive and negative red/green upper gray scale voltages PRGV_x and NRGV_x using each of the first and second external resistors RR21 and RR31 to maintain a color temperature based on a gray scale more constant.

Alternatively, the second resistor RR2 of the second voltage-dividing resistor string 124 and the gth voltage-dividing resistor Rr_g of the third voltage-dividing resistor string 126 may be connected to the first voltage-dividing resistor string 122 in the same manner shown in FIG. 4 and described above.

Figure 9:
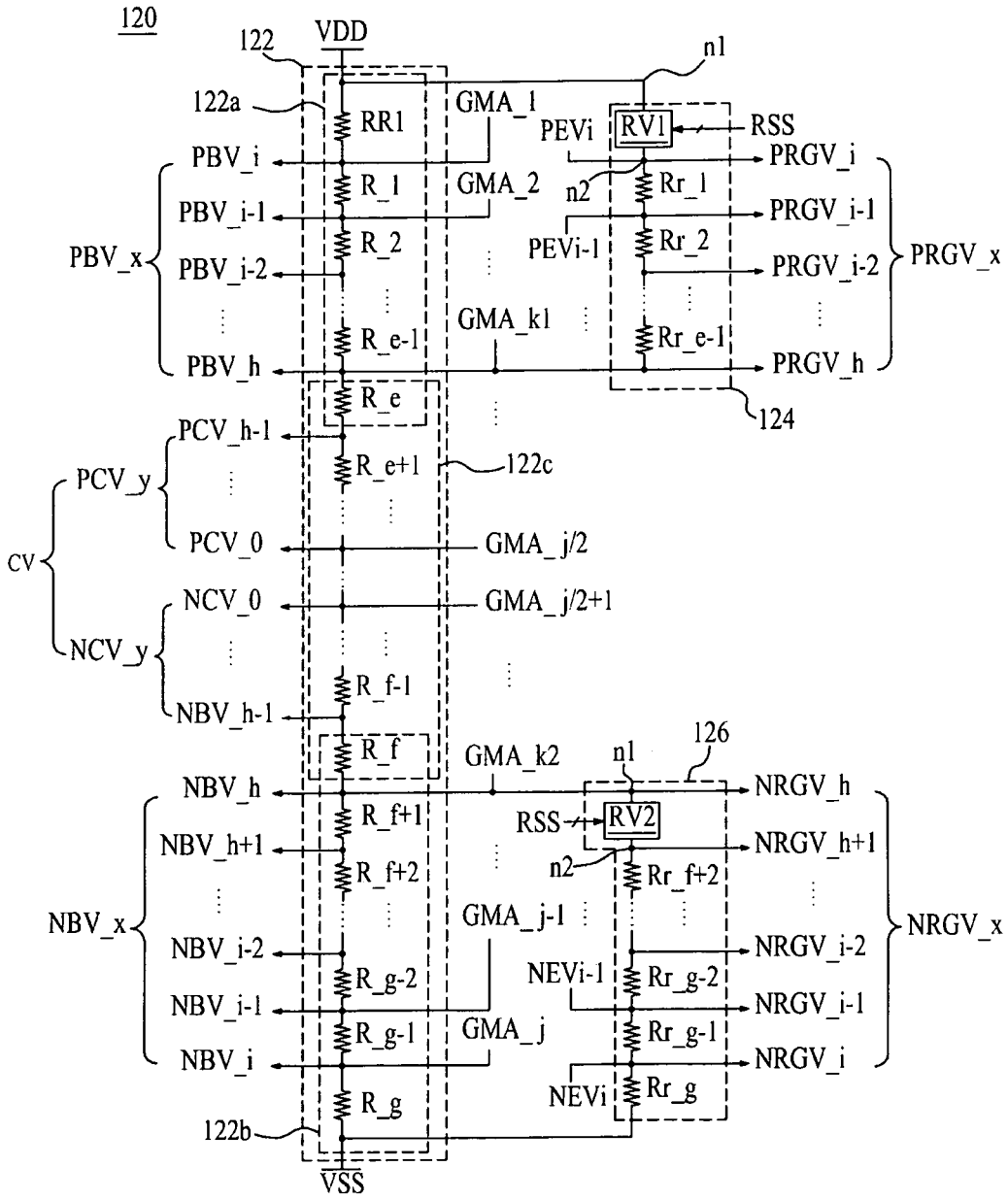
FIG. 9 is a schematic circuit diagram of an exemplary gray scale voltage generator of a data driving device according to a third embodiment of the present invention.

FIG. 9 is a schematic circuit diagram of an exemplary gray scale voltage generator 120 of the data driving device 100 according to a third embodiment of the present invention. The data driving device 100 according to the third embodiment of the present invention generally has the same configuration as the data driving device 100 according to the first embodiment of the present invention shown in FIGS. 2 and 3 with some modifications. Therefore, descriptions of like elements in FIGS. 2 and 3 already described above are not repeated.

In particular, the gray scale voltage generator 120 of the data driving device 100 according to the third embodiment of the present invention includes first and second selectors RV1 and RV2 in place of the second and third resistors RR2 and RR3 in the second and third voltage-dividing resistor strings 124 and 126 shown in FIG. 3.

Figure 10:
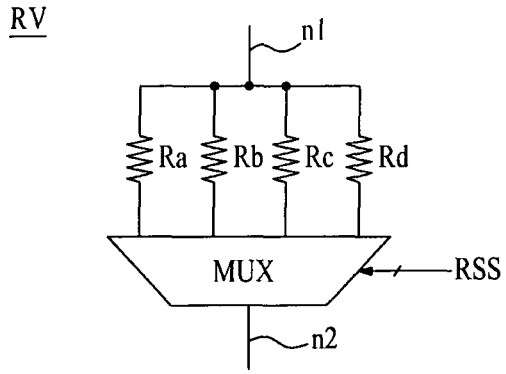
FIG. 10 is a schematic circuit diagram of an exemplary resistor selector shown in FIG. 9.

As shown in FIG. 10, the first selector RV1 includes a plurality of optional resistors Ra, Rb, Rc, and Rd connected in parallel to the first node n1 and a multiplexer MUX for connecting any one of the optional resistors Ra, Rb, Rc, and Rd to the second node n2 in response to a resistor selection signal RSS externally supplied thereto. In the present exemplary embodiment, the first node n1 is connected to the driving voltage source VDD, and the second node n2 is connected to the first positive red/green voltage-dividing resistor Rr_1 of the second voltage-dividing resistor string 124. The first selector RV1 selects any one of the optional resistors Ra, Rb, Rc, and Rd based on the resistor selection signal RSS, thereby making it possible not only to optimize the x red/green gray scale voltages PRGV_x in the positive area, but also to finely adjust the same.

The second selector RV2, as shown in FIG. 10, includes a plurality of optional resistors Ra, Rb, Rc, and Rd connected in parallel to the voltage-dividing node the first node n1 and a multiplexer MUX for connecting any one of the optional resistors Ra, Rb, Rc, and Rd to the second node n2 in response to a resistor selection signal RSS externally supplied thereto. In the present exemplary embodiment, the first node n1 is connected to the (k2)th reference gamma voltage line and the second node is connected to the negative red/green voltage-dividing resistor Rr_f+2 of the third voltage-dividing resistor string 126. The second selector RV2 selects any one of the optional resistors Ra, Rb, Rc, and Rd based on the resistor selection signal RSS, thereby making it possible not only to optimize the x red/green gray scale voltages NRGV_x in the negative area, but also to finely adjust the same.

Accordingly, the data driving device 100 according to the third embodiment of the present invention can optimize and finely adjust each of the positive and negative red/green upper gray scale voltages PRGV_x and NRGV_x using each of the first and second selectors RV1 and RV2 to maintain a color temperature based on a gray scale more constant.

Alternatively, in the gray scale voltage generator 120 of the data driving device 100 according to the third embodiment of the present invention, the first node n1 of the second voltage-dividing resistor string 124 and the gth voltage-dividing resistor Rr_g of the third voltage-dividing resistor string 126 may be connected to the first voltage-dividing resistor string 122 in the same manner as shown in FIG. 4 and described above.

Figure 11:
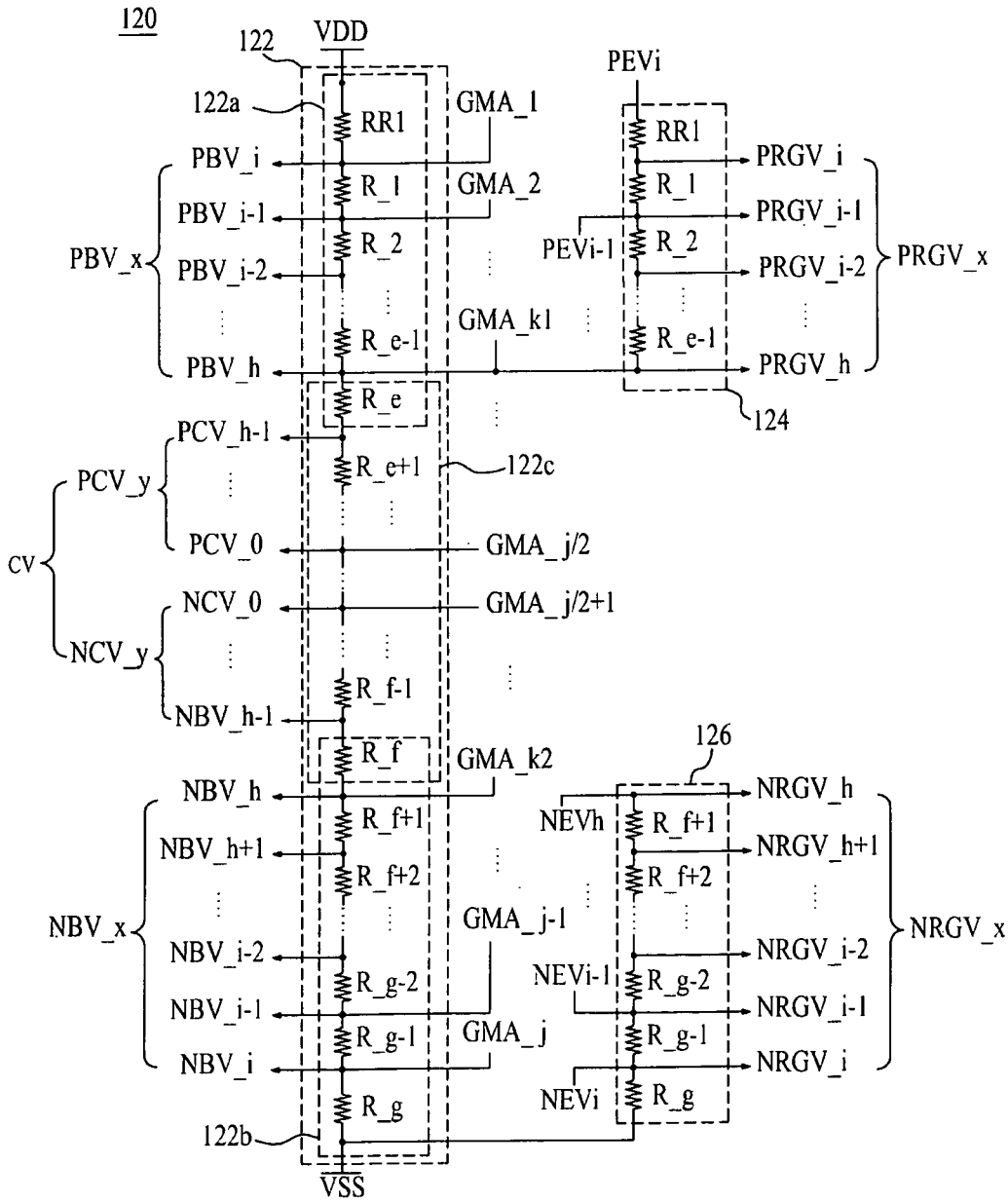
FIG. 11 is a schematic circuit diagram of an exemplary gray scale voltage generator of a data driving device according to a fourth embodiment of the present invention.

FIG. 11 is a schematic circuit diagram of an exemplary gray scale voltage generator 120 of the data driving device 100 according to a fourth embodiment of the present invention. The data driving device 100 according to the fourth embodiment of the present invention generally has the same configuration as the data driving device 100 according to the first embodiment of the present invention shown in FIGS. 2 and 3 with some modifications. Therefore, descriptions of like elements in FIGS. 2 and 3 already described above are not repeated.

In particular, the second voltage-dividing resistor string 124 includes a first resistor RR1 and first to (e−1)th voltage-dividing resistors R_1 to R_e−1 each having the same resistance as that of the resistors in the first area 122*a* of the first voltage-dividing resistor string 122. That is, the second voltage-dividing resistor string 124 has the same structure as that of the first area 122*a* of the first voltage-dividing resistor string 122 with the exception of the eth voltage-dividing resistor R_e in the first area 122*a*. Further, an ith positive gray scale external voltage PEVi is separately supplied to the second voltage-dividing resistor string 124. Accordingly, the second voltage-dividing resistor string 124 generates the positive red/green upper gray scale voltages PRGV_x based on the ith positive gray scale external voltage PEVi. Therefore, in the fourth exemplary embodiment of the present invention, the positive red/green upper gray scale voltages PRGV_x can be fine tuned by adjusting the ith positive gray scale external voltage PEVi.

The third voltage-dividing resistor string 126 includes (f+1)th to gth voltage-dividing resistors R_f+1 to R_g each having the same resistance as that of the resistors in the second area 122*b* of the first voltage-dividing resistor string 122. That is, the third voltage-dividing resistor string 126 has the same structure as that of the second area 122*b* of the first voltage-dividing resistor string 122 with the exception of the fth voltage-dividing resistor R_f in the second area 122*b*. Further, an hth negative gray scale external voltage NEVh is separately supplied to the voltage-dividing node of the third voltage-dividing resistor string 126 that generates the hth negative red/green gray scale voltage NRGV_h. Accordingly, the third voltage-dividing resistor string 126 generates the negative red/green upper gray scale voltages NRGV_x based on the hth negative gray scale external voltage NEVh. Therefore, in the fourth exemplary embodiment of the present invention, the negative red/green upper gray scale voltages NRGV_x can be fine tuned by adjusting the hth negative gray scale external voltage NEVh.

Accordingly, the data driving device 100 according to the fourth embodiment of the present invention can optimize and finely adjust each of the positive and negative red/green upper gray scale voltages PRGV_x and NRGV_x using each of the ith positive gray scale external voltage PEVi and the hth negative gray scale external voltage NEVh to maintain a color temperature based on a gray scale more constant.

Figure 12:
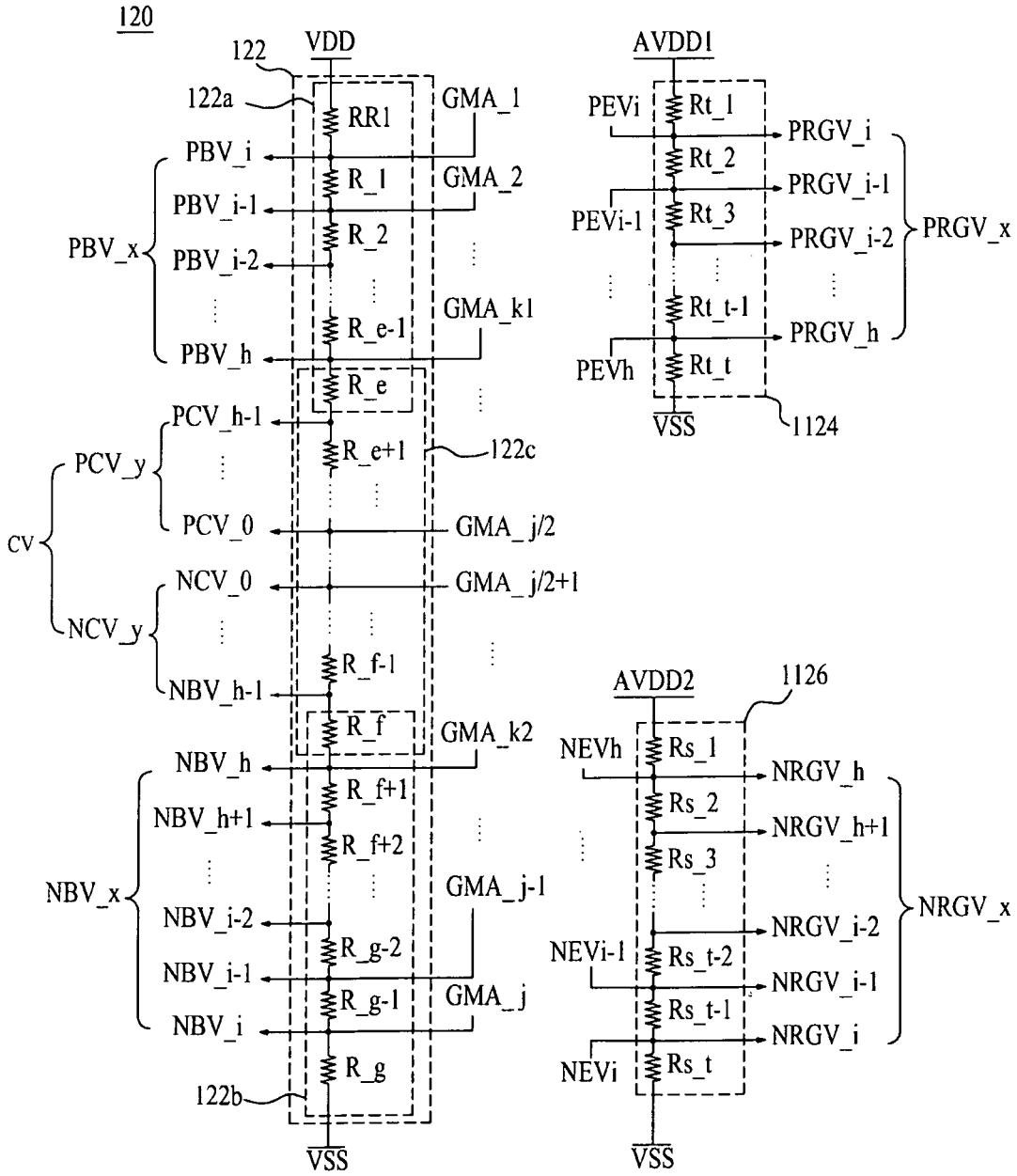
FIG. 12 is a schematic circuit diagram of an exemplary gray scale voltage generator of a data driving device according to a fifth embodiment of the present invention.

FIG. 12 is a schematic circuit diagram of an exemplary gray scale voltage generator 120 of the data driving device 100 according to a fifth embodiment of the present invention. The data driving device 100 according to the fifth embodiment of the present invention generally has the same configuration as the data driving device 100 according to the first embodiment of the present invention shown in FIGS. 2 and 3 with some modifications. Therefore, descriptions of like elements in FIGS. 2 and 3 already described above are not repeated.

In particular, the gray scale voltage generator 120 of the data driving device 100 according to the fifth embodiment of the present invention includes first to third voltage-dividing resistor strings 122, 1124 and 1126.

The first voltage-dividing resistor string 122 generates positive and negative blue upper gray scale voltages PBV_x and NBV_x and positive and negative three-color common gray scale voltages CV using voltage divisions of a first resistor RR1 and first to gth voltage-dividing resistors R_1 to R_g connected in series between a driving voltage source VDD and a ground voltage source VSS. The first voltage-dividing resistor string 122 has the same configuration as that of the first embodiment of the present invention shown in FIG. 3. Accordingly, a detailed description thereof is not repeated.

The second voltage-dividing resistor string 1124 includes first to tth positive voltage-dividing resistors Rt_1 to Rt_t connected in series between a first supply voltage source AVDD1 and the ground voltage source VSS. The first supply voltage source AVDD1 may have a voltage level between an ith positive gray scale voltage PRGV_i and the driving voltage source VDD. A plurality of positive external voltages PEVi to PEVh are supplied to intermediate voltage-dividing nodes of the second voltage-dividing resistor string 1124. For example, an ith positive gray scale external voltage PEVi corresponding to an ith gray scale voltage PRGV_i may be supplied to a voltage-dividing node (between Rt_1 and Rt_2) that generates the ith gray scale voltage PRGV_i among the voltage-dividing nodes of the second voltage-dividing resistor string 1124, and an (i−1)th positive gray scale external voltage PEVi−1 corresponding to an (i−1)th gray scale voltage PRGV_i−1 may be supplied to a voltage-dividing node (between Rt_2 and Rt_3) that generates the (i−1)th gray scale voltage PRGV_i−1 among the voltage-dividing nodes of the second voltage-dividing resistor string 1124. An hth positive gray scale external voltage PEVh corresponding to an hth gray scale voltage PRGV_h may be supplied to a voltage-dividing node (between Rt_t−1 and Rt_t) that generates the hth gray scale voltage PRGV_h among the voltage-dividing nodes of the second voltage-dividing resistor string 1124.

The second voltage-dividing resistor string 1124 supplies to the analog processor 140, x positive red/green upper gray scale voltages PRGV_x including the ith gray scale voltage PRGV_i to the hth gray scale voltage PRGV_h generated by the voltage divisions at the corresponding voltage-dividing nodes each formed between every adjacent ones of the first to tth positive voltage-dividing resistors Rt_1 to Rt_t.

The third voltage-dividing resistor string 1126 includes first to tth negative voltage-dividing resistors Rs_1 to Rs_t connected in series between a second supply voltage source AVDD2 and the ground voltage source VSS. The second supply voltage source AVDD2 may have a voltage level between an hth negative gray scale voltage NRGV_h and the ground voltage source VSS.

A plurality of negative external voltages NEVh to NEVi are supplied to intermediate voltage-dividing nodes of the third voltage-dividing resistor string 1126. For example, an hth negative gray scale external voltage NEVh corresponding to an hth gray scale voltage NRGV_h is supplied to a voltage-dividing node (between Rs_1 and Rs_2) that generates the hth gray scale voltage NRGV_h among the voltage-dividing nodes of the third voltage-dividing resistor string 1126, and an (i−1)th negative gray scale external voltage NEVi−1 corresponding to an (i−1)th gray scale voltage NRGV_i−1 may be supplied to a voltage-dividing node (between Rs_t−2 and Rs_t−1) that generates the (i−1)th gray scale voltage NRGV_i−1 among the voltage-dividing nodes of the third voltage-dividing resistor string 1126. An ith negative gray scale external voltage NEVi corresponding to an ith gray scale voltage NRGV_i is supplied to a voltage-dividing node (between Rs_t−1 and Rs_t) that generates the ith gray scale voltage NRGV_i among the voltage-dividing nodes of the third voltage-dividing resistor string 1126.

The third voltage-dividing resistor string 1126 supplies to the analog processor 140, x negative red/green upper gray scale voltages NRGV_x including the hth gray scale voltage NRGV_h to the ith gray scale voltage NRGV_i generated by the voltage divisions at the corresponding voltage-dividing nodes each formed between every adjacent ones of the first to tth negative voltage-dividing resistors Rs_1 to Rs_t.

The gray scale voltage generator 120 of the data driving device 100 according to the fifth embodiment of the present invention generates the positive and negative blue upper gray scale voltages PBV_x and NBV_x and the positive and negative three-color common gray scale voltages CV using the first voltage-dividing resistor string 122 and generates the positive and negative red/green upper gray scale voltages PRGV_x and NRGV_x using the second and third voltage-dividing resistor strings 1124 and 1126 isolated from the first voltage-dividing resistor string 122. In order to compensate for a color temperature, each of the positive blue upper gray scale voltages PBV_x has a voltage level higher by a predetermined value than each of the positive red/green upper gray scale voltages PRGV_x, and each of the negative blue upper gray scale voltages NBV_x has a voltage level lower by a predetermined value than each of the negative red/green upper gray scale voltages NRGV_x. Therefore, the data driving device 100 according to the fifth embodiment of the present invention can separately and individually control the blue upper gray scale voltages PBV_x and NBV_x and the red/green upper gray scale voltages PRGV_x and NRGV_x so as to maintain a color temperature based on a gray scale constant.

Although the data driving devices according to the first to fifth exemplary embodiments of the present invention have been described to separately and individually control the upper gray scales of the blue gray scale voltages PBV_x and NBV_x and red/green gray scale voltages PRGV_x and NRGV_x, the present invention is not limited thereto and may separately and individually control the lower gray scales of the gray scale voltages as will hereinafter be described.

Figure 13:
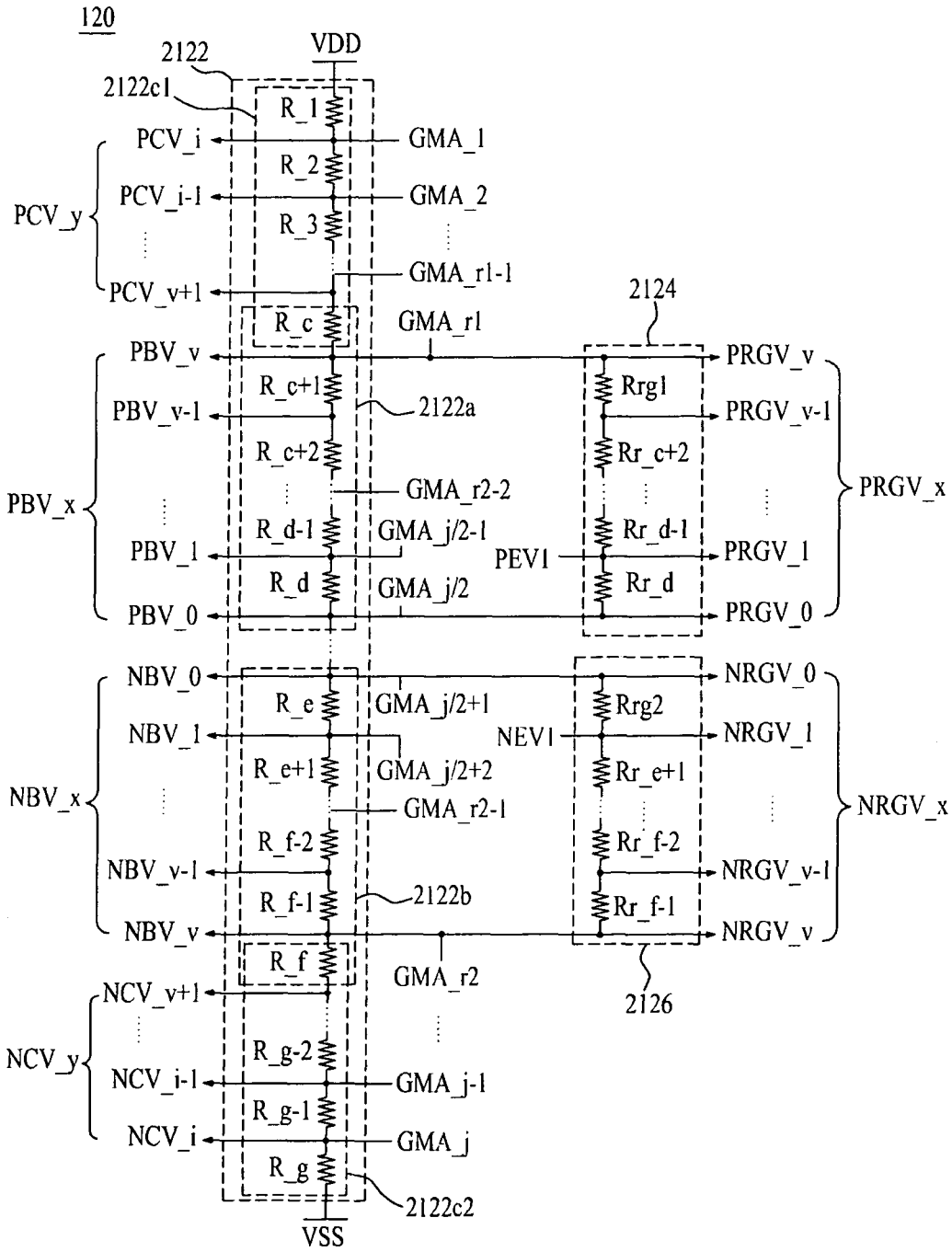
FIG. 13 is a schematic circuit diagram of an exemplary gray scale voltage generator of a data driving device according to a sixth embodiment of the present invention.

FIG. 13 is a schematic circuit diagram of an exemplary gray scale voltage generator 120 of the data driving device 100 according to a sixth embodiment of the present invention. The data driving device 100 according to the sixth embodiment of the present invention generally has the same configuration as the data driving device 100 according to the first embodiment of the present invention shown in FIG. 2 with the exception of the gray scale voltage generator 120. Therefore, descriptions of like elements in FIG. 2 already described above are not repeated.

The gray scale voltage generator 120 of the data driving device according to the sixth embodiment of the present invention includes first to third voltage-dividing resistor strings 2122, 2124, and 2126. The first voltage-dividing resistor string 2122 includes first to gth voltage-dividing resistors R_1 to R_g (where g is a natural number) connected in series between a driving voltage source VDD and a ground voltage source VSS. The first voltage-dividing resistor string 2122 is divided into first and second common areas 2122*c*1 and 2122*c*2 and first and second areas 2122*a* and 2122*b* according to voltages generated by voltage divisions using resistors.

The first common area 2122*c*1 includes the first to cth voltage-dividing resistors R_1 to R_c (where c is a natural number smaller than g) connected in series to the driving voltage source VDD. First to (r1−1)th reference gamma voltages GMA_1 to GMA_r1−1 (where r1 is a natural number smaller than j/2), among j reference gamma voltages GMA_j, are supplied to intermediate voltage-dividing nodes of the first common area 2122*c*1, respectively. The first to (r1−1)th reference gamma voltages GMA_1 to GMA_r1−1 have regular or irregular voltage differences with respect to the adjacent reference gamma voltages depending on an electro-optical characteristic, color temperature characteristic, and gamma characteristic of a liquid crystal and are supplied to the corresponding voltage-dividing nodes of the first common area 2122*c*1, respectively. The first common area 2122*c*1 supplies to the analog processor 140, y positive three-color common gray scale voltages PCV_y including ith to (v+1)th gray scale voltages PCV_i to PCV_v+1 generated by the voltage divisions at the corresponding voltage-dividing nodes each formed between every adjacent ones of the first to cth voltage-dividing resistors R_1 to R_c. When the number of bits of the data signal is 8, for example, the first common area 2122*c*1 generates 192 positive three-color common gray scale voltages PCV_y including 64th to 255th positive gray scale voltages PCV_64 to PCV_255.

The first area 2122*a* includes the cth to dth voltage-dividing resistors R_c to R_d connected in series. The (r1)th to (j/2)th reference gamma voltages GMA_r1 to GMA_j/2, among the j reference gamma voltages GMA_j, are supplied to intermediate voltage-dividing nodes of the first area 2122*a*, respectively. The (r1)th to (j/2)th reference gamma voltages GMA_r1 to GMA_j/2 have regular or irregular voltage differences with respect to the adjacent reference gamma voltages depending on the electro-optical characteristic, color temperature characteristic, and gamma characteristic of the liquid crystal and are supplied to the corresponding voltage-dividing nodes of the first area 2122*a*, respectively. The first area 2122*a* supplies to the analog processor 140, x positive blue gray scale voltages PBV_x including vth to 0th positive gray scale voltages PBV_v to PBV_0 generated by the voltage divisions at the corresponding voltage-dividing nodes each formed between every adjacent ones of the cth to dth voltage-dividing resistors R_c to R_d. When the number of bits of the data signal is 8, for example, the first area 2122*a* generates 64 positive blue gray scale voltages PBV_x including 63th to 0th positive gray scale voltages PBV_63 to PBV_0.

The second area 2122*b* includes the eth to fth voltage-dividing resistors R_e to R_f connected in series. The (j/2+1)th to (r2−1)th reference gamma voltages GMA_j/2+1 to GMA_r2−1, among the j reference gamma voltages GMA_j, are supplied to intermediate voltage-dividing nodes of the second area 2122*b*, respectively. The (j/2+1)th to (r2−1)th reference gamma voltages GMA_j/2+1 to GMA_r2−1 have regular or irregular voltage differences with respect to the adjacent reference gamma voltages depending on the electro-optical characteristic, color temperature characteristic, and gamma characteristic of the liquid crystal and are supplied to the corresponding voltage-dividing nodes of the second area 2122*b*, respectively. The second area 2122*b* supplies to the analog processor 140, x negative blue gray scale voltages NBV_x including 0th to vth negative gray scale voltages NBV_0 to NBV_v generated by the voltage divisions at the corresponding voltage-dividing nodes each formed between every adjacent ones of the eth to fth voltage-dividing resistors R_e to R_f. When the number of bits of the data signal is 8, for example, the second area 2122*b* generates 64 negative blue gray scale voltages NBV_x including 0th to 63th negative gray scale voltages NBV_0 to NBV_63.

Alternatively, at least one dummy resistor (not shown) may be connected between the first and second areas 2122*a* and 2122*b*.

The second common area 2122*c*2 includes the fth to gth voltage-dividing resistors R_f to R_g connected in series. The (r2)th to jth reference gamma voltages GMA_r2 to GMA_j, among the j reference gamma voltages GMA_j, are supplied to intermediate voltage-dividing nodes of the second common area 2122*c*2, respectively. The (r2)th to jth reference gamma voltages GMA_r2 to GMA_j have regular or irregular voltage differences with respect to the adjacent reference gamma voltages depending on the electro-optical characteristic, color temperature characteristic, and gamma characteristic of the liquid crystal and are supplied to the corresponding voltage-dividing nodes of the second common area 2122*c*2, respectively. The second common area 2122*c*2 supplies to the analog processor 140, y negative three-color common gray scale voltages NCV_y including (v+1)th to ith gray scale voltages NCV_v+1 to NCV_i generated by the voltage divisions at the corresponding voltage-dividing nodes each formed between every adjacent ones of the fth to gth voltage-dividing resistors R_f to R_g. When the number of bits of the data signal is 8, for example, the second common area 2122*c*2 generates 192 negative three-color common gray scale voltages NCV_y including 64th to 255th negative gray scale voltages NCV_64 to NCV_255.

The second voltage-dividing resistor string 2124 includes a first red/green resistor Rrg1 and x positive red/green voltage-dividing resistors Rr_c+2 to Rr_d. The first red/green resistor Rrg1 is connected to the voltage-dividing node of the first voltage-dividing resistor string 2122 that generates the vth positive gray scale voltage PBV-v and is externally supplied with the (r1)th reference gamma voltage GMA_r1. The first red/green resistor Rrg1 has a resistance larger than that of the (c+1)th resistor R_c+1 of the first voltage-dividing resistor string 2122 to optimize x red/green gray scale voltages PRGV_x in a positive area.

The x positive red/green voltage-dividing resistors Rr_c+2 to Rr_d are connected in series between the first red/green resistor Rrg1 and a voltage-dividing node to which the (j/2)th reference gamma voltage GMA_j/2 is supplied. Each of the x positive red/green voltage-dividing resistors Rr_c+2 to Rr_d has the same resistance as that of the corresponding ones of the (c+2)th to dth voltage-dividing resistors R_c+2 to R_d arranged in the first area 2122*a* of the first voltage-dividing resistor string 2122. Thus, the second voltage-dividing resistor string 2124 has the same structure as that of the first area 2122*a* of the first voltage-dividing resistor string 2122, with the exception of the resistance of the first red/green resistor Rrg1.

At least one positive external voltage PEV1 may be further supplied to at least one of the voltage-dividing nodes of the second voltage-dividing resistor string 2124. The second voltage-dividing resistor string 2124 supplies to the analog processor 140, x positive red/green lower gray scale voltages PRGV_x including the vth to 0th gray scale voltages PRGV_v to PRGV_0 generated by the voltage divisions at the corresponding voltage-dividing nodes each formed between every adjacent ones of the resistors Rrg1 and Rr_c+2 to Rr_d.

The third voltage-dividing resistor string 2126 includes a second red/green resistor Rrg2, and x negative red/green voltage-dividing resistors Rr_e+1 to Rr_f−1. The second red/green resistor Rrg2 is connected to a voltage-dividing node to which the (j/2+1)th reference gamma voltage GMA_j/2+1 is supplied. The second red/green resistor Rrg2 has a resistance larger than that of the eth resistor R_e of the first voltage-dividing resistor string 2122 to optimize x red/green gray scale voltages NRGV_x in a negative area.

The x negative red/green voltage-dividing resistors Rr_e+1 to Rr_f−1 are connected in series between the second red/green resistor Rrg2 and the voltage-dividing node of the first voltage-dividing resistor string 2122 that is externally supplied with the (r2)th reference gamma voltage GMA_r2. Each of the x negative red/green voltage-dividing resistors Rr_e+1 to Rr_f−1 has the same resistance as that of the corresponding ones of the (e+1)th to (f−1)th voltage-dividing resistors R_e+1 to R_f−1 arranged in the second area 2122*b* of the first voltage-dividing resistor string 2122. Thus, the third voltage-dividing resistor string 2126 has the same structure as that of the second area 2122*b* of the first voltage-dividing resistor string 2122 with the exception of the resistance of the second red/green resistor Rrg2.

At least one negative external voltage NEV1 may be further supplied to at least one of the voltage-dividing nodes of the third voltage-dividing resistor string 2126. The third voltage-dividing resistor string 2126 supplies to the analog processor 140, x negative red/green lower gray scale voltages NRGV_x including the 0th to vth gray scale voltages NRGV_0 to NRGV_v generated by the voltage divisions at the corresponding voltage-dividing nodes each formed between every adjacent ones of the resistors Rrg2 and Rr_e+1 to Rr_f−1.

The gray scale voltage generator 120 in accordance with the sixth exemplary embodiment of the present invention generates the positive and negative blue lower gray scale voltages PBV_x and NBV_x and the positive and negative three-color common gray scale voltages PCV_y and NCV_y using the first voltage-dividing resistor string 2122 and generates the positive and negative red/green lower gray scale voltages PRGV_x and NRGV_x using the second and third voltage-dividing resistor strings 2124 and 2126. In order to compensate for a color temperature, each of the positive blue lower gray scale voltages PBV_x has a voltage level higher by a predetermined value than each of the positive red/green lower gray scale voltages PRGV_x, and each of the negative blue lower gray scale voltages NBV_x has a voltage level lower by a predetermined value than each of the negative red/green lower gray scale voltages NRGV_x. Therefore, the data driving device 100 according to the sixth embodiment of the present invention can separately and individually control the blue lower gray scale voltages PBV_x and NBV_x and the red/green lower gray scale voltages PRGV_x and NRGV_x so as to maintain a color temperature based on a gray scale constant.

Figure 14:
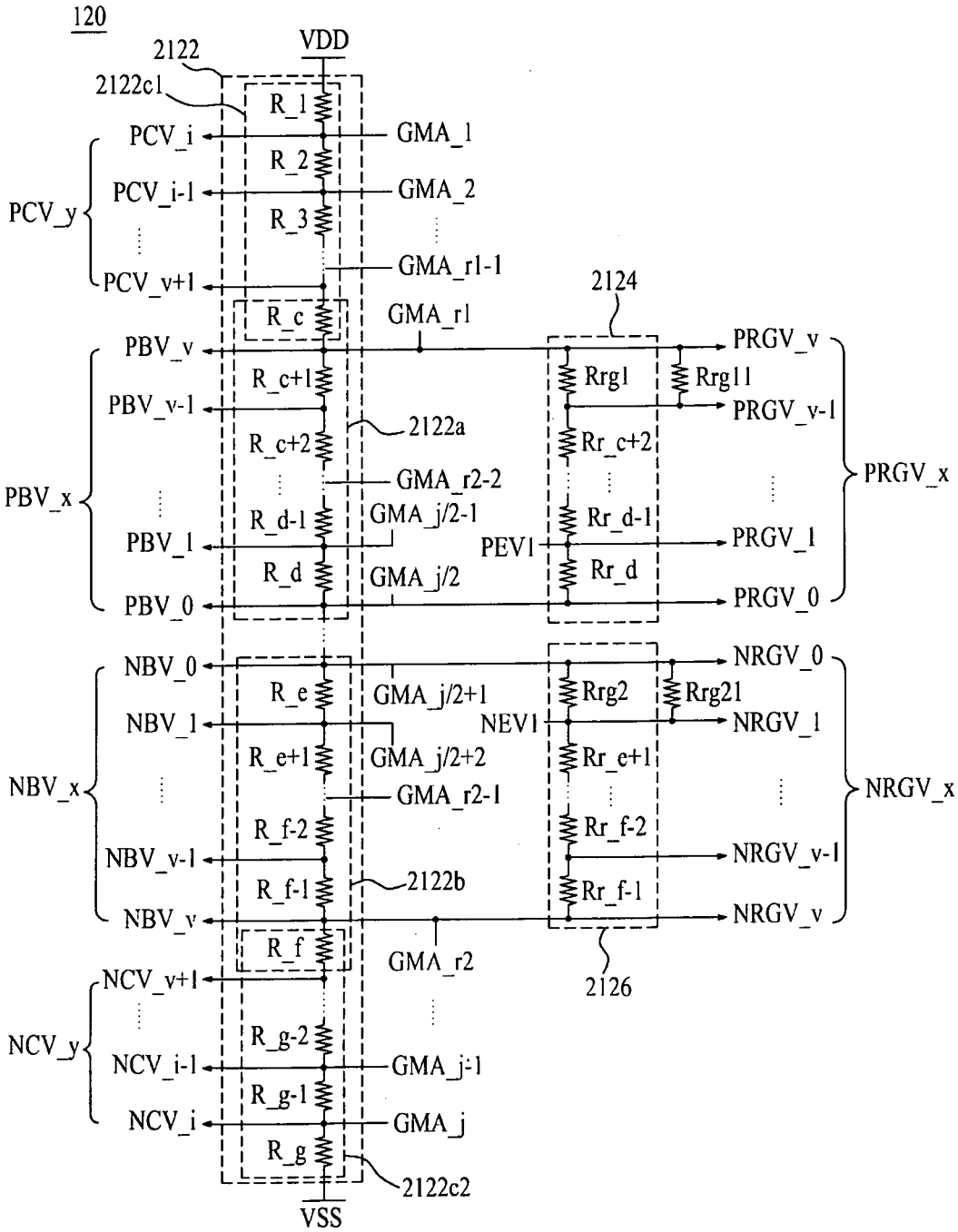
FIG. 14 is a schematic circuit diagram of an exemplary gray scale voltage generator of a data driving device according to a seventh embodiment of the present invention.

FIG. 14 is a schematic circuit diagram of an exemplary gray scale voltage generator 120 of the data driving device 100 according to a seventh embodiment of the present invention. The data driving device 100 according to the seventh embodiment of the present invention generally has the same configuration as the data driving device 100 according to the sixth embodiment of the present invention shown in FIGS. 2 and 13 with the exception that it further includes first and second external resistors Rrg11 and Rrg21 connected to the gray scale voltage generator 120. Therefore, descriptions of like elements in FIGS. 2 and 13 already described above are not repeated.

In particular, the first external resistor Rrg11 is connected in parallel to the first red/green resistor Rrg1 of the second voltage-dividing resistor string 2124 to finely adjust the resistance of the first red/green resistor Rrg1, as described above in the second embodiment of the present invention. The second external resistor Rrg21 is connected in parallel to the second red/green resistor Rrg2 of the third voltage-dividing resistor string 2126 to finely adjust the resistance of the second red/green resistor Rrg2, as described above in the second embodiment of the present invention. Accordingly, the data driving device 100 according to the seventh embodiment of the present invention can finely adjust each of the positive and negative red/green lower gray scale voltages PRGV_x and NRGV_x using each of the first and second external resistors Rrg11 and Rrg21 to maintain a color temperature based on a gray scale more constant.

Figure 15:
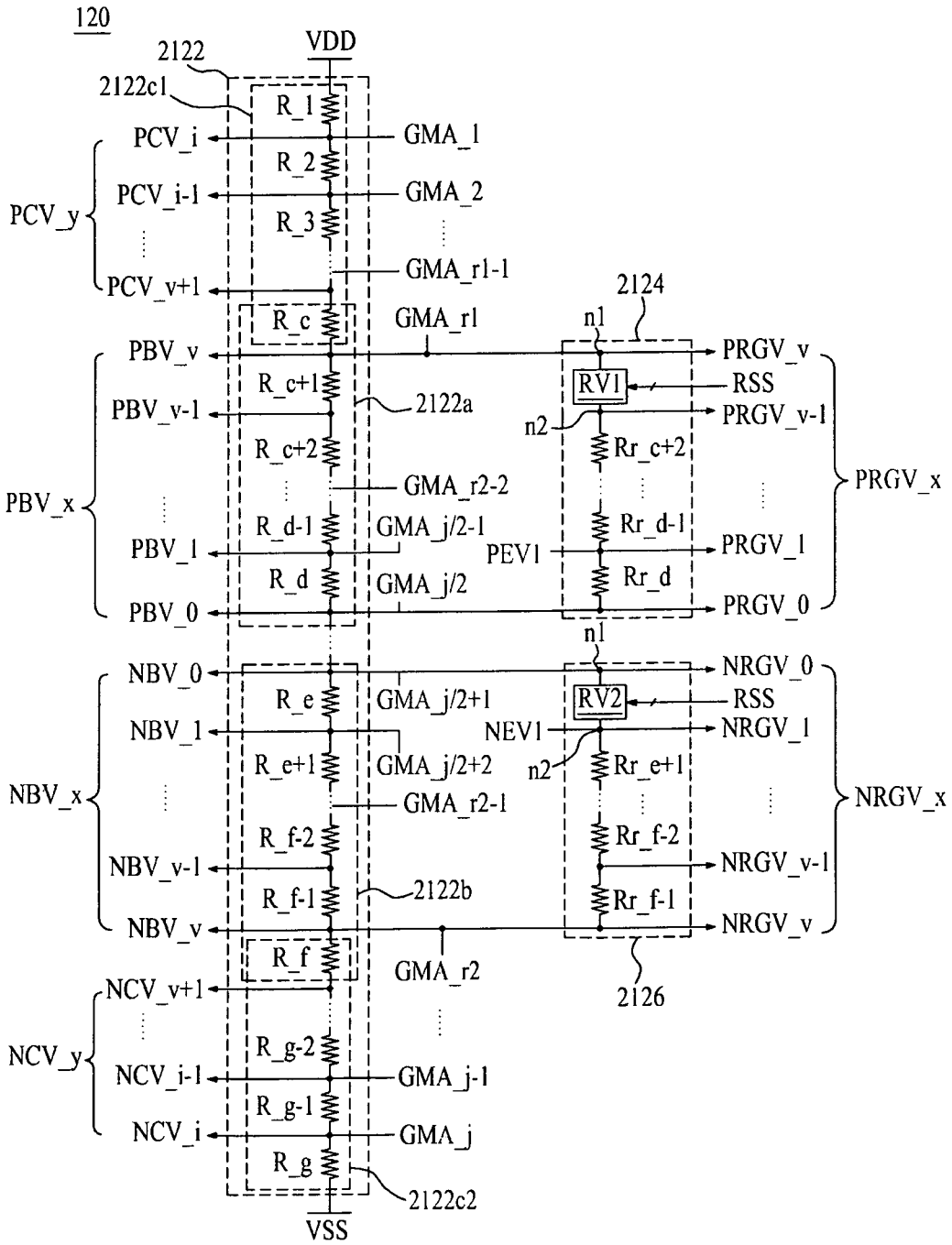
FIG. 15 is a schematic circuit diagram of an exemplary gray scale voltage generator of a data driving device according to an eighth embodiment of the present invention.

FIG. 15 is a schematic circuit diagram of an exemplary gray scale voltage generator 120 of a data driving device 100 according to an eighth embodiment of the present invention. The data driving device 100 according to the eighth embodiment of the present invention generally has the same configuration as the data driving device 100 according to the sixth embodiment of the present invention shown in FIGS. 2 and 13 with some modifications. Therefore, descriptions of like elements in FIGS. 2 and 13 already described above are not repeated.

In particular, the gray scale voltage generator 120 of the data driving device 100 according to the eighth embodiment of the present invention includes first and second selectors RV1 and RV2 in place of the first and second red/green resistors Rrg1 and Rrg2 in the second and third voltage-dividing resistor strings 2124 and 2126 shown in FIG. 13.

The first selector RV1 includes a plurality of optional resistors Ra, Rb, Rc, and Rd, and a multiplexer MUX as described above in the third embodiment of the present invention (FIG. 10). The first selector RV1 selects any one of the optional resistors Ra, Rb, Rc, and Rd based on a resistor selection signal RSS, thereby making it possible not only to optimize the x red/green gray scale voltages PRGV_x in the positive area, but also to finely adjust the same.

The second selector RV2 includes a plurality of optional resistors Ra, Rb, Rc, and Rd, and a multiplexer MUX as described above in the third embodiment of the present invention (FIG. 10). The second selector RV2 selects any one of the optional resistors Ra, Rb, Rc, and Rd based on a resistor selection signal RSS, thereby making it possible not only to optimize the x red/green gray scale voltages NRGV_x in the negative area, but also to finely adjust the same.

Accordingly, the data driving device 100 according to the eighth embodiment of the present invention can optimize and finely adjust each of the positive and negative red/green lower gray scale voltages PRGV_x and NRGV_x using each of the first and second selectors RV1 and RV2 to maintain a color temperature based on a gray scale more constant.

Figure 16:
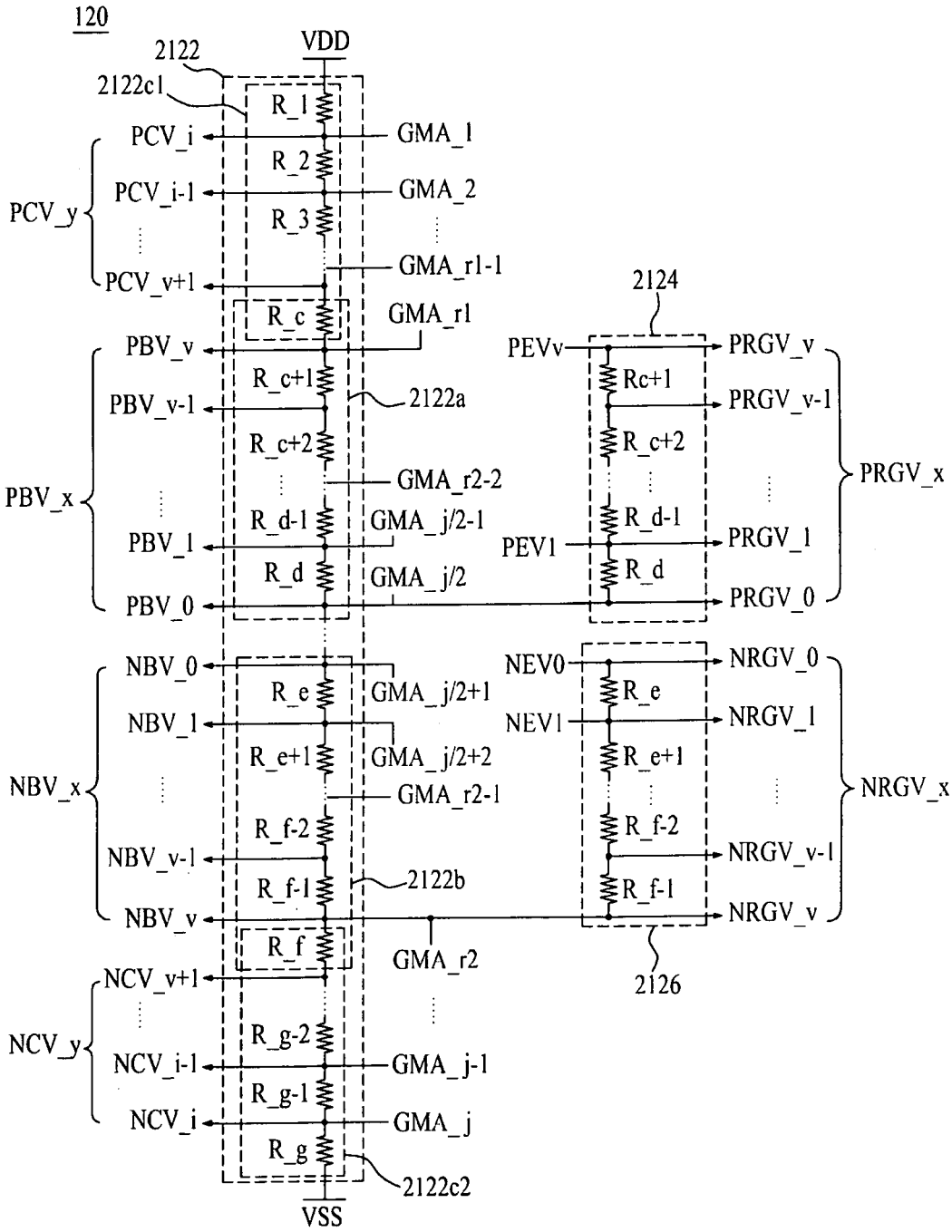
FIG. 16 is a schematic circuit diagram of an exemplary gray scale voltage generator of a data driving device according to a ninth embodiment of the present invention.

FIG. 16 is a schematic circuit diagram of an exemplary gray scale voltage generator 120 of the data driving device 100 according to a ninth embodiment of the present invention. The data driving device 100 according to the ninth embodiment of the present invention generally has the same configuration as the data driving device 100 according to the sixth embodiment of the present invention shown in FIGS. 2 and 13 with some modifications. Therefore, descriptions of like elements in FIGS. 2 and 13 already described above are not repeated.

In particular, the second voltage-dividing resistor string 2124 includes (c+1)th to dth voltage-dividing resistors R_c+1 to R_d each having the same resistance as that of the corresponding ones of the resistors in the first area 2122*a* of the first voltage-dividing resistor string 2122. The second voltage-dividing resistor string 2124 generates the positive red/green lower gray scale voltages PRGV_x based on the vth positive gray scale external voltage PEVv. Therefore, the ninth embodiment of the present invention can finely adjust the positive red/green lower gray scale voltages PRGV_x by adjusting the vth positive gray scale external voltage PEVv.

The third voltage-dividing resistor string 2126 includes eth to (f−1)th voltage-dividing resistors R_e to R_f−1 each having the same resistance as that of the corresponding ones of the resistors in the second area 2122*b* of the first voltage-dividing resistor string 2122. The third voltage-dividing resistor string 2126 generates the negative red/green lower gray scale voltages NRGV_x based on the 0th negative gray scale external voltage NEV0. Therefore, the ninth embodiment of the present invention can finely adjust the negative red/green lower gray scale voltages NRGV_x by adjusting the 0th negative gray scale external voltage NEV0.

Accordingly, the data driving device 100 according to the ninth embodiment of the present invention can optimize and finely adjust each of the positive and negative red/green lower gray scale voltages PRGV_x and NRGV_x using each of the vth positive gray scale external voltage PEVv and the 0th negative gray scale external voltage NEV0 to maintain a color temperature based on a gray scale more constant.

Figure 17:
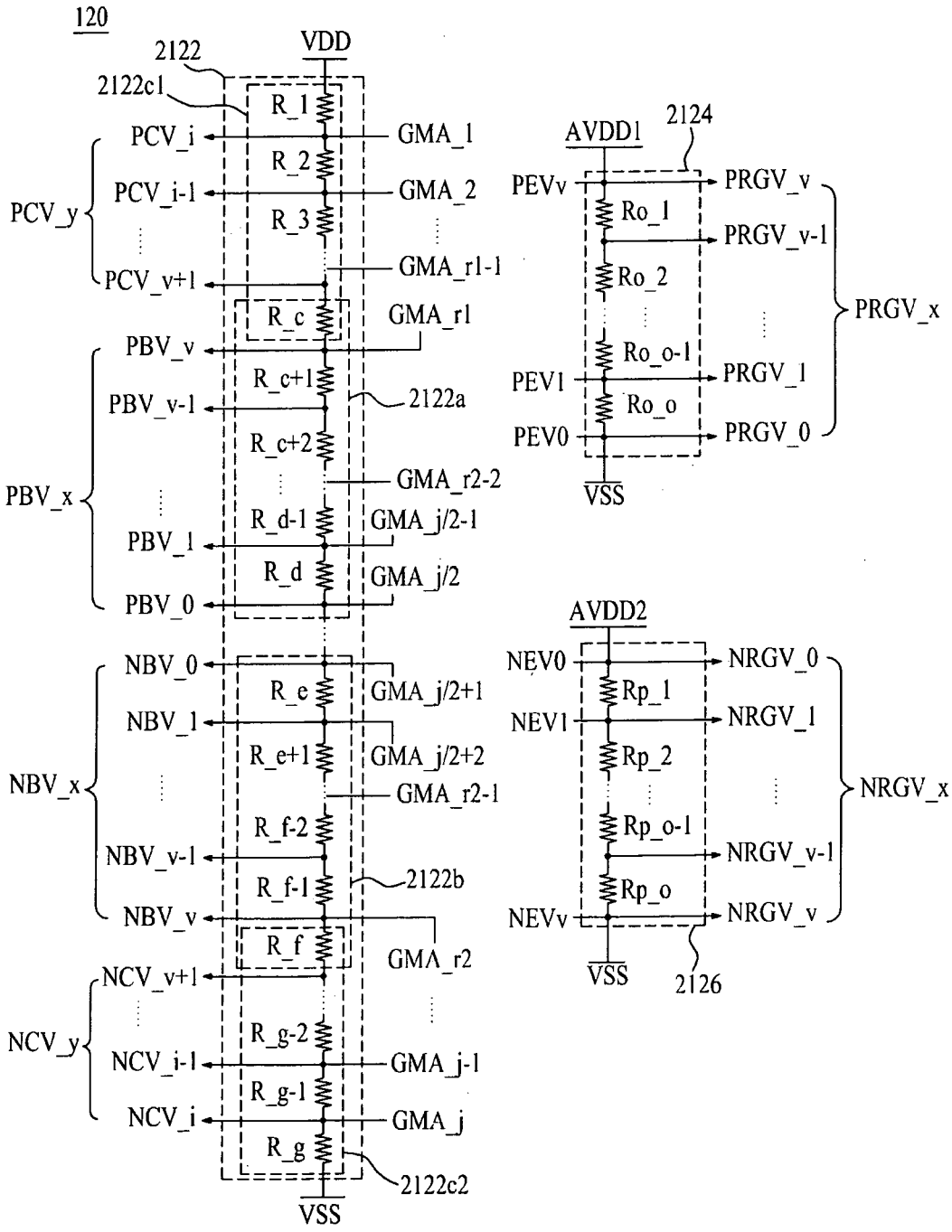
FIG. 17 is a schematic circuit diagram of an exemplary gray scale voltage generator of a data driving device according to a tenth embodiment of the present invention.

FIG. 17 is a schematic circuit diagram of an exemplary gray scale voltage generator 120 of the data driving device 100 according to a tenth embodiment of the present invention. The data driving device 100 according to the tenth embodiment of the present invention generally has the same configuration as the data driving device 100 according to the sixth embodiment of the present invention shown in FIGS. 2 and 13 with some modifications. Therefore, descriptions of like elements in FIGS. 2 and 13 already described above are not repeated.

In particular, the gray scale voltage generator 120 of the data driving device 100 according to the tenth embodiment of the present invention includes first to third voltage-dividing resistor strings 2122, 2124, and 2126.

The first voltage-dividing resistor string 2122 generates positive and negative three-color common gray scale voltages PCV_y and NCV_y and positive and negative blue gray scale voltages PBV_x and NBV_x using voltage divisions of first to gth voltage-dividing resistors R_1 to R_g connected in series between a driving voltage source VDD and a ground voltage source VSS. The first voltage-dividing resistor string 2122 has the same configuration as that of the sixth embodiment of the present invention shown in FIG. 13, and a detailed description thereof is not repeated.

The second voltage-dividing resistor string 2124 includes first to oth positive voltage-dividing resistors Ro_1 to Ro_o connected in series between a first supply voltage source AVDD1 and the ground voltage source VSS. The first supply voltage source AVDD1 may have a voltage level between a vth positive gray scale voltage PRGV_v and the driving voltage source VDD or may be the same as an (r1)th reference gamma voltage GMA_r1. A plurality of positive external voltages PEVv to PEV0 are supplied to intermediate voltage-dividing nodes of the second voltage-dividing resistor string 2124. The vth positive gray scale external voltage PEVv may be an (r1)th reference gamma voltage GMA_r1, and the 0th positive gray scale external voltage PEV0 may be a (j/2)th reference gamma voltage GMA_j/2.

The second voltage-dividing resistor string 2124 supplies to the analog processor 140, x positive red/green lower gray scale voltages PRGV_x including the vth to 0th gray scale voltages PRGV_v to PRGV_0 generated by the voltage divisions at the corresponding voltage-dividing nodes each formed between every adjacent ones of the first to oth positive voltage-dividing resistors Ro_1 to Ro_o.

The third voltage-dividing resistor string 2126 includes first to oth negative voltage-dividing resistors Rp_1 to Rp_o connected in series between a second supply voltage source AVDD2 and the ground voltage source VSS. The second supply voltage source AVDD2 may have a voltage level between a vth negative gray scale voltage NRGV_v and the ground voltage source VSS. A plurality of negative external voltages NEV0 to NEVv are supplied to intermediate voltage-dividing nodes of the third voltage-dividing resistor string 2126. The 0th negative gray scale external voltage NEV0 may be a (j/2+1)th reference gamma voltage GMA_j/2+1, and the vth negative gray scale external voltage NEVv may be an (r2)th reference gamma voltage GMA_r2.

The third voltage-dividing resistor string 2126 supplies to the analog processor 140, x negative red/green lower gray scale voltages NRGV_x including the 0th to vth gray scale voltages NRGV_0 to NRGV_v generated by the voltage divisions at the corresponding voltage-dividing nodes each formed between every adjacent ones of the first to oth negative voltage-dividing resistors Rp_1 to Rp_o.

The gray scale voltage generator 120 of the data driving device 100 according to the tenth embodiment of the present invention generates the positive and negative three-color common gray scale voltages PCV_y and NCV_y and the positive and negative blue gray scale voltages PBV_x and NBV_x using the first voltage-dividing resistor string 2122 and generates the positive and negative red/green lower gray scale voltages PRGV_x and NRGV_x using the second and third voltage-dividing resistor strings 2124 and 2126 isolated from the first voltage-dividing resistor string 2122. In order to compensate for a color temperature, each of the positive blue lower gray scale voltages PBV_x has a voltage level higher by a predetermined value than each of the positive red/green lower gray scale voltages PRGV_x, and each of the negative blue lower gray scale voltages NBV_x has a voltage level lower by a predetermined value than each of the negative red/green lower gray scale voltages NRGV_x. Therefore, the data driving device 100 according to the tenth embodiment of the present invention can separately and individually control the blue lower gray scale voltages PBV_x and NBV_x and the red/green lower gray scale voltages PRGV_x and NRGV_x so as to maintain a color temperature based on a gray scale constant.

Although the data driving devices according to the first to tenth embodiments of the present invention have been described to separately and individually control the upper or lower gray scales of the blue gray scale voltages PBV_x and NBV_x and red/green gray scale voltages PRGV_x and NRGV_x, the present invention is not limited thereto and may separately and individually control the upper and lower gray scales of the gray scale voltages as will hereinafter be described.

Figure 18:
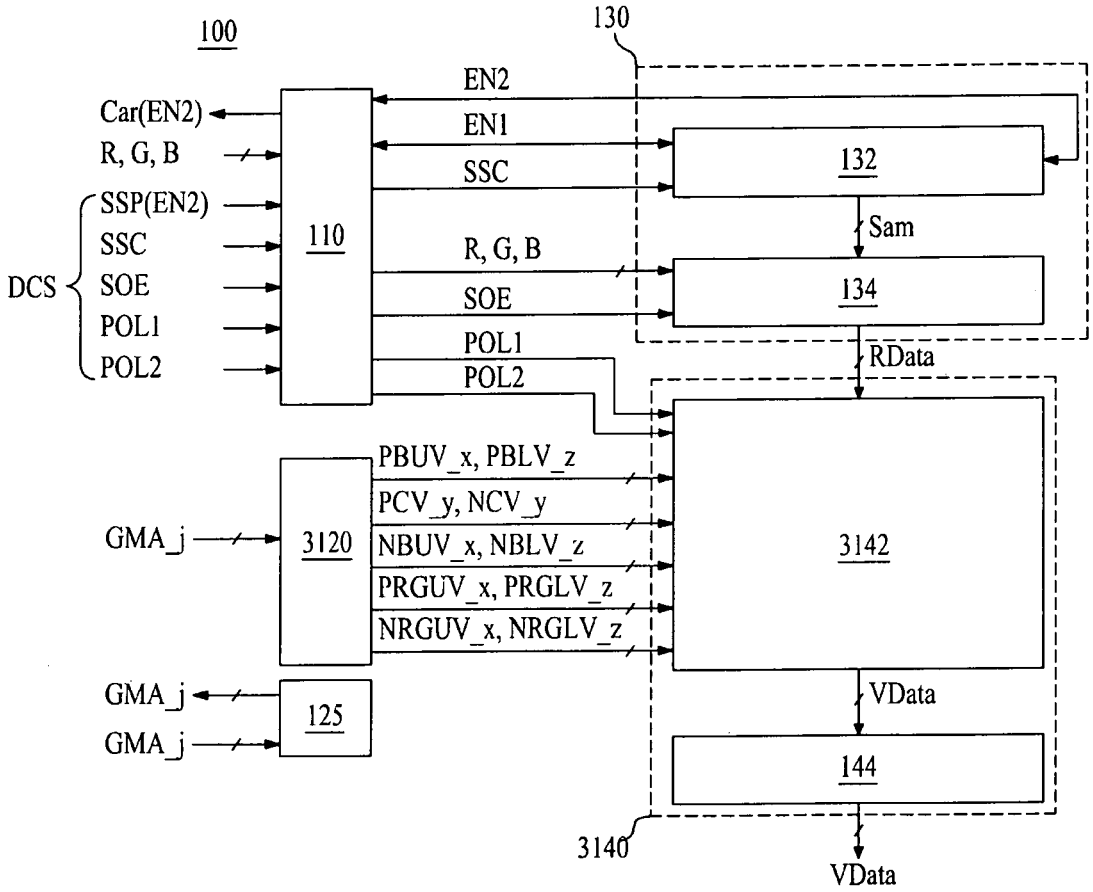
FIG. 18 is a block diagram schematically showing the configuration of a data driving device according to an eleventh embodiment of the present invention.

FIG. 18 is a block diagram schematically showing an exemplary configuration of the data driving device 100 according to an eleventh embodiment of the present invention. The data driving device 100 according to the eleventh embodiment of the present invention generally has the same configuration as that of the first embodiment of the present invention shown in FIG. 2 with the exception of a gray scale voltage generator 3120 and an analog processor 3140. Therefore, descriptions of like elements in FIG. 2 already described above are not repeated.

Figure 19:
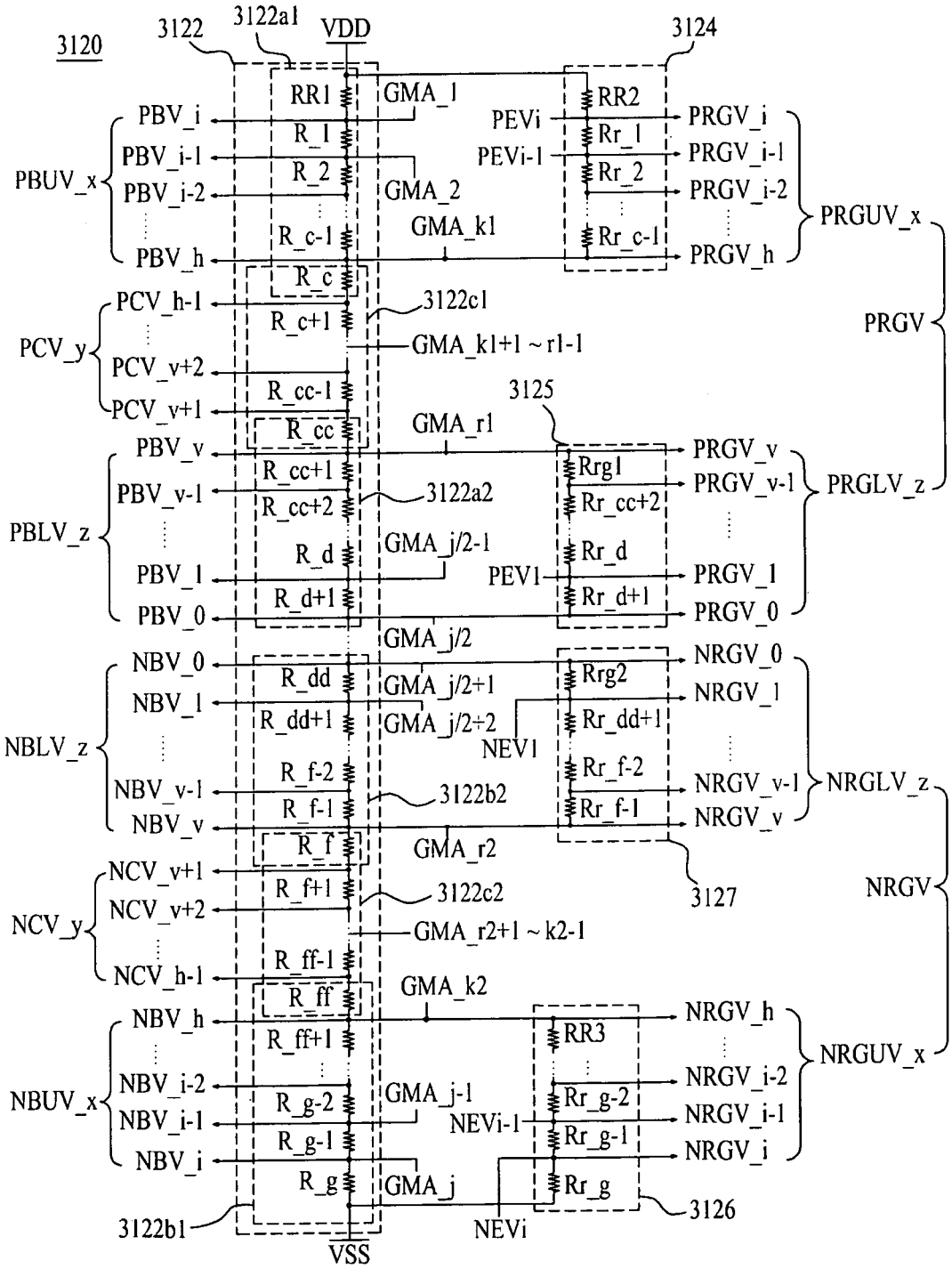
FIG. 19 is a schematic circuit diagram of an exemplary gray scale voltage generator shown in FIG. 18.

In particular, the gray scale voltage generator 3120 includes first to fifth voltage-dividing resistor strings 3122, 3124, 3125, 3126, and 3127, as shown in FIG. 19. Generally, the gray scale voltage generator 3120 of the present exemplary embodiment includes a combination of the gray scale voltage generator 120 of the first embodiment of the present invention shown in FIG. 3 and the sixth embodiment of the present invention shown in FIG. 13. Therefore, descriptions of like elements in FIGS. 3 and 13 already described above are not repeated.

The first voltage-dividing resistor string 3122 includes first to fourth areas 3122*a*1, 3122*a*2, 3122*b*1, and 3122*b*2, and first and second common areas 3122*c*1 and 3122*c*2.

The first area 3122*a*1 is substantially the same as the first area 122*a* of the gray scale voltage generator 120 shown in FIG. 3 with different reference labels. Therefore, the first area 3122*a*1 generates x positive blue upper gray scale voltages PBUV_x including ith to hth positive gray scale voltages PBV_i to PBV_h in accordance with the principles described above and supplies the generated voltages to the analog processor 3140.

The first common area 3122*c*1 is substantially the same as the positive area of the common area 122*c* of the gray scale voltage generator 120 shown in FIG. 3 with different reference labels. Therefore, the first common area 3122*c*1 generates y positive three-color common gray scale voltages PCV_y including (h−1)th to (v+1)th positive gray scale voltages PCV_h−1 to PCV_v+1 in accordance with the principles described above and supplies the generated voltages to the analog processor 3140.

The second area 3122*a*2 is substantially the same as the first area 2122*a* of the gray scale voltage generator 120 shown in FIG. 13 with different reference labels. Therefore, the second area 3122*a*2 generates z positive blue lower gray scale voltages PBLV_z including vth to 0th positive gray scale voltages PBV_v to PBV_0 in accordance with the principles described above and supplies the generated voltages to the analog processor 3140.

The third area 3122*b*1 is substantially the same as the second area 122*b* of the gray scale voltage generator 120 shown in FIG. 3 with different reference labels. Therefore, the third area 3122*b*1 generates x negative blue upper gray scale voltages NBUV_x including hth to ith negative gray scale voltages NBV_h to NBV_i in accordance with the principles described above and supplies the generated voltages to the analog processor 3140.

The second common area 3122*c*2 is substantially the same in configuration as the negative area of the common area 122*c* of the gray scale voltage generator 120 shown in FIG. 3 with different reference labels. Therefore, the second common area 3122*c*2 generates y negative three-color common gray scale voltages NCV_y including (v+1)th to (h−1)th negative gray scale voltages NCV_v+1 to NCV_h−1 in accordance with the principles described above and supplies the generated voltages to the analog processor 3140.

The fourth area 3122*b*2 is substantially the same as the second area 2122*b* of the gray scale voltage generator 120 shown in FIG. 13 with different reference labels. Therefore, the fourth area 3122*b*2 generates z negative blue lower gray scale voltages NBLV_z including 0th to vth negative gray scale voltages NBV_0 to NBV_v in accordance with the principles described above and supplies the generated voltages to the analog processor 3140.

The second voltage-dividing resistor string 3124 is substantially the same as the second voltage-dividing resistor string 124 of the gray scale voltage generator 120 shown in FIG. 3 with different reference labels. Therefore, the second voltage-dividing resistor string 3124 generates x positive red/green upper gray scale voltages PRGUV_x including ith to hth positive gray scale voltages PRGV_i to PRGV_h in accordance with the principles described above and supplies the generated voltages to the analog processor 3140.

The third voltage-dividing resistor string 3125 is substantially the same as the second voltage-dividing resistor string 2124 of the gray scale voltage generator 120 shown in FIG. 13 with different reference labels. Therefore, the third voltage-dividing resistor string 3125 generates z positive red/green lower gray scale voltages PRGLV_z including vth to 0th positive gray scale voltages PRGV_v to PRGV_0 in accordance with the principles described above and supplies the generated voltages to the analog processor 3140.

The fourth voltage-dividing resistor string 3126 is substantially the same as the third voltage-dividing resistor string 126 of the gray scale voltage generator 120 shown in FIG. 3 with different reference labels. Therefore, the fourth voltage-dividing resistor string 3126 generates x negative red/green upper gray scale voltages NRGUV_x including hth to ith negative gray scale voltages NRGV_h to NRGV_i in accordance with the principles described above and supplies the generated voltages to the analog processor 3140.

The fifth voltage-dividing resistor string 3127 is substantially the same as the third voltage-dividing resistor string 2126 of the gray scale voltage generator 120 shown in FIG. 13 with different reference labels. Therefore, the fifth voltage-dividing resistor string 3127 generates z negative red/green lower gray scale voltages NRGLV_z including 0th to vth negative gray scale voltages NRGV_0 to NRGV_v in accordance with the principles described above and supplies the generated voltages to the analog processor 3140.

The gray scale voltage generator 3120 in accordance with the eleventh embodiment of the present invention generates the positive and negative blue upper and lower gray scale voltages PBUV_x, PBLV_z, NBUV_x, and NBLV_z and the positive and negative three-color common gray scale voltages PCV_y and NCV_y using the first voltage-dividing resistor string 3122, generates the positive red/green upper and lower gray scale voltages PRGUV_x and PRGLV_z using the second and third voltage-dividing resistor strings 3124 and 3125, and generates the negative red/green upper and lower gray scale voltages NRGUV_x and NRGLV_z using the fourth and fifth voltage-dividing resistor strings 3126 and 3127.

Figure 20:
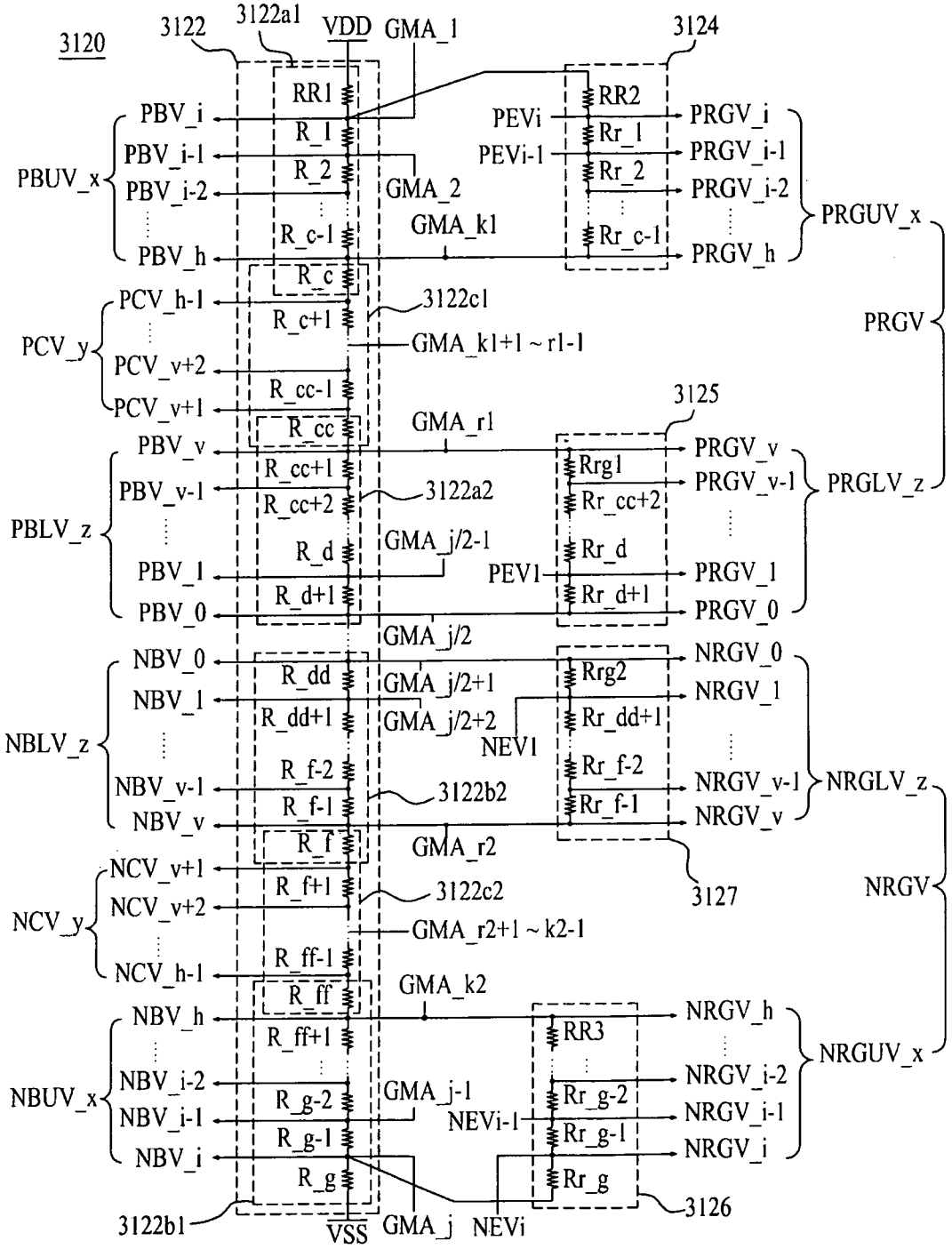
FIG. 20 is a schematic circuit diagram of another exemplary configuration of the gray scale voltage generator shown in FIG. 18.

Alternatively, as shown in FIG. 20, the second resistor RR2 of the second voltage-dividing resistor string 3124 may be connected to the voltage-dividing node (between RR1 and R_1) that generates the ith positive gray scale voltage PBV_i among the voltage-dividing nodes of the first voltage-dividing resistor string 3122 rather than to the driving voltage source VDD. Likewise, the gth voltage-dividing resistor Rr_g of the fourth voltage-dividing resistor string 3126 may be connected to the voltage-dividing node (between R_g−1 and R_g) that generates the ith negative gray scale voltage NBV_i among the voltage-dividing nodes of the first voltage-dividing resistor string 3122 rather than to the ground voltage source VSS.

Figure 21:
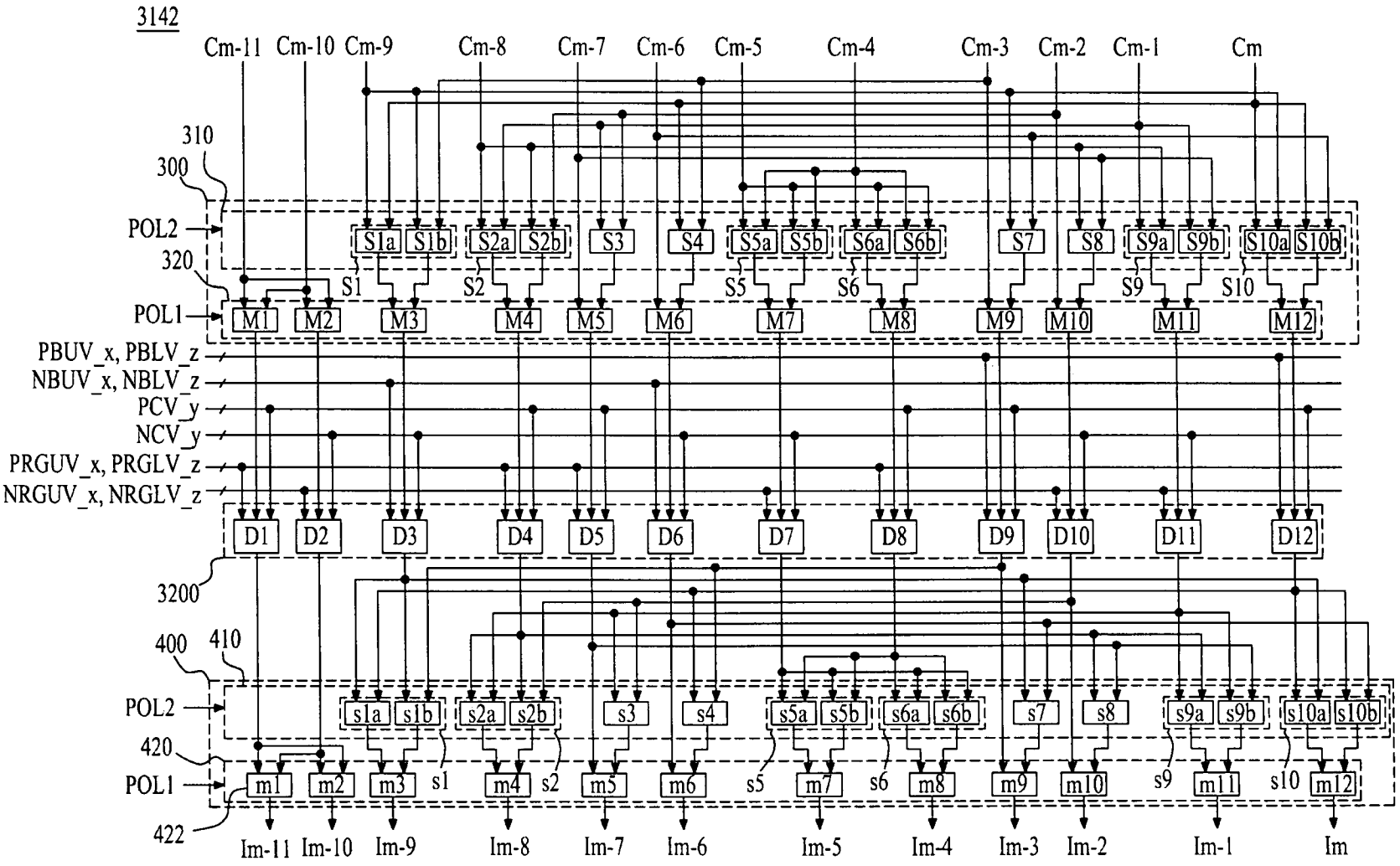
FIG. 21 is a schematic block diagram of an exemplary digital/analog converter shown in FIG. 18.

As shown in FIG. 18, the analog processor 3140 includes a D/A converter 3142 and an output buffer part 144. The D/A converter 3142, as shown in FIG. 21, is the same as that of the first embodiment of the present invention shown in FIG. 5 with the exception of the gray scale voltages PBUV_x, PBLV_z, NBUV_x, NBLV_z, PCV_y, NCV_y, PRGUV_x, PRGLV_z, NRGUV_x, and NRGLV_z supplied to a data converter 3200. Therefore, a description of like elements shown in FIG. 5 already described above is not repeated.

In particular, the positive red/green upper and lower gray scale voltages PRGUV_x and PRGLV_z and the positive three-color common gray scale voltages PCV_y from the gray scale voltage generator 3120 are supplied to each of the first, fourth, fifth, and eighth decoders D1, D4, D5, and D8. Each of the first, fourth, fifth, and eighth decoders D1, D4, D5, and D8 converts the latched red or green data RData into a positive red or green image signal VData using the positive red/green upper and lower gray scale voltages PRGUV_x and PRGLV_z and the positive three-color common gray scale voltages PCV_y.

The negative red/green upper and lower gray scale voltages NRGUV_x and NRGLV_z and the negative three-color common gray scale voltages NCV_y from the gray scale voltage generator 3120 are supplied to each of the second, seventh, tenth, and eleventh decoders D2, D7, D10, and D11. Each of the second, seventh, tenth, and eleventh decoders D2, D7, D10, and D11 converts the latched red or green data RData into a negative red or green image signal VData using the negative red/green upper and lower gray scale voltages NRGUV_x and NRGLV_z and the negative three-color common gray scale voltages NCV_y.

The positive blue upper and lower gray scale voltages PBUV_x and PBLV_z and the positive three-color common gray scale voltages PCV_y from the gray scale voltage generator 3120 are supplied to each of the ninth and twelfth decoders D9 and D12. Each of the ninth and twelfth decoders D9 and D12 converts the latched blue data RData into a positive blue image signal VData using the positive blue upper and lower gray scale voltages PBUV_x and PBLV_z and the positive three-color common gray scale voltages PCV_y.

The negative blue upper and lower gray scale voltages NBUV_x and NBLV_z and the negative three-color common gray scale voltages NCV_y from the gray scale voltage generator 3120 are supplied to each of the third and sixth decoders D3 and D6. Each of the third and sixth decoders D3 and D6 converts the latched blue data RData into a negative blue image signal VData using the negative blue upper and lower gray scale voltages NBUV_x and NBLV_z and the negative three-color common gray scale voltages NCV_y.

The D/A converter 3142 controls the paths of the data and image signals based on the logic states of the first and second polarity control signals POL1 and POL2 using the data path controller 300 and image signal path controller 400 in the manner already described previously with reference to FIGS. 5 and 6A-6D. Therefore, the D/A converter 3142 converts the latched data RData into the image signals VData having the polarity pattern of the horizontal 1-dot or horizontal 2-dot inversion mode and supplies the converted image signals to the output buffer part 144.

The output buffer part 144 buffers the image signal VData of each channel supplied from the D/A converter 3142 and outputs the buffered image signal externally through a final output channel. The output buffer part 144 amplifies and outputs the image signal VData based on an external load.

As described above, the data driving device 100 according to the eleventh embodiment of the present invention can separately and individually control the blue upper and lower gray scale voltages PBV and NBV and the red/green upper and lower gray scale voltages PRGV and NRGV so as to maintain a color temperature based on a gray scale more constant.

Figure 22:
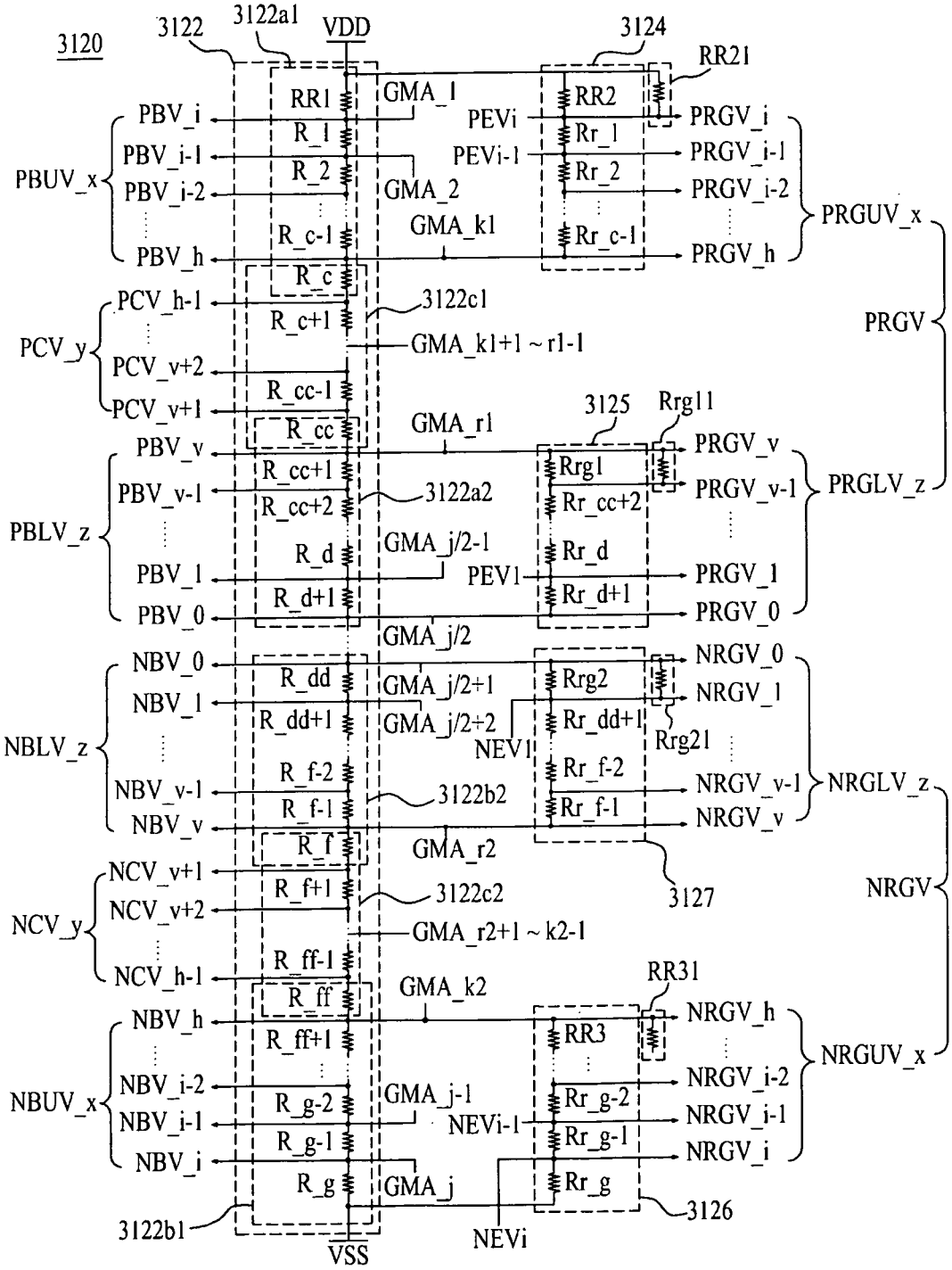
FIG. 22 is a schematic circuit diagram of an exemplary gray scale voltage generator of a data driving device according to a twelfth embodiment of the present invention.

FIG. 22 is a schematic circuit diagram of an exemplary gray scale voltage generator 3120 of the data driving device 100 according to a twelfth embodiment of the present invention. The data driving device 100 according to the twelfth embodiment of the present invention generally the same as the data driving device 100 according to the eleventh embodiment of the present invention shown in FIGS. 18 and 19 with the exception that it further includes first to fourth external resistors RR21, Rrg11, RR31, and Rrg21 connected to the gray scale voltage generator 3120. Therefore, descriptions of like elements in FIGS. 18 and 19 already described above are not repeated.

The first external resistor RR21 is connected in parallel to the second red/green resistor RR2 of the second voltage-dividing resistor string 3124 to finely adjust the resistance of the second red/green resistor RR2 in a similar manner as described above in the second embodiment of the present invention. The second external resistor Rrg11 is connected in parallel to the first red/green resistor Rrg1 of the third voltage-dividing resistor string 3125 to finely adjust the resistance of the first red/green resistor Rrg1 in a similar manner as described above in the seventh embodiment of the present invention. The third external resistor RR31 is connected in parallel to the third red/green resistor RR3 of the fourth voltage-dividing resistor string 3126 to finely adjust the resistance of the third red/green resistor RR3 in a similar manner as described above in the second embodiment of the present invention. The fourth external resistor Rrg21 is connected in parallel to the second red/green resistor Rrg2 of the fifth voltage-dividing resistor string 3127 to finely adjust the resistance of the second red/green resistor Rrg2 in a similar manner as described above in the seventh embodiment of the present invention. Accordingly, the data driving device 100 according to the twelfth embodiment of the present invention can finely adjust each of the positive and negative red/green upper and lower gray scale voltages PRGV and NRGV using each of the first to fourth external resistors RR21, Rrg11, RR31, and Rrg21 to maintain a color temperature based on a gray scale more constant.

Alternatively, in the gray scale voltage generator 3120 of the data driving device 100 according to the twelfth embodiment of the present invention, the second resistor RR2 of the second voltage-dividing resistor string 3124 and the gth voltage-dividing resistor Rr_g of the fourth voltage-dividing resistor string 3126 may be connected to the first voltage-dividing resistor string 3122 in the same manner shown in FIG. 20 and described above.

Figure 23:
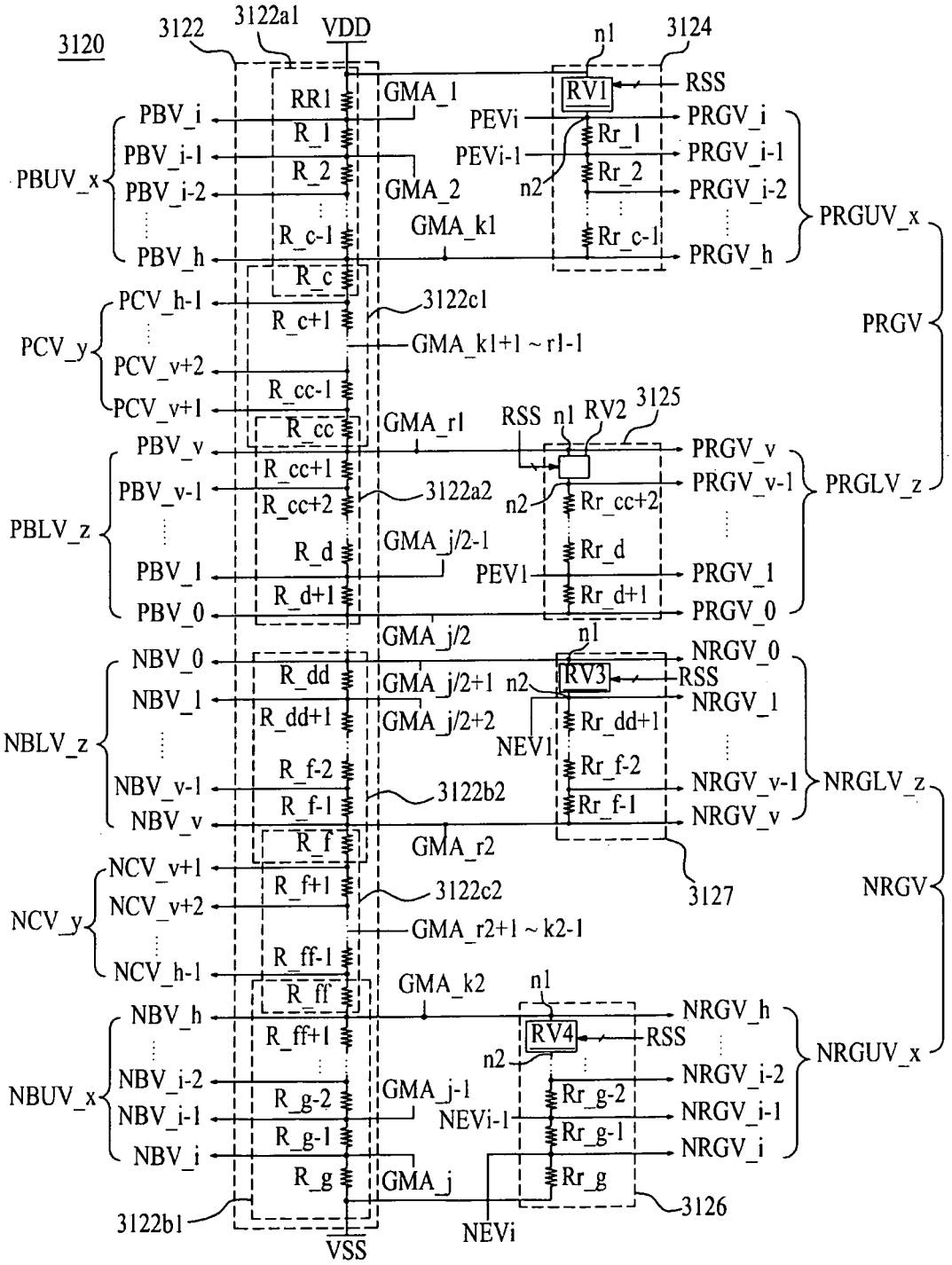
FIG. 23 is a schematic circuit diagram of an exemplary gray scale voltage generator of a data driving device according to a thirteenth embodiment of the present invention.

FIG. 23 is a schematic circuit diagram of an exemplary gray scale voltage generator 3120 of the data driving device 100 according to a thirteenth embodiment of the present invention. The gray scale voltage generator 3120 of the data driving device 100 according to the thirteenth embodiment of the present invention is generally a combination of the third embodiment of the present invention as shown in FIGS. 9 and 10 and the eighth embodiment of the present invention shown in FIG. 15 as applied to the eleventh embodiment of the present invention as shown in FIG. 19. That is, the gray scale voltage generator 3120 includes first to fourth selectors RV1 to RV4 in place of the second resistor RR2, first red/green resistor Rrg1, third resistor RR3, and second red/green resistor Rrg2 in the second to fifth voltage-dividing resistor strings 3124, 3125, 3126 and 3127. The first to fourth selectors RV1 to RV4 are the same as those in the third and eighth embodiments of the present invention as described above. Therefore, a detailed description thereof is not repeated. Accordingly, the data driving device 100 according to the thirteenth embodiment of the present invention can optimize and finely adjust each of the positive and negative red/green upper and lower gray scale voltages PRGV and NRGV using each of the first to fourth selectors RV1 to RV4.

Figure 24:
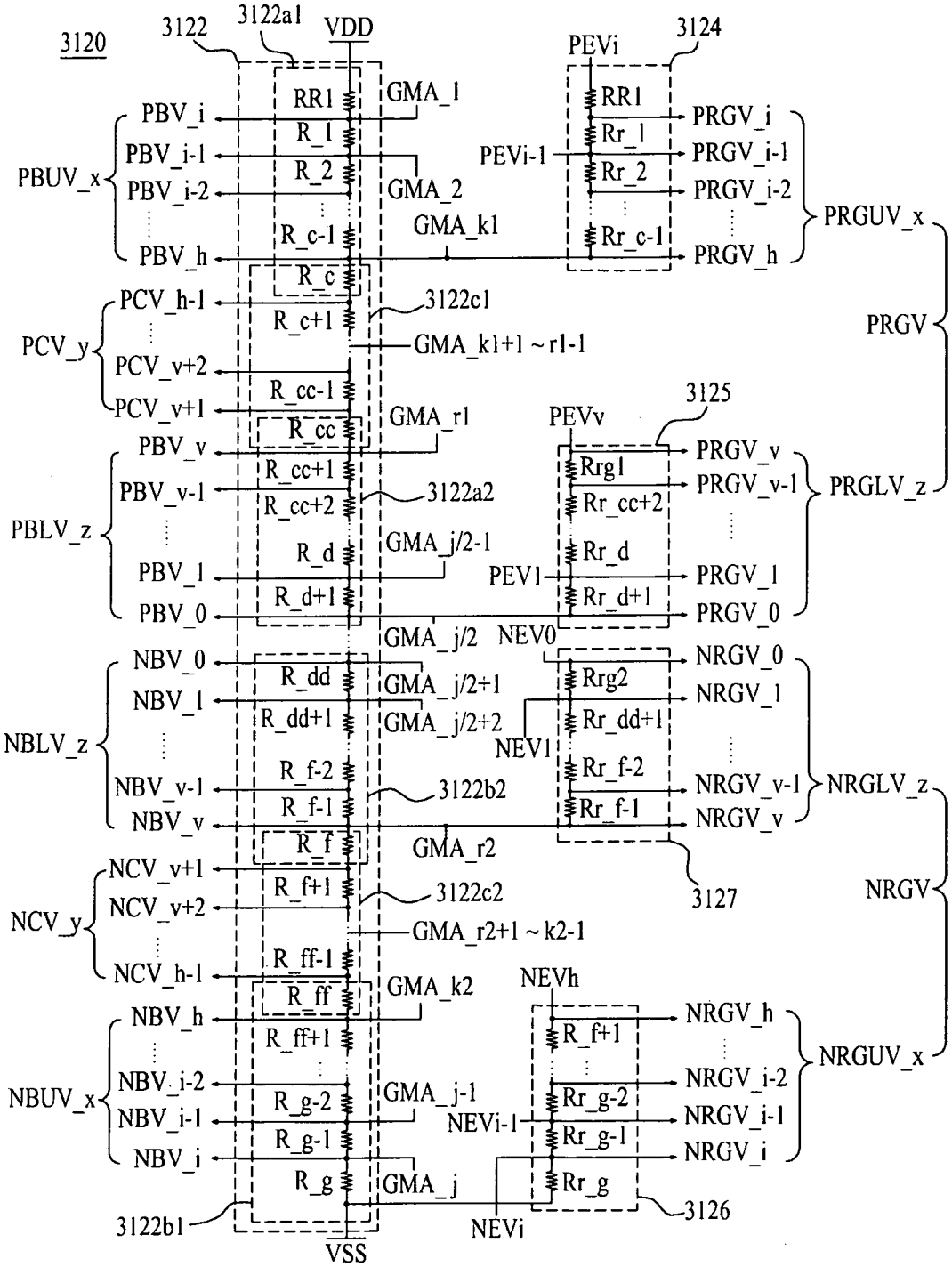
FIG. 24 is a schematic circuit diagram of an exemplary gray scale voltage generator of a data driving device according to a fourteenth embodiment of the present invention.

FIG. 24 is a schematic circuit diagram of an exemplary gray scale voltage generator 3120 of the data driving device 100 according to a fourteenth embodiment of the present invention. The gray scale voltage generator 3120 of the data driving device 100 according to the fourteenth embodiment of the present invention is generally a combination of the fourth embodiment of the present invention shown in FIG. 11 and the ninth embodiment of the present invention shown in FIG. 16 as applied to the eleventh embodiment of the present invention as shown in FIG. 19. Therefore, the gray scale voltage generator 3120 can optimize and finely adjust each of the positive and negative red/green upper and lower gray scale voltages PRGV and NRGV using each of the ith and vth positive gray scale external voltages PEVi and PEVv and hth and 0th negative gray scale external voltages NEVH and NEV0 as described above in the fourth and ninth embodiments of the present invention.

Figure 25:
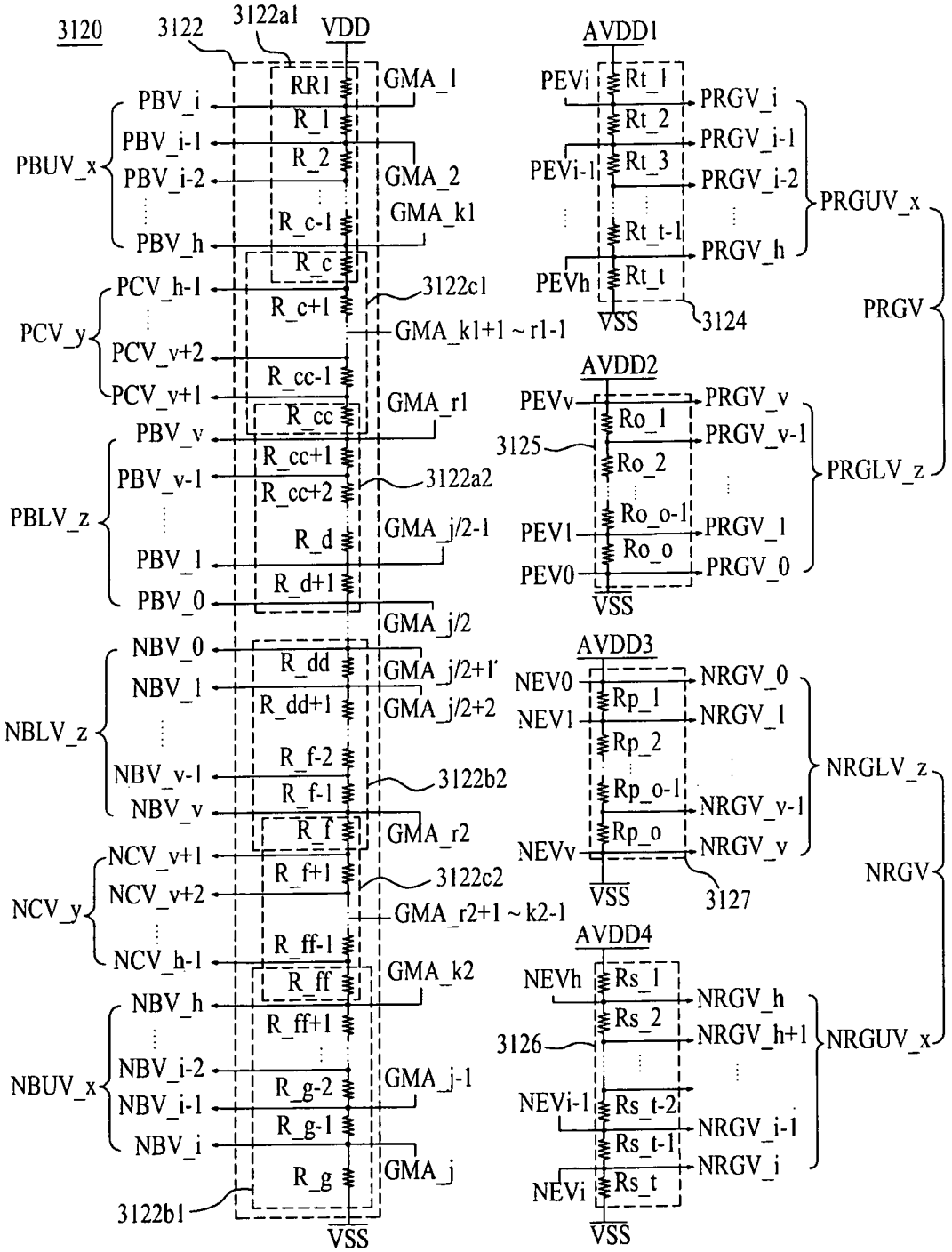
FIG. 25 is a schematic circuit diagram of an exemplary gray scale voltage generator of a data driving device according to a fifteenth embodiment of the present invention.

FIG. 25 is a schematic circuit diagram of an exemplary gray scale voltage generator 3120 of the data driving device 100 according to a fifteenth embodiment of the present invention. The gray scale voltage generator 3120 of the data driving device 100 according to the fifteenth embodiment of the present invention is generally a combination of the fifth embodiment of the present invention shown in FIG. 12 and the tenth embodiment of the present invention shown in FIG. 17 applied to the eleventh embodiment of the present invention as shown in FIG. 19. Therefore, the gray scale voltage generator 3120 can separately and individually control the positive and negative blue upper and lower gray scale voltages PBV and NBV and the positive and negative red/green upper and lower gray scale voltages PRGV and NRGV by completely isolating the second to fifth voltage-dividing resistor strings 3124, 3125, 3126, and 3127 from the first voltage-dividing resistor string 3122 using first to fourth supply voltages AVDD1, AVDD2, AVDD3, and AVDD4 as described above in the fifth and tenth embodiments of the present invention.

Figure 26:
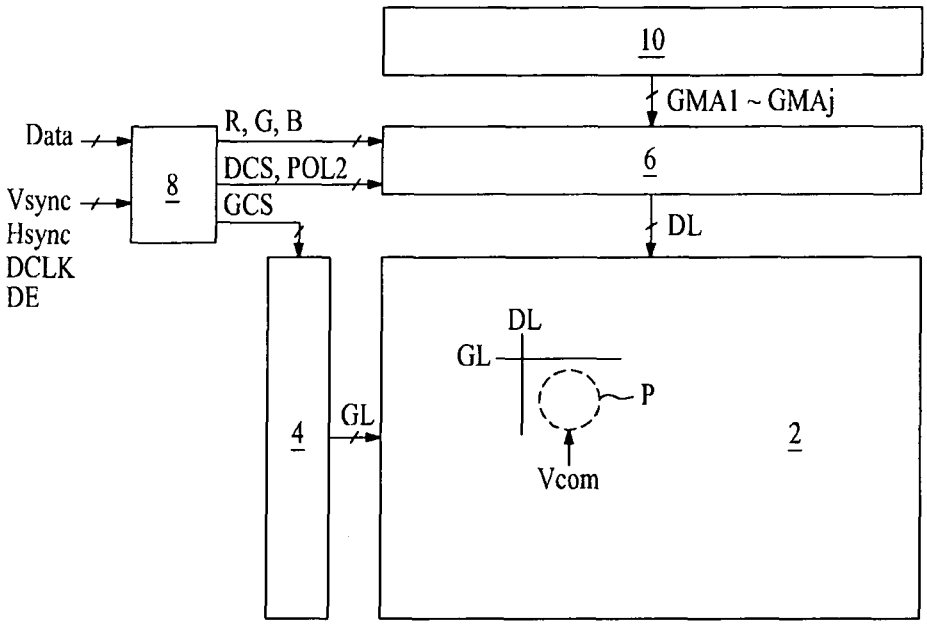
FIG. 26 is a block diagram schematically showing a liquid crystal display device according to an exemplary embodiment of the present invention.

FIG. 26 is a block diagram schematically showing a liquid crystal display device according to an exemplary embodiment of the present invention. The liquid crystal display device according to the present embodiment includes an image display panel 2 having a plurality of pixel cells P formed respectively in areas defined by a plurality of data lines DL and a plurality of gate lines GL, a gate driver 4 for driving the gate lines GL of the image display panel 2, a data driver 6 for supplying image signals to the data lines DL of the image display panel 2, a timing controller 8 for supplying data signals R, G, and B to the data driver 6 and controlling the data driver 6 and gate driver 4, and a reference gamma voltage generator 10 for generating a plurality of reference gamma voltages GMA1 to GMAj and supplying the generated reference gamma voltages to the data driver 8.

The image display panel 2 includes a spacer (not shown) for maintaining a cell gap between an upper substrate (not shown) and a lower substrate (not shown) bonded to face each other, and a liquid crystal layer (not shown) formed in a liquid crystal space provided by the spacer between the upper and lower substrates. The upper substrate includes at least three color filters including red, green, and blue color filters, a black matrix for separating the color filters from one another and defining the pixel cells, and a common electrode to which a common voltage Vcom is supplied. Here, the common electrode may be formed on the upper or lower substrate depending on a liquid crystal mode. The lower substrate includes thin film transistors formed respectively in the pixel cell P areas defined by the data lines DL and the gate lines GL and pixel electrodes connected respectively to the thin film transistors. Each thin film transistor switches an image signal supplied from a corresponding one of the data lines DL to a corresponding one of the pixel electrodes in response to a gate-on voltage supplied from a corresponding one of the gate lines GL.

The timing controller 8 arranges external image data Data and supplies the arranged data to the data driver 6. The timing controller 8 also generates a gate control signal GCS for controlling the gate driver 4 and a data control signal DCS for controlling the data driver 6 using at least one of external synchronous signals, such as a data enable signal DE that indicates a data enable period and a dot clock DCLK that determines a data transmission frequency. At this time, the timing controller 8 may generate the gate and data control signals GCS and DCS by using at least one of an external horizontal synchronous signal Hsync and an external vertical synchronous signal Vsync. The data control signal DCS includes a source output enable signal SOE that controls a data output period of the data driver 6, a source start pulse SSP that starts data sampling, a source shift clock SSC that controls a data sampling timing, and a polarity control signal POL that controls a data voltage polarity. The gate control signal GCS includes a gate output enable signal GOE that controls the output of the gate driver 4 to provide the gate-on voltage, a gate start pulse GSP that starts the driving of the gate driver 4, and a gate shift clock GSC that specifies the period of the gate-on voltage.

The gate driver 4 generates the gate-on voltage in response to the gate control signal GCS from the timing controller 8 and supplies the generated gate-on voltage sequentially to the gate lines GL. As a result, the gate lines GL of the image display panel 2 are sequentially driven by the gate-on voltage from the gate driver 4. The gate driver 4 may be formed on a substrate on which the image display panel 2 is formed and may be connected to the gate lines GL during the manufacturing process of the thin film transistors.

The reference gamma voltage generator 10 generates a plurality of reference gamma voltages GMA1 to GMAj with different voltage levels using voltage-dividing resistor strings connected in series and supplies the generated reference gamma voltages to the data driver 8.

The data driver 6 includes one or more data driving devices. Each data driving device in the data driver 6 may be any one of the data driving devices 100 according to the first to fifteenth embodiments of the present invention described above. Thus, the descriptions of each data driving device are not repeated.

The first polarity control signal POL1 supplied to each data driving device of the data driver 6 is provided in the data control signal DCS generated by the timing controller 8. The second polarity control signal POL2 may be fixed at the first logic state or second logic state depending on the display characteristics of the image display panel 2. Alternatively, the first and second polarity control signals POL1 and POL2 supplied to each data driving device 100 of the data driver 6 may be generated by the timing controller 8 in such a manner as to vary with that characteristics of the image display panel 2 or image data to be displayed.

The reference gamma voltages GMA1 to GMAj from the reference gamma voltage generator 10 are supplied to the gamma buffer 125 of each of the data driving devices 100 according to the first to fifteenth embodiments of the present invention as described above.

The liquid crystal display device according to the present embodiment includes one or more data driving devices 100 that can individually control red/green gray scale voltages and blue gray scale voltages. Therefore, it is possible to realize a constant color temperature in the entire area of a black gray scale or white gray scale displayed on the image display panel 2.

Furthermore, in the liquid crystal display device according to the present embodiment, the same number of decoders as that of the output channels of each data driving device 100 are arranged in the D/A converter 142 to convert digital data into image signals. Therefore, it is possible to reduce the size of each data driving device so as to more flexibly cope with the enlargement of the liquid crystal display device.

A data driving device according to the present invention can separately and individually control blue upper and/or lower gray scale voltages and red/green upper and/or lower gray scale voltages to maintain a color temperature based on a gray scale constant. In addition, the same number of decoders as that of output channels of the data driving device are arranged in a digital/analog converter, thereby reducing the size of the data driving device.

Accordingly, a liquid crystal display device according to the present invention that includes a data driving device in accordance with the present invention can separately and individually control blue upper and/or lower gray scale voltages and red/green upper and/or lower gray scale voltages. Therefore, a constant color temperature in the entire area of a black gray scale or white gray scale displayed on an image display panel can be achieved. In addition, because the same number of decoders as that of output channels of the data driving device are arranged in a digital/analog converter to convert digital data into image signals, the size of the data driving device can be reduced so as to more flexibly cope with the enlargement of the liquid crystal display device.

It will be apparent to those skilled in the art that various modifications and variations can be made in the data driving device of the present invention and the liquid crystal display device using the same without departing from the spirit or scope of the invention. Thus, it is intended that the present invention cover the modifications and variations of this invention provided they come within the scope of the appended claims and their equivalents.

What is claimed is:

1. A data driving device for a liquid crystal display, comprising:

a control circuit to relay red (R), green (G), and blue (B) data signals;

a gray scale voltage generator to generate gray scale voltages;

a digital processor to latch the R, G, B data signals; and an analog processor to convert the latched R, G, B data supplied from the digital processor into image signals to be displayed on the liquid crystal display, wherein the gray scale voltage generator includes:

a voltage dividing resistor string to generate blue (B), red (R), and green (G) gray scale voltages using reference gamma voltages, the voltage dividing resistor string, including:

a B gray scale voltage signal generating section generating B gray scale voltages which is used in converting B data into B image signals, a RG-common gray scale voltage generating section generating RG-common gray scale voltages which are common used in converting R data into R image signals and converting G data into G image signals, and a RGB-common gray scale voltage generating section generating RGB-common gray scale voltages which are common used in converting B data into B image signals, converting R data into R image signals and converting G data into G image signals, wherein the B gray scale voltage generating section and the RG-common gray scale voltage generating section individually generate B gray scale voltage and RG-common gray scale voltage in at least one region of a high gray scale region and a low gray scale region, such that the B gray scale voltage generating section and the RG-common gray scale voltage generating section individually control a B gray scale voltage and a RG-common gray scale voltage to maintain a constant color temperature in the at least one region of the high and low gray scale regions, and wherein in the high gray scale region, each of positive B gray scale voltages has a voltage level higher than each of the positive RG-common gray scale voltages and each of the negative B gray scale voltages has a voltage level lower than each of the negative RG-common gray scale voltages, wherein the analog processor comprises:

a digital/analog converter for converting the latched data into the image signals using the positive and negative B gray scale voltages, the positive and negative RG-common gray scale voltages, and the positive and negative RGB-common gray scale voltages, the image signals having polarities corresponding to first and second polarity control signals; and an output buffer for buffering the image signals supplied from the digital/analog converter, wherein the digital/analog converter comprises a plurality of data conversion blocks each comprising twelve channels repetitively arranged in an order of red, green, and blue, each of the data conversion blocks comprising:

a data converter configured to convert the latched red, green, and blue data into the red, green, and blue image signals, respectively, using:

the positive and negative blue gray scale voltages, the positive and negative red/green gray scale voltages, and the positive and negative three-color common gray scale voltages, a data path controller configured to control a path of each of the latched red, green, and blue data from the digital processor to the data converter over first to twelfth input channels, based on the first and second polarity control signals, and an image signal path controller configured to control a path of each of the red, green, and blue image signals from the data converter to the output buffer, based on the first and second polarity control signals.

2. The data driving device of claim 1, wherein:

the B gray scale voltage generating section includes a positive high B gray scale voltage generating section and a negative high B gray scale voltage generating section;

the RG-common gray scale voltage generating section includes a positive high RG-common gray scale voltage generating section and a negative high RG-common gray scale voltage generating section; and the RGB-common gray scale voltage generating section includes a positive RGB-common gray scale voltage generating section and a negative RGB-common gray scale voltage generating section, wherein the voltage driving resistor string includes first, second, third, and fourth portions, the first portion including the positive high B gray scale voltage generating section and the positive high RG-common gray scale voltage generating section, the second portion including the positive RGB-common gray scale voltage generating section, the third portion including the negative RGB-common gray scale voltage generating section, and the fourth portion including the negative high B gray scale voltage generating section and the negative high RG-common gray scale voltage generating section.

3. The data driving device of claim 2, wherein:

the positive high RG-common gray scale voltage generating section is connected to a driving voltage source (VDD); and the negative high RG-common gray scale voltage generating section is connected to a ground voltage source (VSS).

4. The data driving device of claim 2, wherein:

the positive high RG-common gray scale voltage generating section is connected to the positive high B gray scale voltage generating section; and the negative high RG-common gray scale voltage generating section is connected to the negative high B gray scale voltage generating section.

5. The data driving device of claim 1, wherein:

the B gray scale voltage generating section includes a positive low B gray scale voltage generating section and a negative low B gray scale voltage generating section;

the RG-common gray scale voltage generating section includes a positive low RG-common gray scale voltage generating section and a negative low RG-common gray scale voltage generating section; and the RGB-common gray scale voltage generating section includes a positive RGB-common gray scale voltage generating section and a negative RGB-common gray scale voltage generating section, wherein the voltage driving resistor string includes first, second, third, and fourth portions, the first portion including the positive RGB-common gray scale voltage generating section, the second portion including the positive low B gray scale voltage generating section and the positive low RG-common gray scale voltage generating section, the third portion including the negative low B gray scale voltage generating section and the negative low RG-common gray scale voltage generating section, and the fourth portion including the negative RGB-common gray scale voltage generating section.

6. The data driving device of claim 1, wherein:

the B gray scale voltage generating section includes:

a positive high B gray scale voltage generating section, a positive low B gray scale voltage generating section, a negative high B gray scale voltage generating section, and a negative low B gray scale voltage generating section;

the RG-common gray scale voltage generating section includes:

a positive high RG-common gray scale voltage generating section, a positive low RG-common gray scale voltage generating section, a negative high RG-common gray scale voltage generating section, and a negative low RG-common gray scale voltage generating section; and the RGB-common gray scale voltage generating section includes a positive RGB-common gray scale voltage generating section and a negative RGB-common gray scale voltage generating section, wherein the voltage driving resistor string includes first, second, third, fourth, fifth, and sixth portions, the first portion including the positive high B gray scale voltage generating section and the positive high RG-common gray scale voltage generating section, the second portion including the positive RGB-common gray scale voltage generating section, the third portion including the positive low B gray scale voltage generating section and the positive low RG-common gray scale voltage generating section, the fourth portion including the negative low B gray scale voltage generating section and the negative low RG-common gray scale voltage generating section, the fifth portion including the negative RGB-common gray scale voltage generating section, and the sixth portion including the negative low B gray scale voltage generating section and the negative low RG-common gray scale voltage generating section.

7. The data driving device of claim 6, wherein:

the positive high RG-common gray scale voltage generating section is connected to a driving voltage source (VDD); and the negative high RG-common gray scale voltage generating section is connected to a ground voltage source (VSS).

8. The data driving device of claim 6, wherein:

the positive high RG-common gray scale voltage generating section is connected to the positive high B gray scale voltage generating section; and the negative high RG-common gray scale voltage generating section is connected to the negative high B gray scale voltage generating section.

9. The data driving device of claim 1, wherein the RG-common gray scale voltage generating section is connected to an external resistor to fine tune the RG-common gray scale voltage.

10. The data driving device of claim 1, wherein the RG-common gray scale voltage generating section is connected to a multiplexer to selectively connect one or more of a plurality of external resistors to fine tune the RG-common gray scale voltage.

11. The data driving device of claim 1, wherein the RG-common gray scale voltage generating section is connected to an external voltage source to fine tune the RG-common gray scale voltage.

12. The data driving device of claim 1, wherein the RG-common gray scale voltage generating section is separate from the B gray scale voltage generating section and connected to an independent supply voltage source to fine tune the RG-common gray scale voltage.

13. The data driving device of claim 1, wherein the data converter comprises:

first to twelfth decoders including positive decoders for converting the latched data into positive image signals: and negative decoders for converting the latched data into negative image signals, wherein the first to twelfth decoders are repetitively arranged in the order of positive, negative, negative, and positive.

14. The data driving device of claim 13, wherein:

the positive RG-common gray scale voltages and the positive RGB-common gray scale voltages from the gray scale voltage generator are supplied to each of the first, fourth, fifth, and eighth decoders;

the negative RG-common gray scale voltages and the negative RGB-common gray scale voltages from the gray scale voltage generator are supplied to each of the second, seventh, tenth, and eleventh decoders;

the positive B gray scale voltages and the positive RGB-common gray scale voltages from the gray scale voltage generator are supplied to each of the ninth and twelfth decoders; and the negative B gray scale voltages and the negative RGB-common gray scale voltages from the gray scale voltage generator are supplied to each of the third and sixth decoders.

15. The data driving device of claim 14, wherein the data path controller comprises:

a first data path controller for controlling the paths of the latched data supplied over the second to twelfth input channels based on the second polarity control signal; and a second data path controller for controlling the paths of the latched data supplied over the first, second, fifth, sixth, ninth, and tenth input channels and through the first data path controller based on the first polarity control signal to supply the latched data to the first to twelfth decoders, respectively.

16. The data driving device of claim 14, wherein the image signal path controller comprises:

a first image signal path controller for controlling the paths of the image signals supplied from the second to twelfth decoders based on the second polarity control signal; and a second image signal path controller for controlling the paths of the image signals supplied from the first, second, fifth, sixth, ninth, and tenth decoders and through the first image signal path controller based on the first polarity control signal to supply the image signals to respective buffer lines of the output buffer.

* * * * *